US011329432B2

(12) United States Patent
Tsai

(10) Patent No.: US 11,329,432 B2
(45) **Date of Patent: *May 10, 2022**

(54) BIDIRECTIONAL ELECTRICAL CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/001,024

(22) Filed: Aug. 24, 2020

(65) Prior Publication Data

US 2021/0044059 A1 Feb. 11, 2021

Related U.S. Application Data

(62) Division of application No. 15/742,156, filed as application No. PCT/CN2016/089436 on Jul. 8, 2016, now Pat. No. 10,756,488.

(60) Provisional application No. 62/312,714, filed on Mar. 24, 2016, provisional application No. 62/281,765, filed on Jan. 22, 2016, provisional application No. 62/268,085, filed on Dec. 16, 2015, provisional application No. 62/259,742, filed on Nov. 25, 2015, provisional application No. 62/249,526, filed on Nov. 2, 2015, provisional application No. 62/203,441, filed (Continued)

(51) Int. Cl.

| | |
|---|---|
| ***H01R 24/00*** | (2011.01) |
| ***H01R 13/642*** | (2006.01) |
| ***H01R 27/00*** | (2006.01) |
| *H01R 43/24* | (2006.01) |
| *H01R 13/405* | (2006.01) |
| *H01R 24/60* | (2011.01) |

(52) U.S. Cl.
CPC ..... *H01R 13/642* (2013.01); *H01R 27/00* (2013.01); *H01R 13/405* (2013.01); *H01R 24/60* (2013.01); *H01R 43/24* (2013.01)

(58) Field of Classification Search
CPC .... H01R 13/642; H01R 13/405; H01R 24/60; H01R 27/00; H01R 43/24
USPC ..... 439/607.35, 607.4, 660
See application file for complete search history.

(56) References Cited

U.S. PATENT DOCUMENTS

| | | | | |
|---|---|---|---|---|
| 9,627,817 | B2 * | 4/2017 | Chang | H01R 24/64 |
| 9,653,850 | B1 * | 5/2017 | Su | H01R 24/60 |
| 9,660,373 | B2 * | 5/2017 | Tsai | H01R 13/5202 |

(Continued)

FOREIGN PATENT DOCUMENTS

| | | | |
|---|---|---|---|
| CN | 204067650 U | * | 12/2014 |
| CN | 204333399 U | * | 5/2015 |

*Primary Examiner* — Khiem M Nguyen
(74) *Attorney, Agent, or Firm* — WPAT, PC

(57) ABSTRACT

A bidirectional electrical connector includes: a housing made of a metal material; an insulation seat; a tongue; and two rows of contact terminals. Each of the two rows of contact terminals is provided with a contact. The two rows of contacts of the two rows of contact terminals are respectively disposed on the top and bottom sides of the tongue. Top and bottom surfaces of a front section of the tongue are projectingly provided with at least two limit projections, so that the top and bottom surfaces of the front section of the tongue have concave-convex structures, the at least two limit projections project beyond each of the two rows of contacts, and the concave-convex structure on the top and bottom surfaces of the tongue can make each row of contacts be isolated from the housing to prevent each row of contacts from being short-circuited.

19 Claims, 59 Drawing Sheets

Related U.S. Application Data on Aug. 11, 2015, provisional application No. 62/189,799, filed on Jul. 8, 2015.

(56) References Cited

U.S. PATENT DOCUMENTS

| | | | | |
|---|---|---|---|---|
| 9,660,389 | B2 * | 5/2017 | Gao | H01R 24/60 |
| 9,660,399 | B2 * | 5/2017 | Hsu | H01R 24/60 |

* cited by examiner

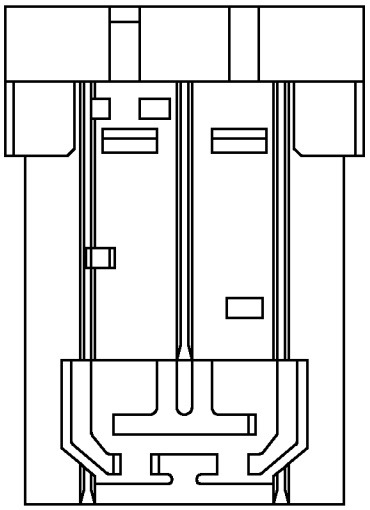
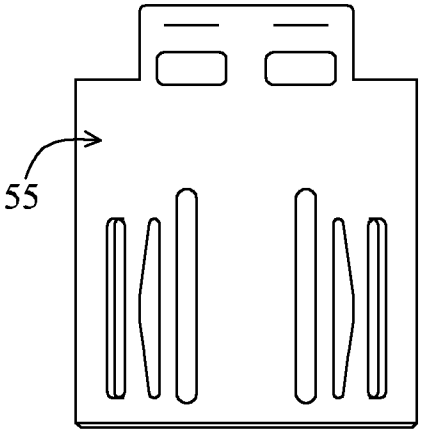
FIG. 32
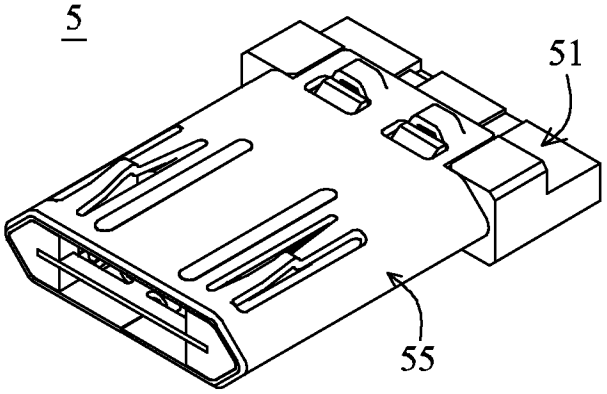
FIG. 30
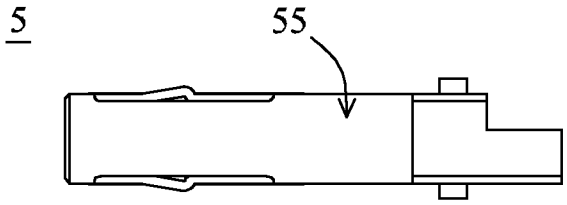
FIG. 31

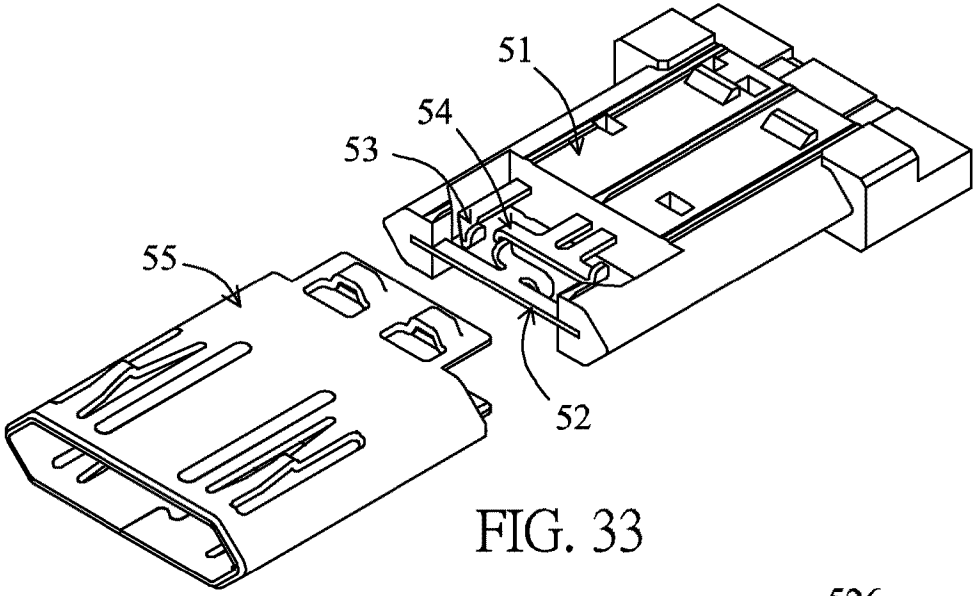
FIG. 33
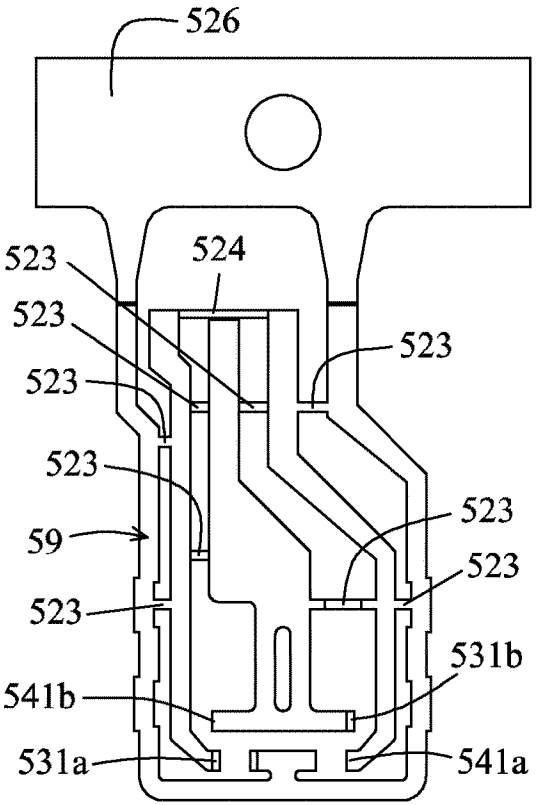
526
524
523
523
523

1q

1q

BIDIRECTIONAL ELECTRICAL CONNECTOR

CROSS-REFERENCE TO RELATED APPLICATIONS

This application is a Divisional Application of U.S. patent application Ser. No. 15/742,156, filed on Jan. 6, 2018, now issued as U.S. Pat. No. 10,756,488 B2, which is a national stage application of PCT Patent Application No. PCT/CN2016/089436, filed on Jul. 8, 2016, which claims priority to U.S. provisional application Ser. No. 62/189,799 filed on Jul. 8, 2015; U.S. provisional application Ser. No. 62/203,441 filed on Aug. 11, 2015; U.S. provisional application Ser. No. 62/249,526 filed on Nov. 2, 2015; U.S. provisional application Ser. No. 62/259,742 filed on Nov. 25, 2015; U.S. provisional application Ser. No. 62/268,085 filed on Dec. 16, 2015; U.S. provisional application Ser. No. 62/281,765 filed on Jan. 22, 2016; and U.S. provisional application Ser. No. 62/312,714 filed on Mar. 24, 2016, the contents of which are incorporated herein by reference.

BACKGROUND OF THE INVENTION

Field of the Invention

The invention relates to a bidirectional electrical connector, and more particularly to a bidirectional electrical connector to be electrically connected to an external circuit board by docking with a complementary electrical connector.

Description of the Related Art

At present, various electronic products have more and more powerful functions, and handheld devices are also getting gradually popular, signal transmission requirements between various products or devices are getting more and more. Based on this, how to dispose more terminal interfaces (e.g., bidirectional electrical connectors or complementary electrical connectors docking therewith), which can perform signal transmission with different devices, in the surrounding contour of the housing of the product or device with the constantly reducing volume has become the goal of the industry's joint efforts. The bidirectional electrical connector is an electrical plug, and the complementary electrical connector is an electrical receptacle.

Before the electrical plug is docked with the electrical receptacle, the correct direction is needed to make the electrical plug face the electrical receptacle, so that both of them can be docked together. That is, the electrical receptacle has the inserting and connecting orientation, which is the so-called mistake-proof function. This function is to ensure the terminal interface on the electrical plug to contact the connection interface on the electrical receptacle. However, many users do not have the habit of placing the electrical plug in the correct direction facing the electrical receptacle, and this mistake-proof function causes the docking failure between the electrical plug and the electrical receptacle on the contrary. Then, the user turns over the electrical plug to perform the correct docking. In other words, this mistake-proof function brings the trouble to the user on the contrary.

Thus, an electrical plug with the duplex docking function is available in the market, and is disclosed in, for example, Taiwan Patent Publication No. TW201440327 disclosing an electrical plug. As shown in FIGS. 15A to 15F of the TW201440327 patent, although the bidirectional electrical connector 1510 can provide the duplex docking function, wherein manufacturing and assembling processes of the crossover terminal box need to be stringently manages so that the precise structure thereof can be implemented. Thus, the manufacturing tolerance of the crossover terminal box is very small. So, the manufacturing and assembling encounter a certain degree of difficulty. In addition, because the crossover terminal box has the complicated interlaced overlapping structure, the positions of the bonding points thereof are not fixed, and it is difficult to perform the bonding work, and this further increase the manufacturing and assembling difficulty thereof.

In addition, there are also several patent publications or patented cases, such as China Patent Application No. 201420215601; 201420486606; or 201520562191, disclosing bidirectional electrical connectors. The disclosed bidirectional electrical connector causes several troubles, such as the increase of the manufacturing or assembling difficulty, the increase of the manufacturing or assembling cost or the short-circuiting concern upon improper use so that the friendly use cannot be provided, upon practical applications.

BRIEF SUMMARY OF THE INVENTION

In view of the deficiencies of the prior art, an objective of the invention is to provide a bidirectional electrical connector, which is capable of facilitating manufacturing and assembling and has a duplex docking function, and is further compatible with the existing electrical receptacle or plug of Micro USB.

Another objective of the invention a is to provide a bidirectional electrical connector that can be conveniently used, wherein in the process of docking the bidirectional electrical connector with a complementary electrical connector, the structure and the action of the tongue of the bidirectional electrical connector can prevent the short-circuited condition from happening so that the user can use it conveniently.

To achieve the above-identified objectives, the invention provides a bidirectional electrical connector, which is capable of docking and positioning with a complementary connector in a reversible dual-positional manner and includes: a housing made of a metal material; an insulation seat; a tongue disposed on a front end of the insulation seat, wherein the housing surrounds the tongue and is formed with a connection slot on top and bottom sides of the tongue, and the tongue is floatingly disposed in a middle section of the connection slot; and two rows of contact terminals, wherein each of the two rows of contact terminals is provided with a contact, the two rows of contacts of the two rows of contact terminals are respectively disposed on the top and bottom sides of the tongue, each of the two rows of contacts form a contact interface, and at least one pair of the contacts of the same circuit in the two contact interfaces are arranged reversely; wherein top and bottom surfaces of a front section of the tongue are projectingly provided with at least two limit projections, so that the top and bottom surfaces of the front section of the tongue have concave-convex structures, the at least two limit projections project beyond each of the two rows of contacts in an up-down direction, and the concave-convex structures of the top and bottom surfaces of a front section of the tongue can make each of the two rows of contacts be isolated from the housing to prevent each of the two rows of contacts from being short-circuited.

In the bidirectional electrical connector, each of the two rows of contacts are connected to at least one row of extensions, the at least one row of extensions are extended and connected to at least one row of fixing portions, the at least one row of fixing portions are fixed to the insulation seat, the at least one row of fixing portions are connected to at least one row of pins, and the at least one row of pins extend out of the insulation seat.

In the bidirectional electrical connector, the at least two limit projections are two limit projections disposed on left and right sides of the tongue, so that the tongue has an H-shaped tongue structure.

In the bidirectional electrical connector, the H-shaped tongue structure comprises the two limit projections having at least two outer sides with thicker dimensions and a middle section partition plate having a middle section with a thinner dimension.

In the bidirectional electrical connector, the two rows of contact terminals rest against the middle section partition plate, and each of the two rows of contacts project beyond middle section partition plate.

In the bidirectional electrical connector, the at least two limit projections are disposed on two outer sides of the two rows of contacts.

In the bidirectional electrical connector, there are more than two limit projections disposed between each of the rows of the contacts.

In the bidirectional electrical connector, in D+ and D− contact terminals of the two rows of contact terminals, width dimensions of the contacts and the extensions are narrower than width dimensions of the contacts and the extensions of ground and power contact terminals.

In the bidirectional electrical connector, in the D+ and D− contact terminals of the two rows of contact terminals, width dimensions of the fixing portions and the pins are narrower than width dimensions of the fixing portions and the pins of the ground and power contact terminals.

In the bidirectional electrical connector, the two rows of contacts are longer contacts on at least two sides.

In the bidirectional electrical connector, each of the two rows of contacts is provided with a bevel guide and a connection point.

In the bidirectional electrical connector, a hollow region is disposed between the tongue and the insulation seat, the tongue is connected to the insulation seat through at least two metal elastic sheets, and the tongue can float up and down relatively to the insulation seat through elastic movements of the at least two metal elastic sheets.

In the bidirectional electrical connector, the bidirectional electrical connector is applicable to: an adapter device comprising a HUB expander, a power bank/charger/mobile power, or a flash drive/U-disk/thumb drive/mobile hard drive; or another electronic device.

In the bidirectional electrical connector, the contacts of the two contact interfaces of the same circuit are arranged reversely; or the contacts of the two contact interfaces of the same contact interface and the same circuit are arranged reversely.

In the bidirectional electrical connector, the contacts of the two contact interfaces of the same circuit are electrically connected together; or the contacts of the two contact interfaces of the same contact interface and the same circuit are electrically connected together; or in the two contact interfaces, the contacts of the same ground circuit are electrically connected, together, and the contacts of the same power circuit are electrically connected together.

In the bidirectional electrical connector, the two contact interfaces are respectively provided with contacts of ground circuits, contacts of power circuits and contacts of D+ and D− signal circuits.

In the bidirectional electrical connector, the two rows of contact terminals are embedded into the insulation seat to be one-time plastic injection molded the tongue; or the two rows of contact terminals are one-time embedded and plastic injection molded.

In the bidirectional electrical connector, the contacts of the same ground circuit and the same power circuit in the upper and lower rows of contact terminals are connected to a transversal extension in a top-bottom and one-left-one-right manner, and the transversal extensions of the same circuit are embedded into, injection molded with and fixed to the tongue.

In this invention, the concave-convex structures of the top and bottom sides of a front section of the tongue can isolate each of the two rows of contacts from the housing to prevent each of the two rows of contacts from being short-circuited.

The main embodiments in the summary of the invention includes the third preferred embodiment corresponding to FIGS. 12 to 20, the eleventh preferred embodiment corresponding to FIGS. 60 and 61, the twelfth preferred embodiment corresponding to FIGS. 62 to 69, the 14th preferred embodiment corresponding to FIG. 75 to FIG. 81, the 16th preferred embodiment corresponding to FIG. 89 to FIG. 96, the 19th preferred embodiment corresponding to FIGS. 106 to 114 and the 28th preferred embodiment corresponding to FIGS. 139 to 144.

The bidirectional electrical connector of the invention can be conveniently manufactured and assembled and has the duplex docking function, and is further compatible with the existing electrical receptacle or plug of Micro USB. The connector can be conveniently. Upon docking with the complementary electrical connector, the structure and action of the tongue of the bidirectional electrical connector can avoid the short-circuited condition to facilitate the use. The snap design of the metal housing can ensure the docking smoothness and stability, and optimize the performance of the bidirectional electrical connector. So, the bidirectional electrical connector of the invention can satisfy the requirements of the higher specification or standard.

BRIEF DESCRIPTION OF THE SEVERAL VIEWS OF THE DRAWINGS

FIGS. 29 to 33 are a top view, a pictorial front view, a side view, a partial structural top view and a structural decomposed schematic view showing the bidirectional electrical connector according to the seventh preferred embodiment of the invention.

FIG. 34 is a structural schematic top view showing the terminal and the tongue of the bidirectional electrical connector according to the seventh preferred embodiment of the invention.

FIG. 35 is a structural pictorial view showing the terminal and the tongue of the bidirectional electrical connector according to the seventh preferred embodiment of the invention.

DETAILED DESCRIPTION OF THE INVENTION

Figure 1:
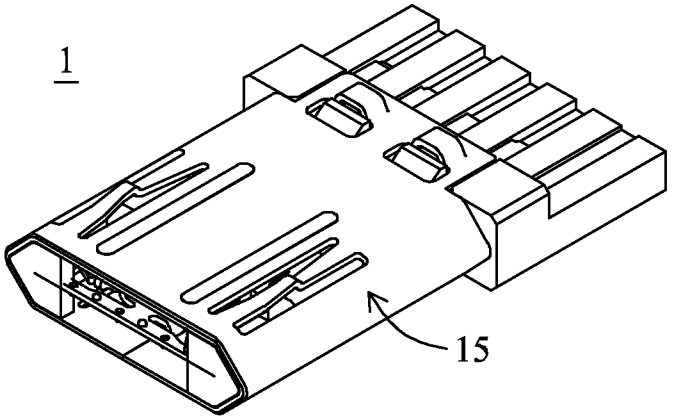
FIGS. 1 to 6 are a structural view, a structural side view, a structural top view, a structural front view, a partial structural decomposed schematic view, and a partial structural decomposed schematic top view showing bidirectional electrical connector according to a first preferred embodiment of the invention.
Figure 2:
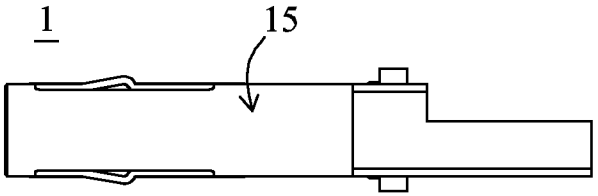
Figure 3:
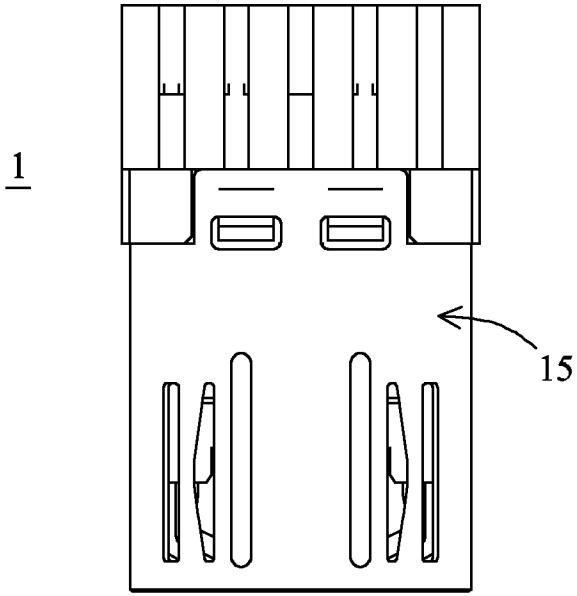
Figure 4:
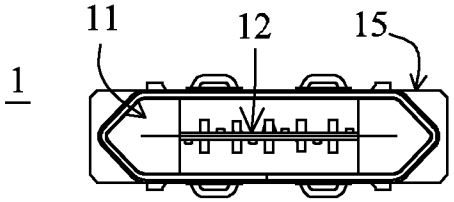
Figure 6:
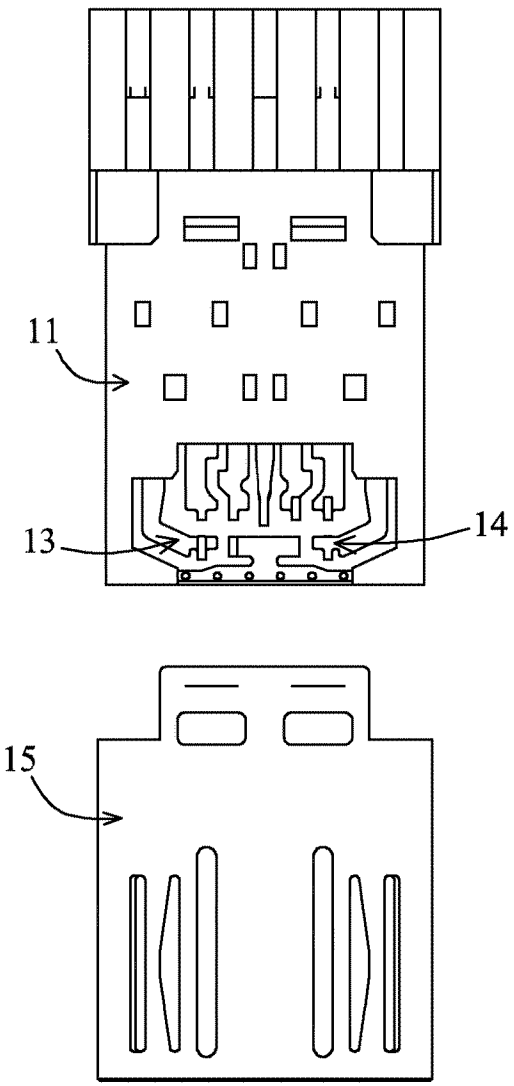
Figure 5:
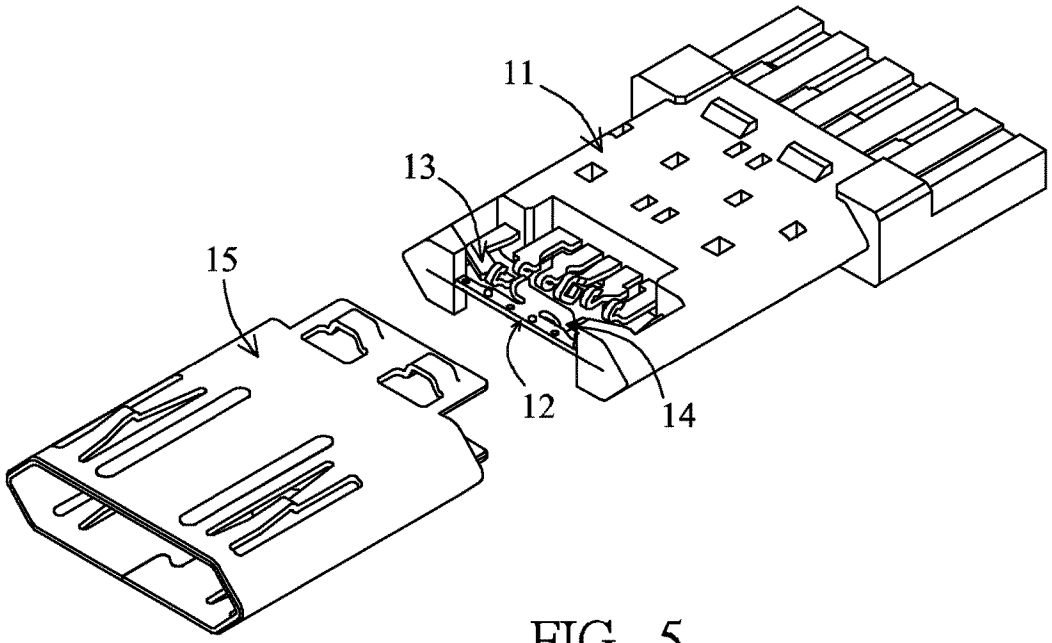
Figure 7:
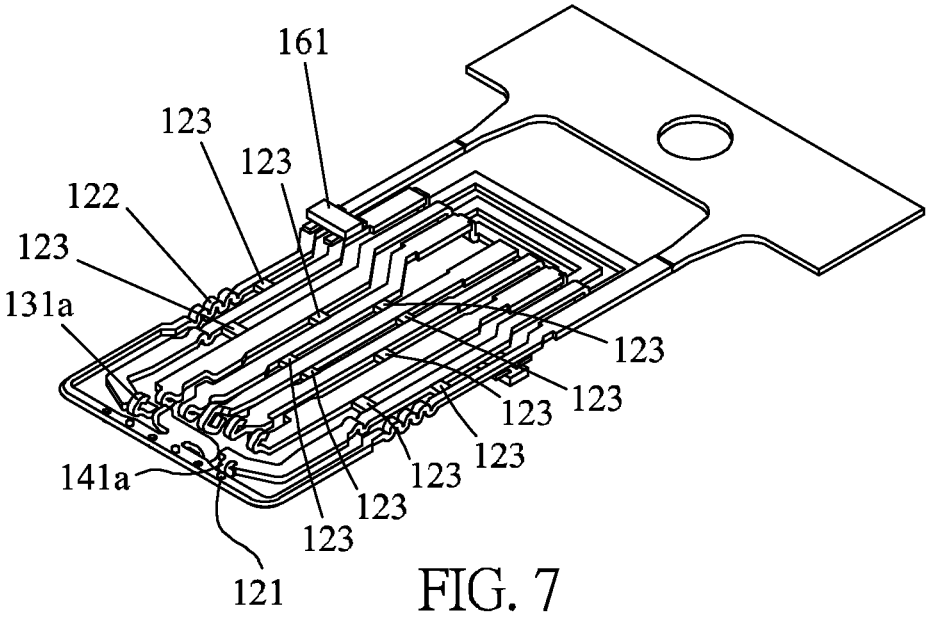
FIG. 7 is a pictorially schematic structural side view showing multiple upper contact terminals and multiple lower contact terminals of the bidirectional electrical connector according to a first preferred embodiment of the invention.
Figure 8:
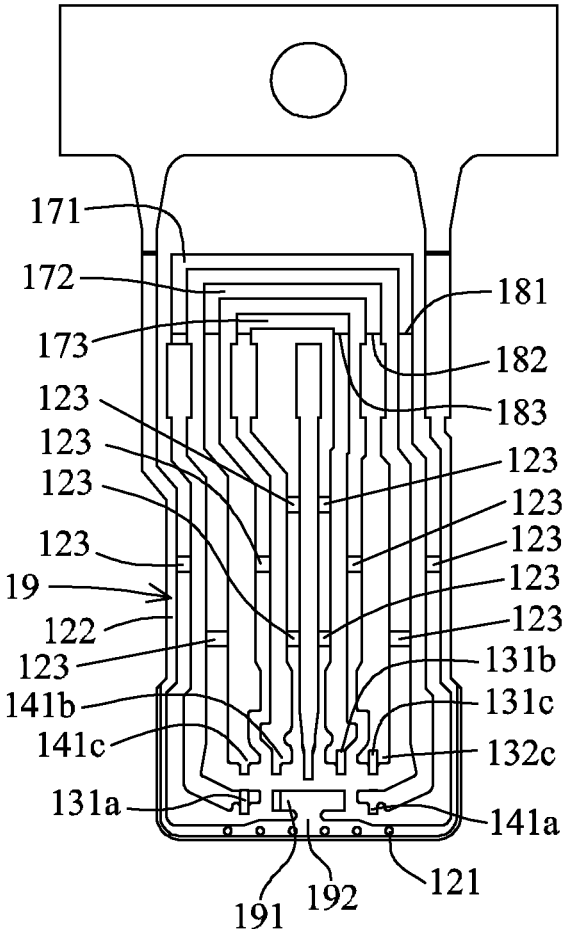
FIG. 8 is a schematic structural top view showing multiple upper contact terminals and multiple lower contact terminals of the bidirectional electrical connector according to the first preferred embodiment of the invention.

Although most of the bidirectional electrical connectors of the invention are in the form of electrical plugs to be explained, the bidirectional electrical connector is not restricted to the electrical plug. Actually, the bidirectional electrical connector may also be an electrical receptacle. At this time, the complementary electrical connector docking therewith is the electrical plug. That is, when the bidirectional electrical connector is the electrical plug, the complementary electrical connector is the electrical receptacle. On the contrary, when the bidirectional electrical connector is the electrical receptacle, the complementary electrical connector is the electrical plug.

The applicant hereby firstly states that the implementation concept of the bidirectional electrical connector of the invention is applicable to at least a USB A-type bidirectional plug, a USB A-type bidirectional socket, a MICRO USB bidirectional plug, a USB C-type bidirectional plug and a USB C-type bidirectional socket and the similar device, but is not restricted thereto.

In addition, the upper and lower contact interfaces of the bidirectional electrical connector of the invention are respectively at least one upper row of contact terminals and at least one lower row of contact terminals. During production, the interval space for stamping of each terminal set of one of the rows of contact terminals may be utilized, and the interval space is utilized to stamp the other row of contact terminals, or further another metal member (metal partition plate or elastic sheet). With the above-mentioned approach, in addition to saving of the material and processing costs of the terminal or metal component, the upper and lower rows of terminals or another metal member (metal partition plate or elastic sheet) can be simultaneously electroplated at a time, and the subsequent assembling or embedding and injection molding of the insulation seat can be facilitated to save the costs of electroplating of the terminal and metal component (metal partition plate or elastic sheet) and the injection molding of the insulation seat, and to save the convenient assembling and processing costs.

The contact interface of the invention may include several sections or portions, such as but without limitation to, contacts, extensions, turning extensions, step portions, fixing portions, pins and the like. In different implementation aspects, sections or portions that may be included in the contact interface may be different, but pertain to the contact interface of the invention. Second, the pin of the invention may also have other aspects, such as a serial hole, a penetration structure, a parallel structure and the like, which are mainly fixed to or electrically connected to circuit board or other wires. The contact mainly interacts and contacts with the docking complementary electrical connector. The extension mainly extends to the location between the tongue and the insulation seat. When the hollow area is held between the tongue and the insulation seat in this invention, several extensions are elastically movable in many implementation aspects. The fixing portion mainly positions the contact interface at the insulation seat, and is usually covered in the insulation seat. Then, the function of each section of the invention is not restricted thereto, and may be slightly adjusted according to the actual implementation aspects.

In the following, several preferred embodiments are further illustrated to illustrate the present invention. However, those skilled in the art will understand that this is simply an example and does not limit the invention or creation itself. The upper and lower contact interfaces of the bidirectional electrical connector of the invention may be a MICRO USB/USB A-type/USB C-type plug or socket to be explained hereinbelow.

Referring to FIGS. 1 to 8, the bidirectional electrical connector 1 of the first embodiment includes a housing 15, an insulation seat 11, a tongue, multiple upper contact terminals 13 of the upper contact interface and multiple lower contact terminals 14 of the lower contact interface. The housing 15 fit with the insulation seat 11 can protect the tongue, the upper contact terminal 13 and the lower contact terminal 14. In the first embodiment, the bidirectional electrical connector 1 may be applied to the MICRO USB bidirectional plug, the housing 15 surrounds the tongue and is formed with a connection slot on top and bottom sides of the tongue, and the tongue is the middle section fixed to the connection slot. The tongue of the bidirectional electrical connector 1 is a fixed metal tongue, the insulation seat 11 disposed on the rear section of the tongue covers the left and right two sides of the metal member 12 of the tongue.

Figure 9:
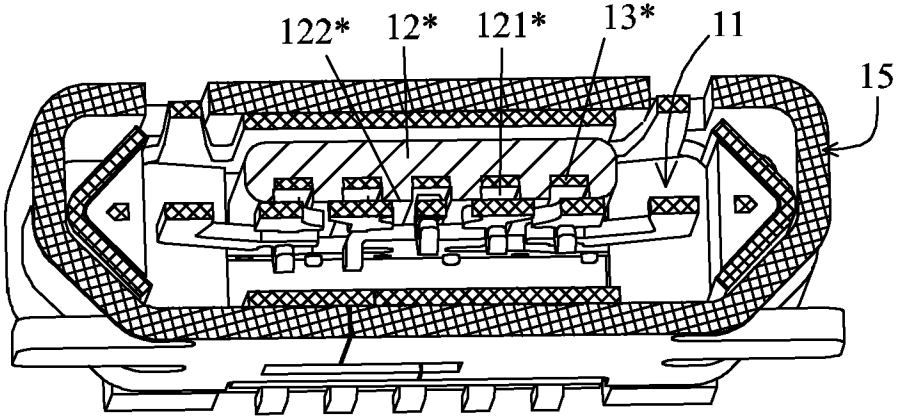
FIG. 9 is a schematically partial structural cross-sectional view showing the bidirectional electrical connector of the first preferred embodiment of the invention docking with the complementary connector.

FIG. 9 is a partially schematically cross-sectional view showing the bidirectional electrical connector 1 docking with the complementary connector. Referring to FIGS. 1 to 9, the metal member 12 of the tongue, the multiple upper contact terminals 13 and the multiple lower contact terminals 14 are made of one metal plate, and a metal material bridge 126 is reserved at the rear ends of the metal member 12 of the tongue, the multiple upper contact terminals 13 and the multiple lower contact terminals 14. It is to be explained that because the metal member 12 of the tongue, the multiple upper contact terminals 13 and the multiple lower contact terminals 14 are made of one metal plate, the portions of the structures may be partially shared, so the following several portions may be the metal member 12 of the tongue, and may also be portions of the upper contact terminal 13 and the lower contact terminal 14. Also, the multiple upper contact terminals 13 and the multiple lower contact terminals 14 made of one metal plate can form different aspects of contacts. For example, the contact 131*a* is in a reversely bent and forward form, and the contact 141*a* is in a sectional form. Thus, the some contacts of the invention may contact using the sectional sections or reversely bent plate surface sections, but the invention is not restricted thereto. Also, when the explanation is made using one single contact terminal 13, the width of the extension 132*c* of the contact terminal 13 is greater than the width of the slot 121* of the complementary connector, so that the extension 132*c* can cross over the separation column 122* of the complementary connector to further avoid the short-circuit condition.

Referring further to FIGS. 1 to 9, one or multiple anti-short-circuit bumps 121 may be disposed on the metal member 12 of the tongue, the anti-short-circuit bumps 121 may rest against the separation column 122* of the tongue 12* of the complementary connector to prevent the upper contact terminal 13 or lower contact terminal 14 from falling within the slot 121* of the tongue 12*, so as to prevent the short-circuited condition from occurring. It is to be explained that based on the property that the contact interface of the complementary connector is disposed in the slot 121* of the tongue 12*, when the metal member 12 of the tongue of this embodiment approaches the tongue 12* of the complementary connector upon docking, no short-circuited condition occurs. So, the provision of the anti-short-circuit bump 121 is optional. Considering the separation column 122* of the tongue 12* of the complementary connector may worn after being used for a period of time, the additional anti-short-circuit bump 121 can further avoid the short-circuited condition.

Referring further to FIGS. 1 to 8, one or multiple terminal material bridges 123 are provided between the upper contact terminal 13, the lower contact terminal 14 and the metal member 12 of the tongue, and the terminal material bridge 123 is connected to the upper contact terminal 13, the lower contact terminal 14 and the metal member 12 of the tongue, so that the assembling convenience and stability can be enhanced. Also, convex recessed structures 122 are provided on the upper contact terminal 13 and the lower contact terminal 14 to adjust and control the position of one or multiple contacts (the explanation is made with reference to the contact 131*a*) of the upper contact terminal 13, or control the position of the one or multiple contacts (the explanation is made with reference to the contact 141*a*) of the lower contact terminal 14 in response to the requirement. Also, an inverse-U shaped or U-shaped integral metal terminal link structure is provided between the two contacts of the same circuit, or a bent step is provided on the rear end of the insulation seat 11. Taking the contact 131*a* and the contact 141*a* of the same circuit as an example, the contact 131*a* and the contact 141*a* facing the rear end of the insulation seat 11 have a U-shaped link structure 171, and may further include a bent step 181. The contact 131*a* is an upwardly bent and reversely forward contact, and the contact 141*a* is a downward surface-broken contact. The other ones of the same circuit may have similar structures: the contact 131*b* and the contact 141*b* are the same circuit, the rear end is provided with the U-shaped link structure 172 and the bent step 182; and the contact 131*c* and the contact 141*c* are the same circuit, and the rear end is provided with the U-shaped link structure 173 and the bent step 183, wherein the contact 131*b* and the contact 131*c* are upward contacting contacts, and the contact 141*b* and the contact 141*c* are downward contacting contacts. Thus, the upward contacting contacts 131*a* to 131*c* and the downward contacting contacts 141*a* to 141*c* are the same circuit, and are sequentially arranged reversely and have the same circuit serial number electrically connected together.

Referring further to FIGS. 1 to 8, the bidirectional electrical connector 1 may include a detection contact with a detection function. For example, taking the contact 131*a* with the grounding function as an example, one side of the contact 131*a* is provided with a detection contact 191, the detection contact 191 and the contact 131*a* are a split-type structure, and the detection contact 19 is integrally provided on the top and bottom of the middle section of the transversal extension 192 of the front end of an outer inverse-U shape 19. Also, a resistor 161 capable of controlling flowing direction of the charge current is disposed between the contact 131*a* of the grounding function and a detection contact 191 with a detection function.

The contacts of the two rows of contacts of the same circuit are integrally connected to a transversal extension in a top-bottom and one-left-one-right manner. The transversal extension pertains to each of the U-shaped link structures 171, 172 and 173, and the one or multiple pairs of contacts of the same circuit are equidistant from the insert interface of the connection slot.

Figure 11:
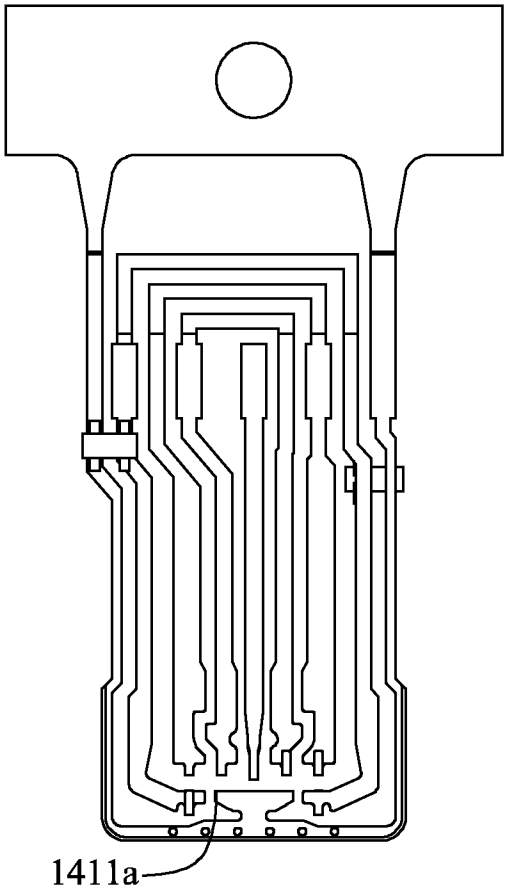
FIG. 11 is a schematic structural top view showing multiple upper contact terminals and multiple lower contact terminals of the bidirectional electrical connector according to the second preferred embodiment of the invention.
Figure 10:
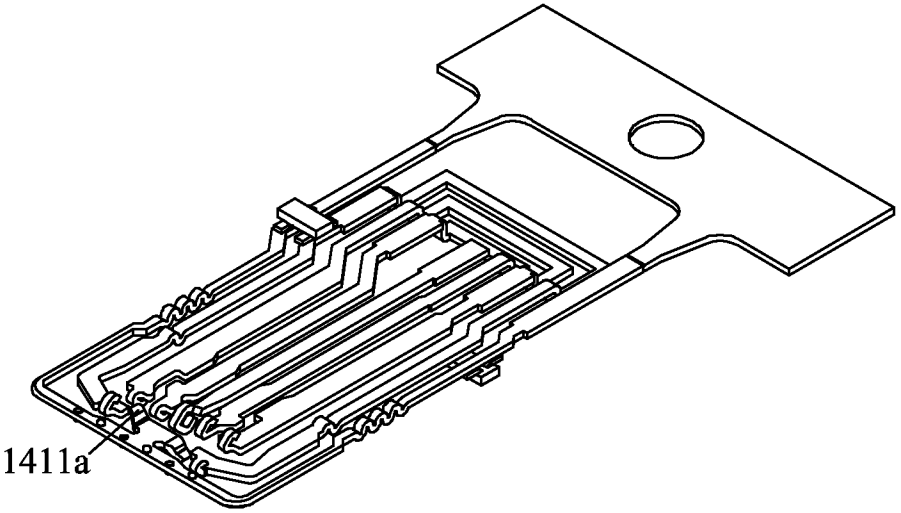
FIG. 10 is a pictorially schematic structural side view showing multiple upper contact terminals and multiple lower contact terminals of the bidirectional electrical connector according to a second preferred embodiment of the invention.
Figure 12:
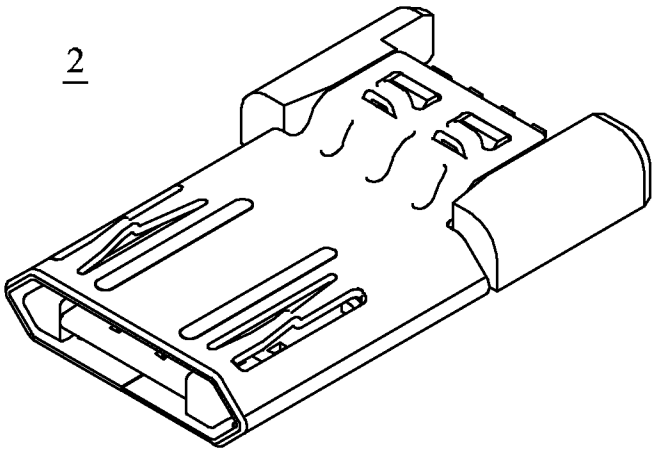
FIGS. 12 to 17 are a structural view, a structural side view, a structural top view, a structural front view, a partial structural decomposed view and a structural decomposed schematic top view showing the bidirectional electrical connector according to the third preferred embodiment of the invention.
Figure 13:
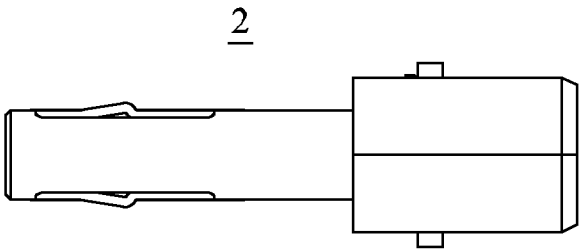
Figure 14:
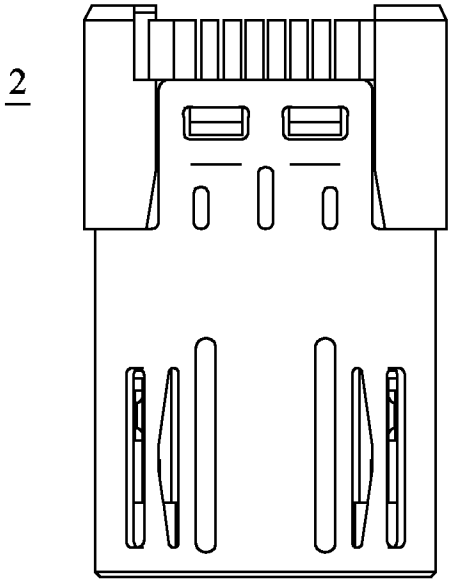
Figure 15:
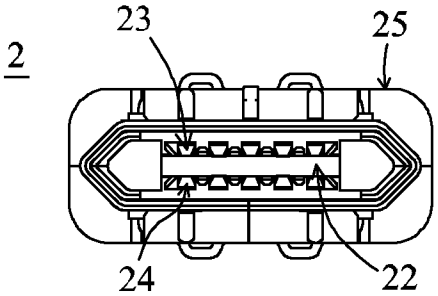
Figure 17:
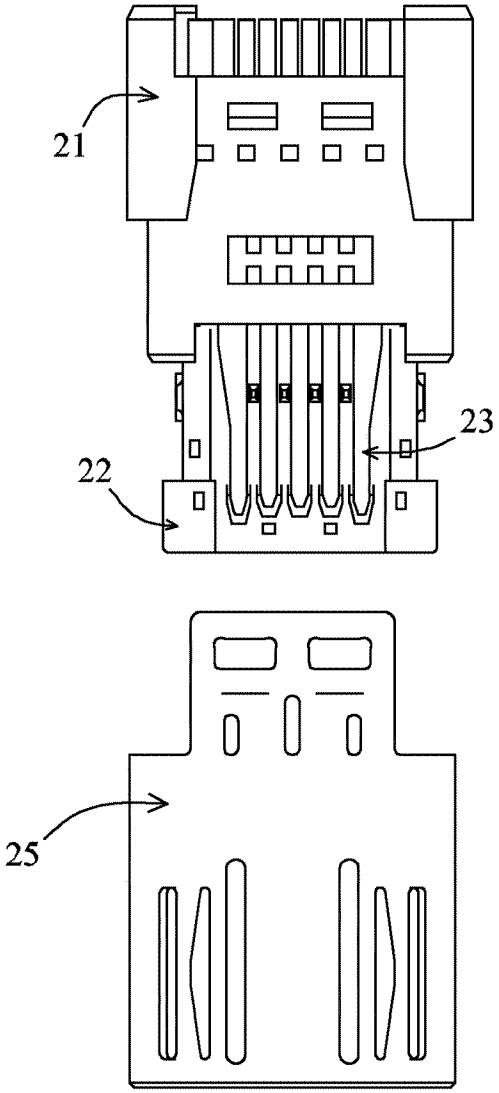
Figure 16:
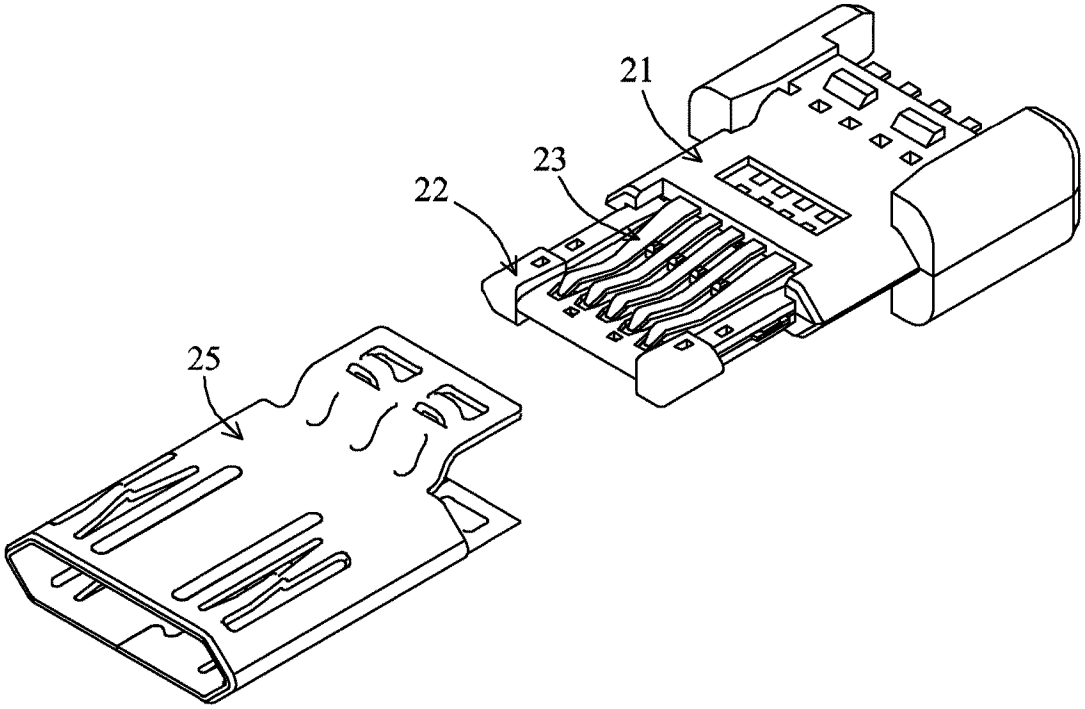

Referring to FIGS. 10 and 11, the difference between the upper and lower contact terminals of the second and first embodiments is that the contact 1411*a* may contact using the bent plate surface section (i.e., the reversely bent forward contact and the plate surface bent contact in the drawings). Thus, the contact terminals of the bidirectional electrical connector of the invention may have one or multiple forms of contacts capable of achieving the electrical connecting function upon forwardly and reversely docking with the complementary electrical connector. According to the descriptions mentioned hereinabove, the first and second embodiments may be applied to the Micro USB plug, which is a fixed metal tongue structure, wherein the metal tongue and the upper and lower contact terminals to form embedded molding with the insulation seat at a time, and one metal plate is pressed to form the fixed metal tongue with at least three, four or five top, bottom, front and rear contacts, and the U-shape integral metal terminal links the same circuit structure.

Referring to FIGS. 12 to 18, the housing 25 of the bidirectional electrical connector 2 of the third embodiment covers the tongue 22 and the insulation seat 21, the housing 25 is made of a metal material, the tongue 22 and the insulation seat 21 adopts the design of the three-piece structure combining the upper insulation base seat 211, the tongue 22 and the lower insulation base seat 212. Second, in response to the combination of three of them, the upper insulation base seat 211, the tongue 22 or/and the lower insulation base seat 212 may include several combined structures. For example, the pillar 2121 of the lower insulation base seat 212 may match with the hole 225 of the tongue 22. Furthermore, one row of upper contact terminals 23 and one row of lower contact terminals 24 are respectively disposed on the top and bottom sides of the tongue 22. Any upper contact terminal 23 includes a connection point, an elastically movable portion, a fixing portion and a pin 234, so does each lower contact terminal 24. The two rows of connection points are respectively disposed on the top and bottom sides of the tongue 22. Each elastically movable extension is connected to the corresponding connection point and one end of the fixing portion. The pin 234 and the pin 244 connected to the other end of the corresponding fixing portion extend out of the insulation seat 21.

Referring further to FIGS. 12 to 18, the tongue 22 is a floating insulation tongue structure, the portions of the tongue 22 neighboring two side surfaces of the housing 25 are thicker than the middle portion of the tongue 22. In the third embodiment, the tongue 22 includes two limit projections 222 and middle section or middle section partition plate 221 disposed between the two limit projections 222, wherein the thickness of any limit projection 222 is greater than that of the middle section partition plate 221, so that the tongue 22 has an H-shaped tongue structure, and that the top and bottom sides of the front section of the tongue 22 have concave-convex structures. The at least two limit projections 22 project beyond one row of contacts of the row of upper contact terminals 23 and one row of contacts of the row of lower contact terminals 24 in the up-down or vertical direction. The concave-convex structures of the top and bottom sides of the front section of the tongue 22 can make each of the two rows of contacts be isolated from the housing 25 to prevent each of the two rows of contacts from being short-circuited. Second, the top and bottom surfaces of the front end of the middle section partition plate 221 may respectively include one row of separately arranged limit portions, which are multiple limit slots 224 (or referred to as terminal limit slots), the top and bottom surfaces of the middle section of the middle section partition plate 221 may respectively include separately arranged multiple guide structures 223. In one embodiment, any upper contact terminal 23 and any lower contact terminal 24 may respectively rest against the top and bottom sides of the middle section partition plate 221, the contact of any upper contact terminal 23 corresponds to the limit slot 224 of the top and bottom sides, the corresponding limit slot 224 limits the front end and two sides of the front bevel 2312 of the contact, and the elastically movable connection point 2311 of the contact projects beyond the highest location of the corresponding limit slot 224 (based on the bottom portion 2242 of the limit slot 224). Similarly, the lower contact terminal 24 also have the same property, so detailed descriptions thereof will be omitted.

Figure 18:
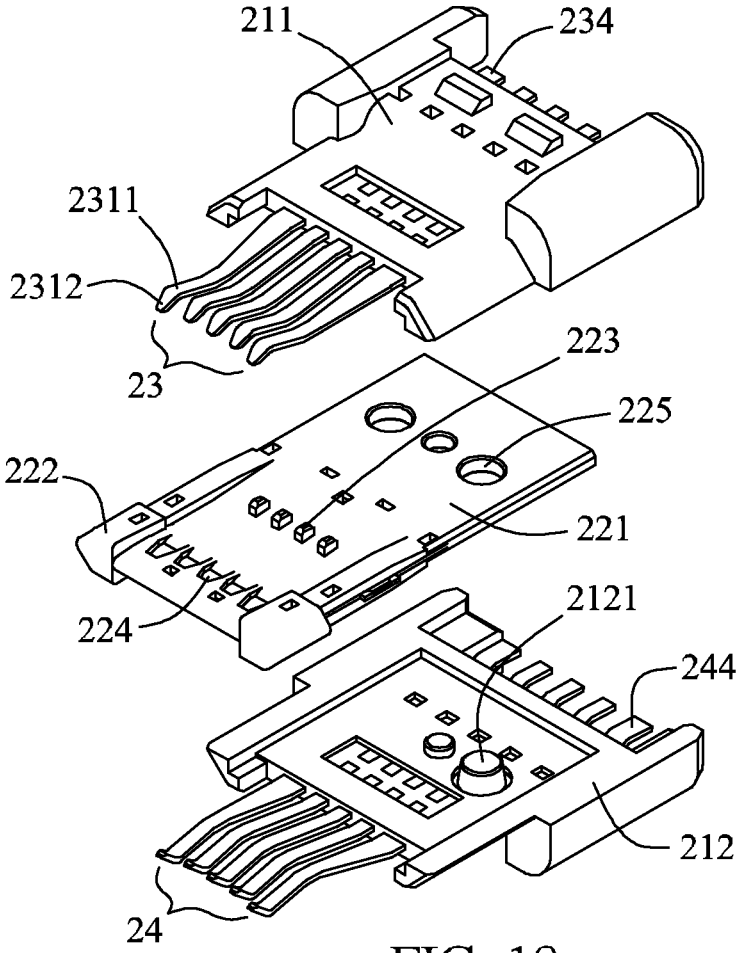
FIG. 18 is a structural decomposed schematic view showing the insulation seat and the tongue of the bidirectional electrical connector according to the third preferred embodiment of the invention.
Figure 19:
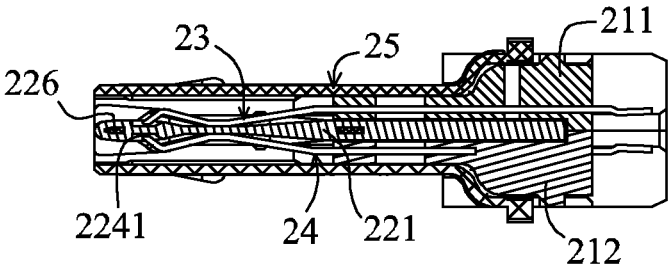
FIG. 19 is a schematically structural cross-sectional view showing different designs of the bidirectional electrical connector according to the third preferred embodiment of the invention.
Figure 20:
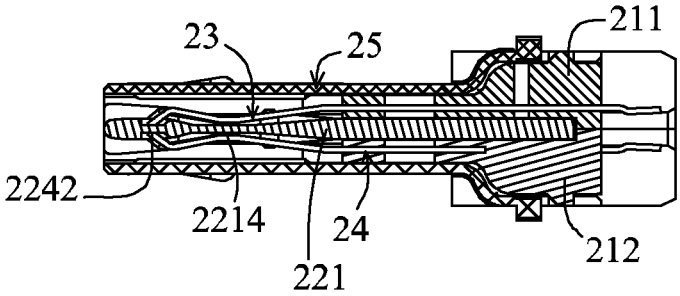
FIG. 20 is a schematically structural cross-sectional view showing different designs of the bidirectional electrical connector according to the third preferred embodiment of the invention.
Figure 23:
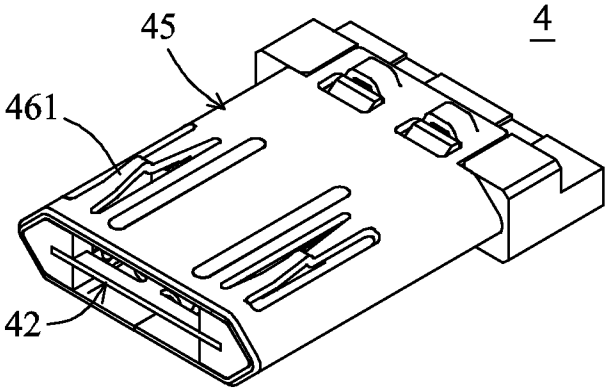
FIGS. 21 to 26 are a structural top view, a structural front view, a structural view, a structural side view, a partial structural top view and a structural decomposed schematic view showing the bidirectional electrical connector according to the sixth preferred embodiment of the invention.
Figure 24:
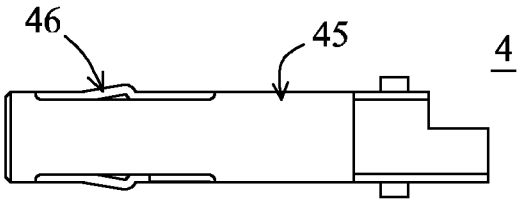
Figure 21:
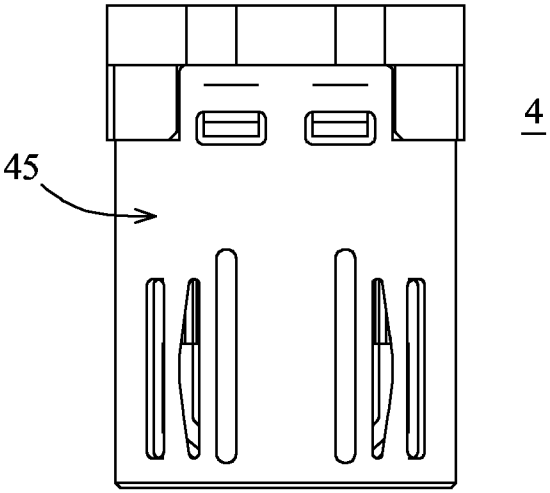
Figure 22:
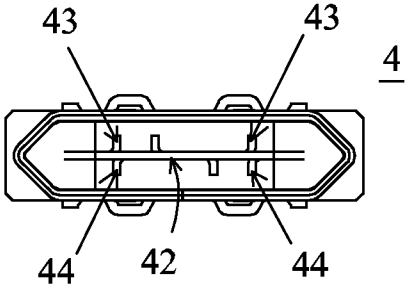
Figure 26:
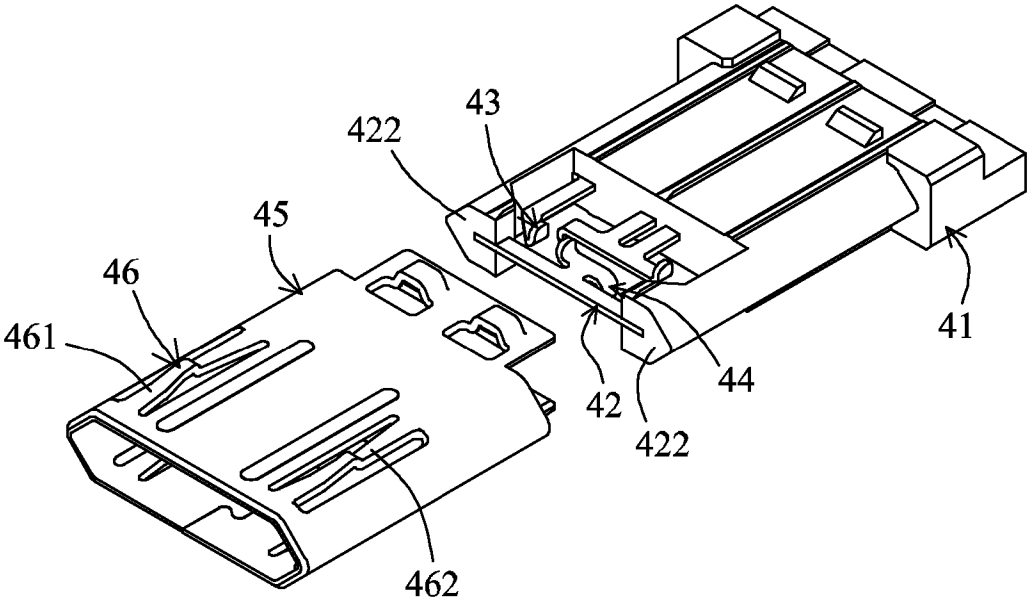
Figure 25:
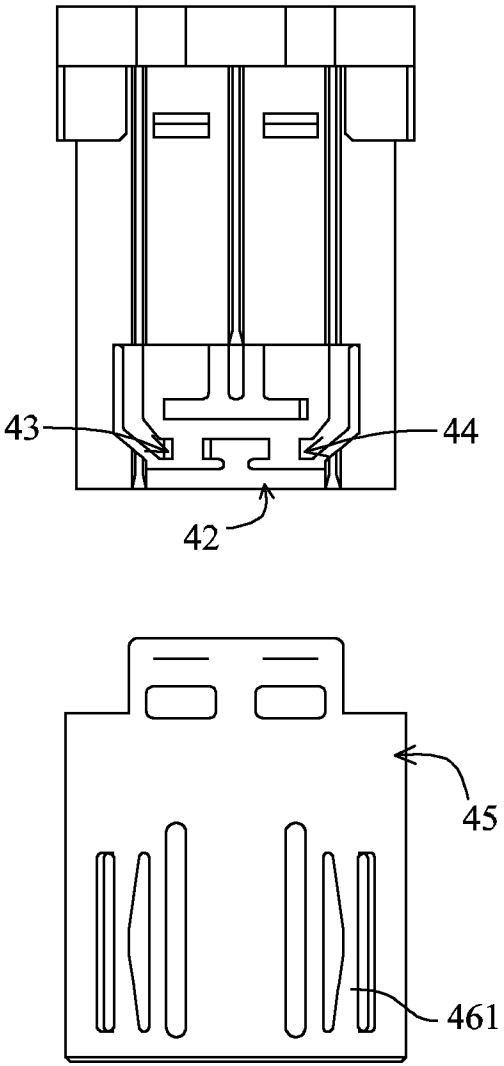
Figure 28:
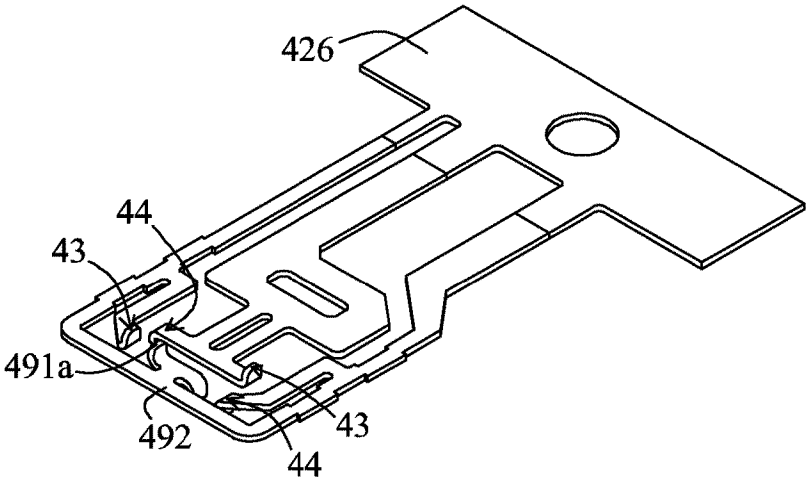
FIG. 28 is a structural pictorial view showing the terminal and the tongue of the bidirectional electrical connector according to the sixth preferred embodiment of the invention.
Figure 29:
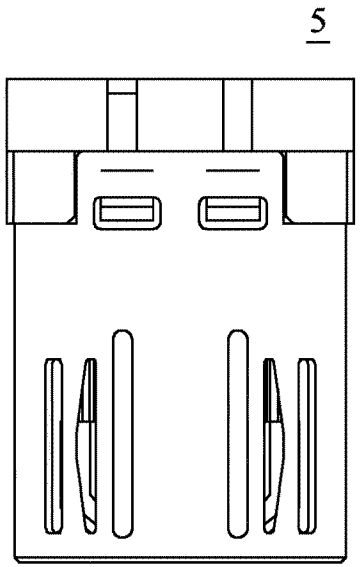
Figure 27:
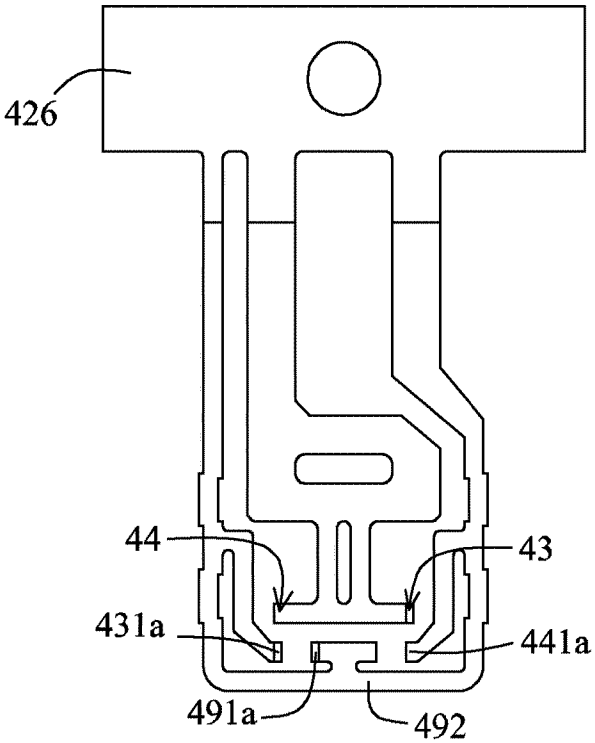
FIG. 27 is a structural schematic top view showing the terminal and the tongue of the bidirectional electrical connector according to the sixth preferred embodiment of the invention.
Figure 38:
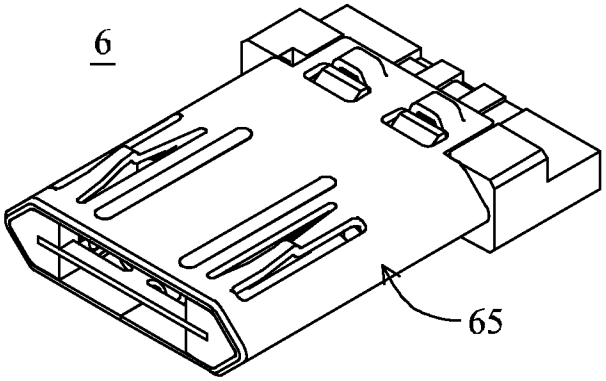
FIGS. 36 to 41 are a top view, a front view, a pictorial side view, a side view, a structural decomposed top view and a structural decomposed pictorial view showing the bidirectional electrical connector according to the eighth preferred embodiment of the invention.
Figure 39:
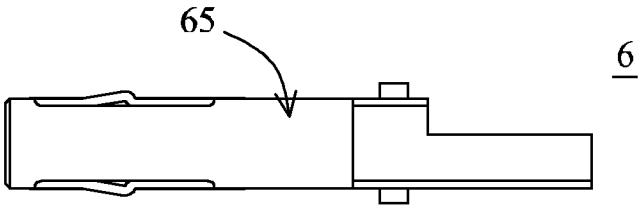
Figure 36:
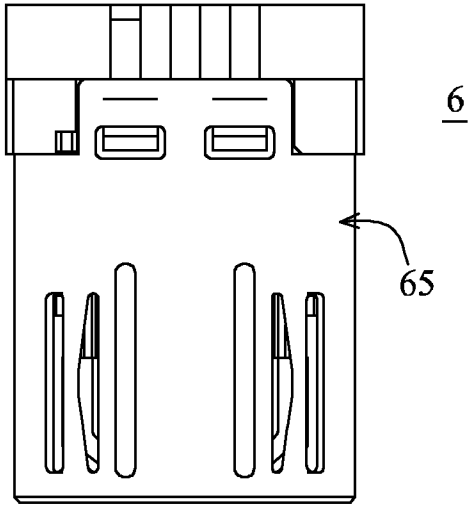
Figure 37:
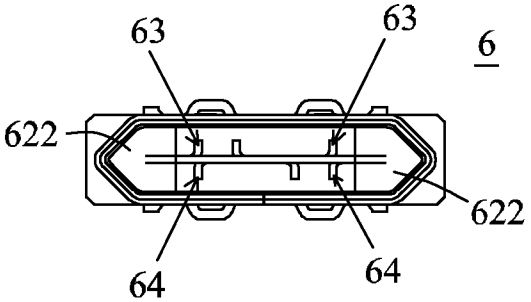
Figure 41:
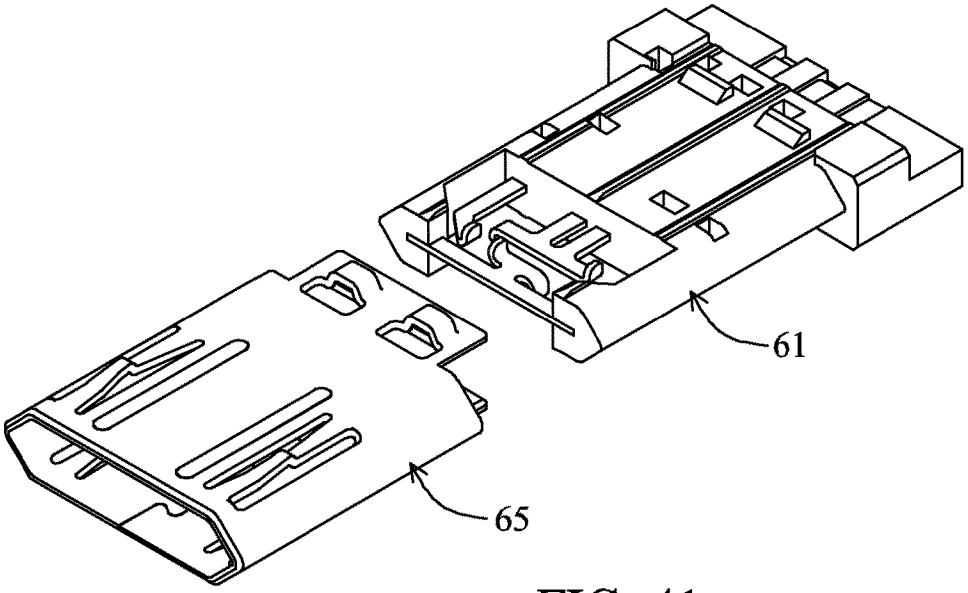
Figure 40:
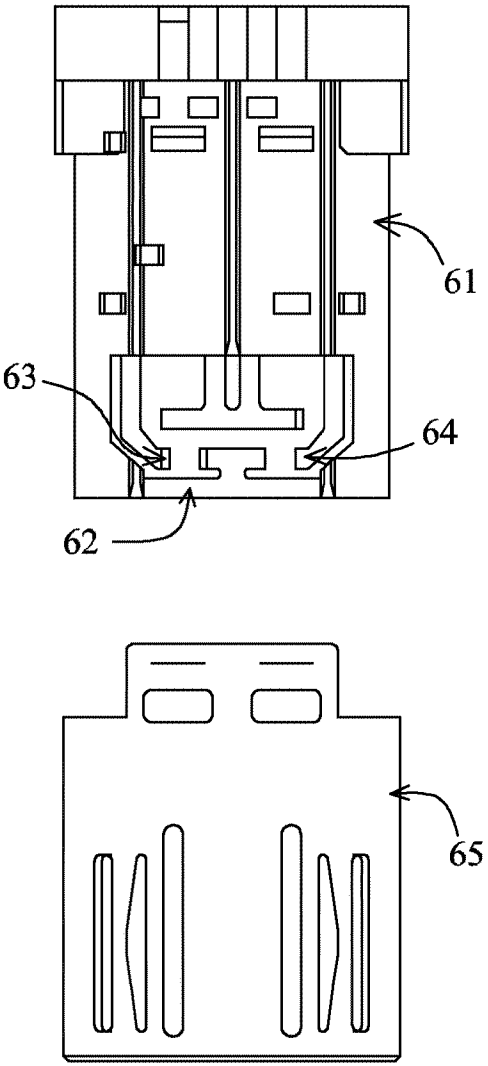
Figure 43:
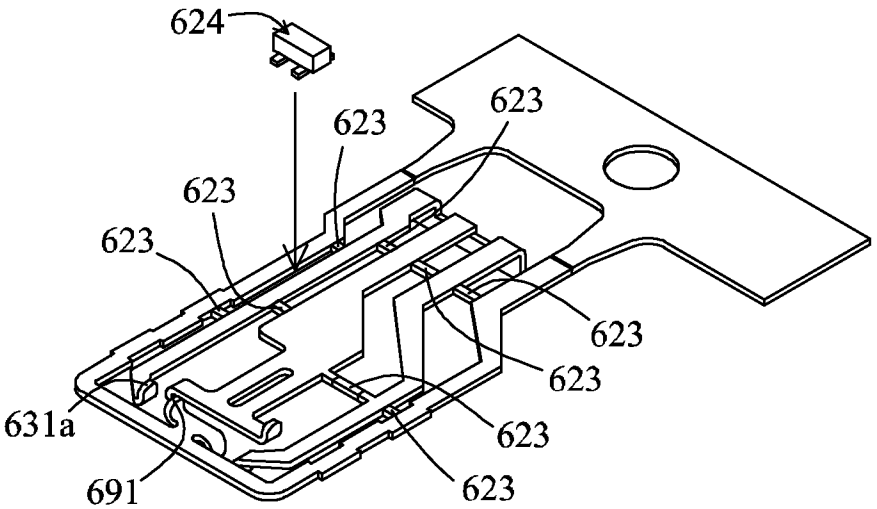
FIG. 43 is a structural pictorial view showing the terminal and the tongue of the bidirectional electrical connector according to the eighth preferred embodiment of the invention.
Figure 42:
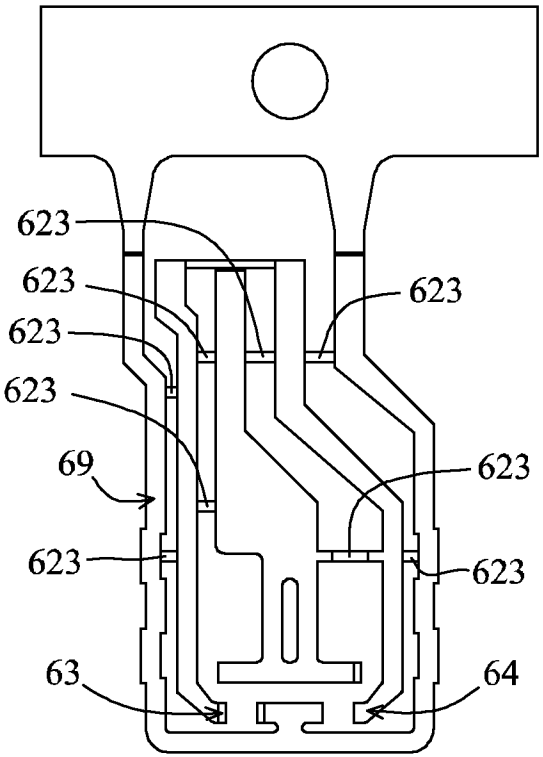
FIG. 42 is a schematic top view showing the contact terminal and the metal tongue of the bidirectional electrical connector according to the eighth preferred embodiment of the invention.
Figure 46:
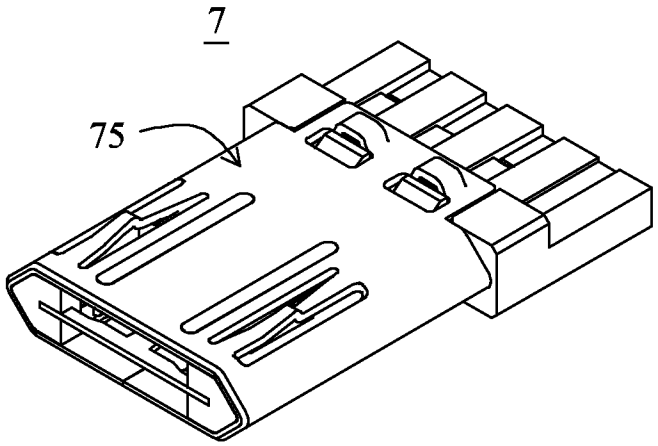
FIGS. 44 to 49 are a structural top view, a structural front view, a structural pictorial side view, a structural side view, a structural partial decomposed view and a structural partial decomposed pictorial schematic side view showing the bidirectional electrical connector according to the ninth preferred embodiment of the invention.
Figure 47:
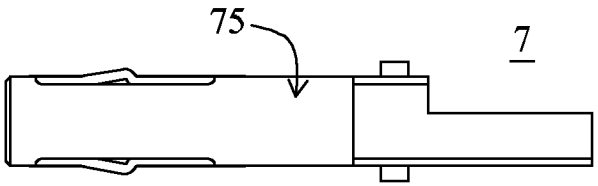
Figure 44:
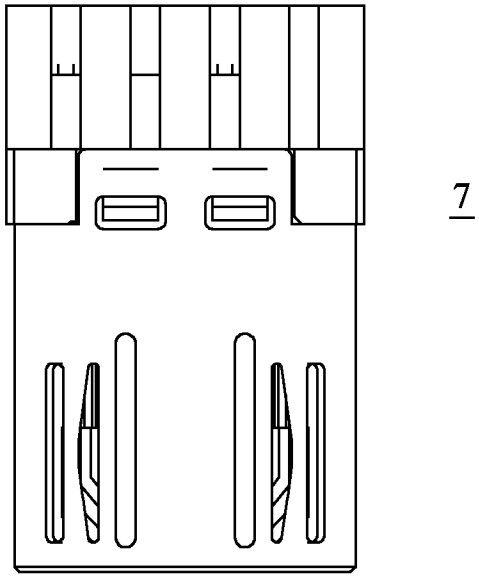
Figure 45:
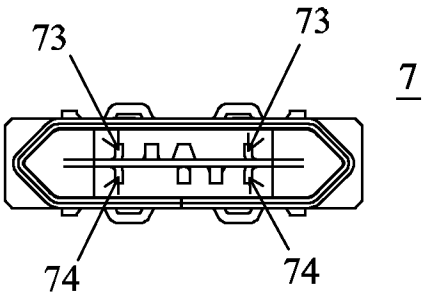
Figure 49:
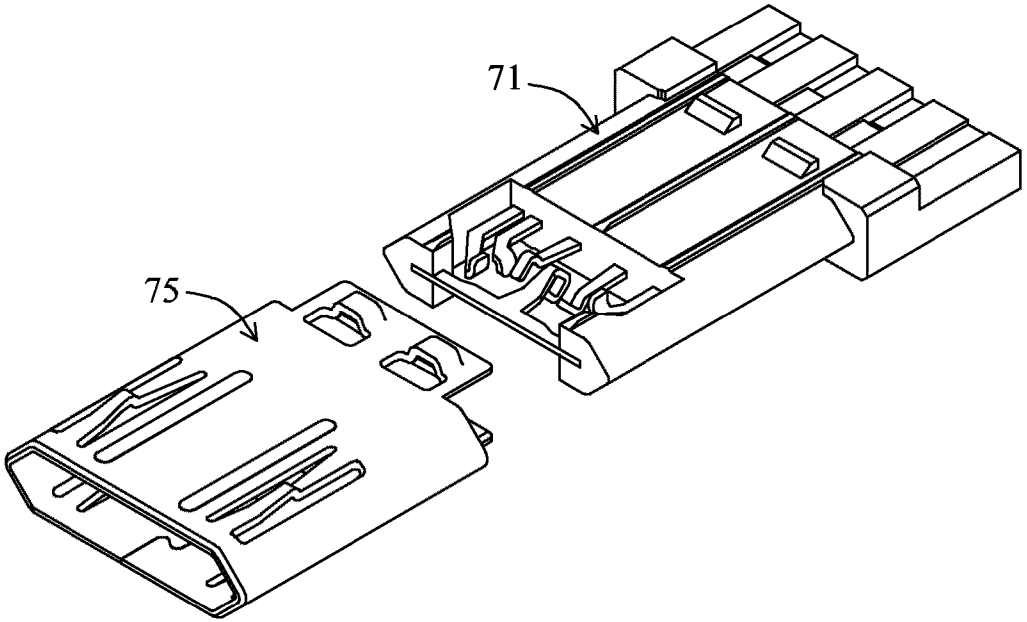
Figure 48:
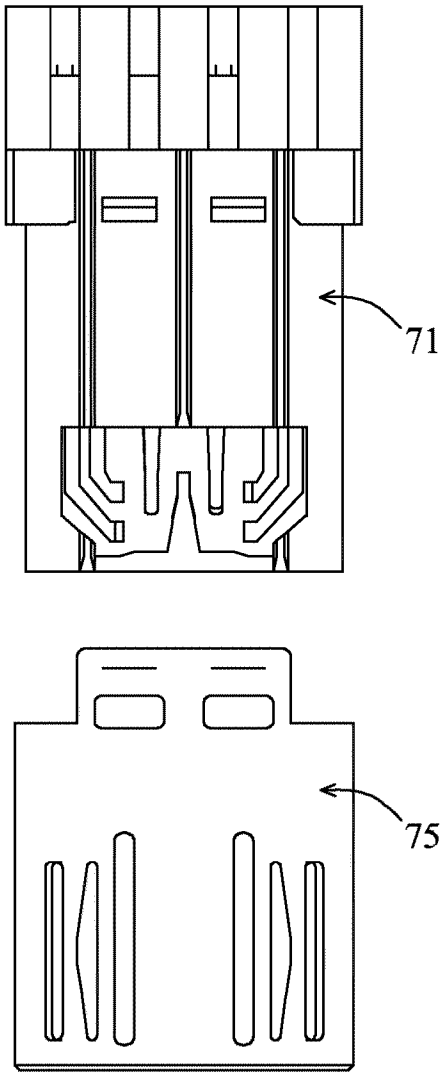
Figure 51:
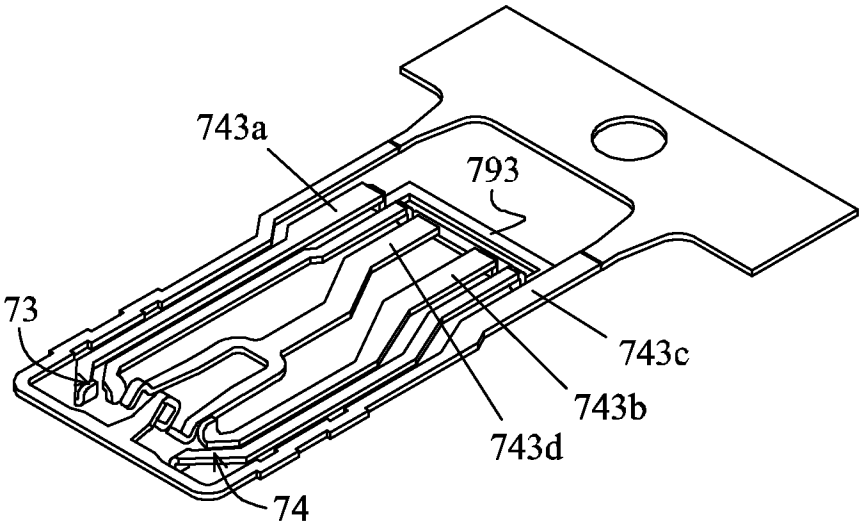
FIG. 51 is a pictorially schematic side view showing the contact interface and the metal tongue of the bidirectional electrical connector according to the ninth preferred embodiment of the invention.
Figure 50:
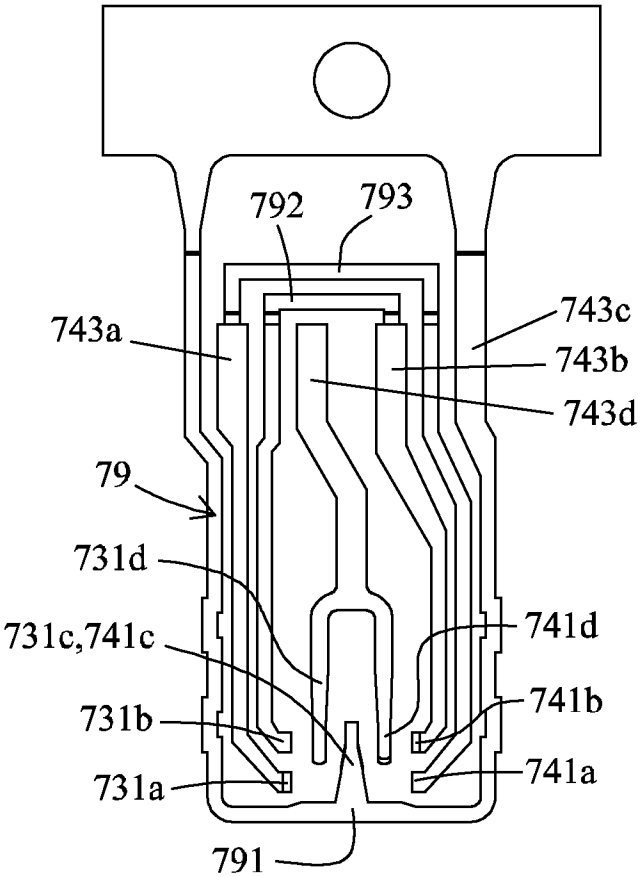
FIG. 50 is a schematic top view showing the contact interface and the metal tongue of the bidirectional electrical connector according to the ninth preferred embodiment of the invention.
Figure 52:
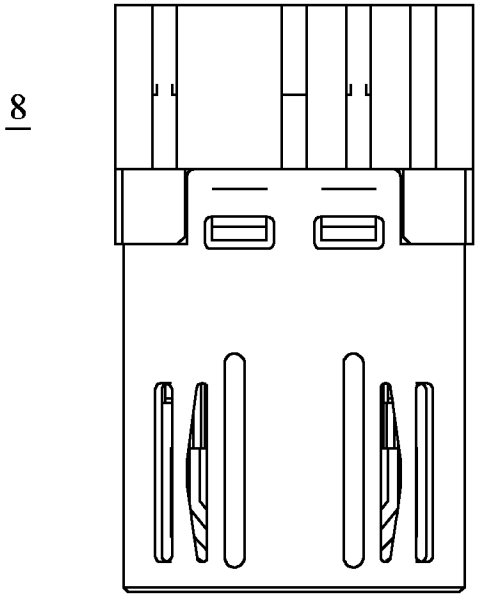
FIGS. 52 to 57 are a structural schematic top view, a structural front view, structural pictorial side view, a structure schematic side view, a structural partial decomposed schematic top view and a structural partial decomposed pictorial schematic side view showing the bidirectional electrical connector according to the tenth preferred embodiment of the invention.
Figure 54:
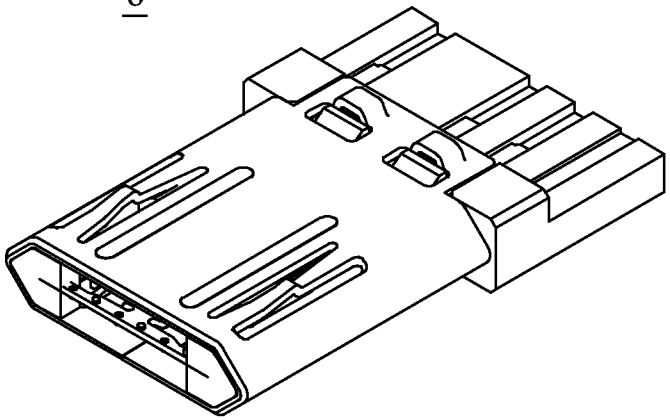
Figure 53:
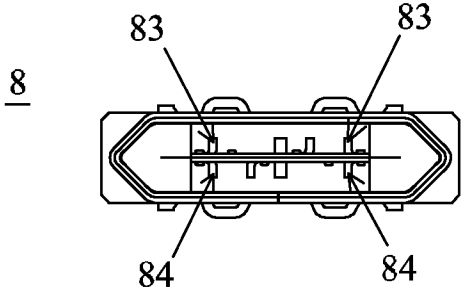
Figure 55:
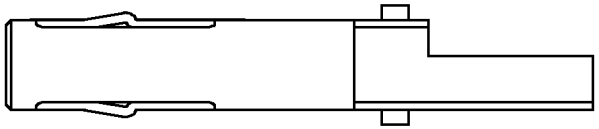
Figure 57:
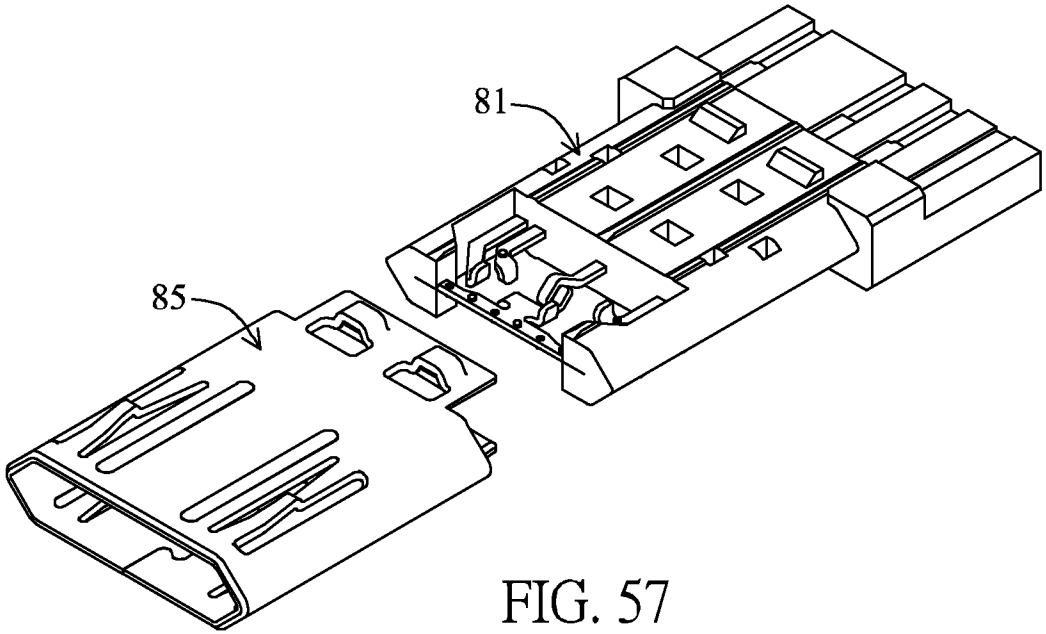
Figure 56:
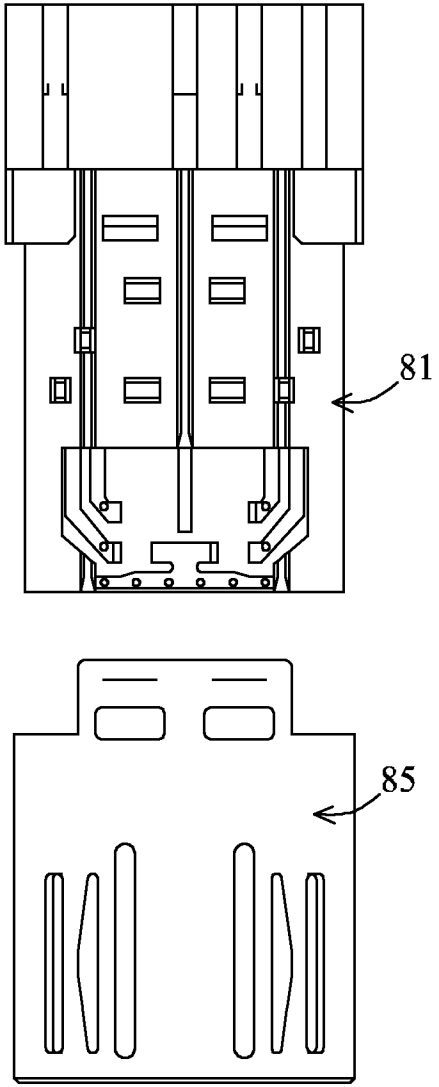
Figure 59:
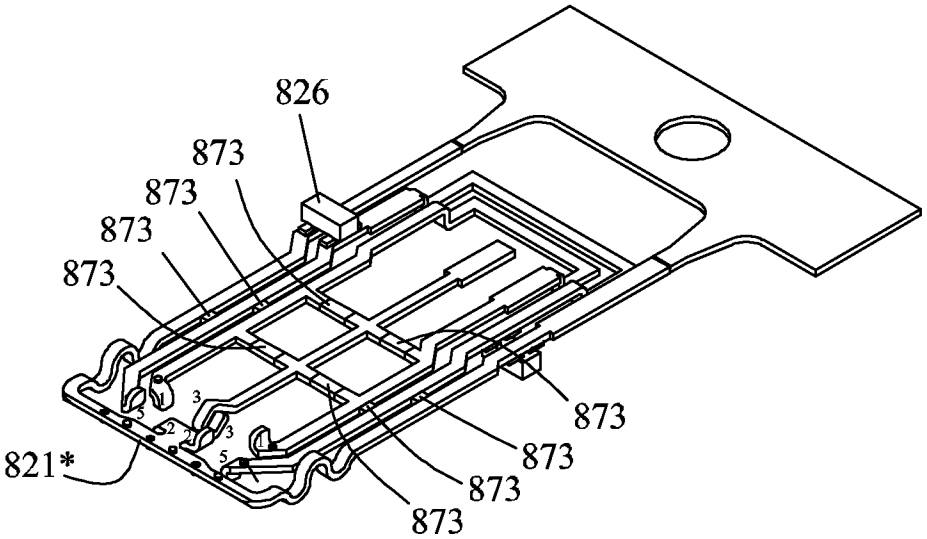
FIG. 59 is a pictorially schematic side view showing the contact interface and the metal tongue of the bidirectional electrical connector according to the ninth preferred embodiment of the invention in different applications.
Figure 58:
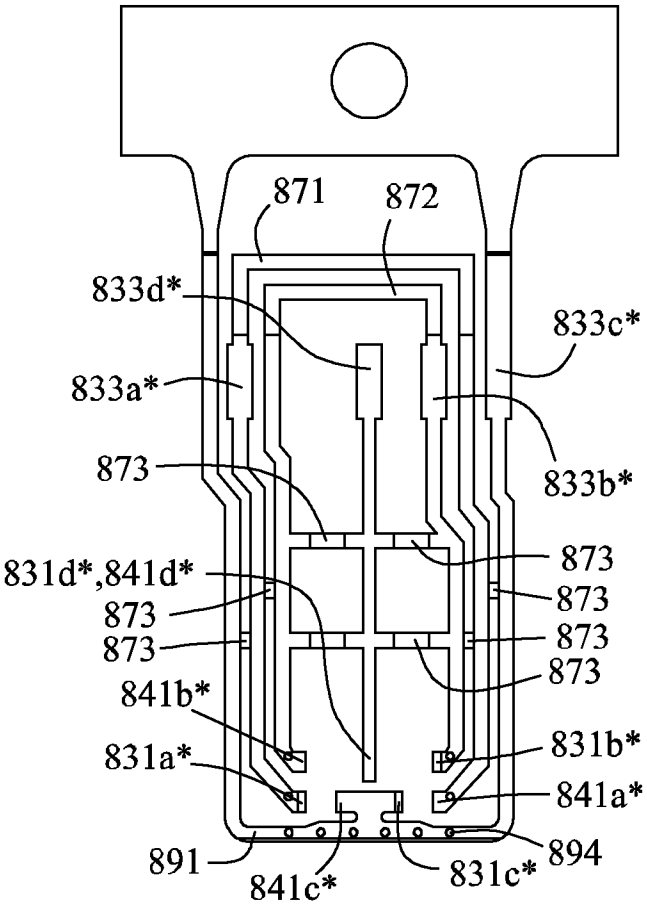
FIG. 58 is a schematic top view showing the contact interface and the metal tongue of the bidirectional electrical connector according to the tenth preferred embodiment of the invention.

Referring to FIGS. 18 and 19, any upper contact terminal 23 and any lower contact terminal 24 of the third embodiment may respectively rest against the top and bottom sides of the middle section partition plate 221, so the middle section partition plate 221 forms the middle section support to the middle section of the contact terminal, a gap 2241 is provided between the front bevel 2312 of the contact and the corresponding limit slot 224 without contacting. In addition, a metal reinforcement plate 226 may further be disposed in the front end of the tongue 22 to increase the structural strength of the tongue 22. FIG. 20 shows another configuration aspect of the contact terminal of the third embodiment. Referring to FIGS. 18 and 20, the front bevel 2312 of the upper contact terminal 23 rests against the bottom portion 2242 of the limit slot 224 of the tongue 22, and the elastically movable gap 2214 is formed between the middle section of the elastically movable extension of the upper contact terminal 23 and the middle section partition plate 221 of the tongue 22. The elastically movable gap 2214 can increase the inclusion absorbing the height error size of the elastically movable contact, and ensure the stable function of the conducting contact. Similarly, the lower contact terminal 24 also has the same property, and detailed descriptions thereof will be omitted. According to the descriptions mentioned hereinabove, the bidirectional electrical connector of the third embodiment may be applied to the Micro USB plug, which is the floating insulation tongue structure and the insulation seat embedded molded at a time, wherein the front bevel guide of the contact of the upper and lower rows of contacts rests against the bottom portion of the limit slot of the tongue, and the connection point of the contact higher than a highest surface of the limit slot based on the bottom surface thereof.

Referring to FIGS. 21 to 28, the bidirectional electrical connector 4 of the sixth embodiment is a MICRO USB 2.0 plug, which includes a housing 45, an insulation seat 41, a tongue 42, an upper contact interface 43 and a lower contact interface 44. The housing 45 surrounds the tongue 42 and is formed with a connection slot on the top and bottom sides of the tongue 42. In this embodiment, the upper contact interface 43 and the lower contact interface 44 may be upper and lower and front and rear contact interfaces, at least one contact interface of the upper contact interface 43 and the lower contact interface 44 may be respectively arranged in parallel and linked, and may be integrally embedded or assembled with other structures in a deployed and non-overlapped manner after one metal plate is punched and cut. In the sixth embodiment, the upper contact interface 43 and the lower contact interface 44 are left-right arranged and linked in parallel, and the rear ends thereof are common linked by a metal material bridge 426. However, the upper and lower contact interfaces of the invention manufactured from one metal plate may also be front-rear arranged and linked in parallel, or even include the configurations of the left-right and front-rear arranged and linked in parallel. Second, the upper contact interface 43 and the lower contact interface 44 may include two grounding contacts, one side of any grounding contact has a detection contact, wherein the detection contact and the grounding contact form an integral structure. Taking the upward contacting contact 431*a* and the downward contacting contact 441*a* as examples of the grounding contacts, one side of any of both of them has a detection contact 491*a*, and the detection contact 491*a* and the contact 431*a* or contact 441*a* are an integral structure. The detection contact 491*a* backwardly forms one-upper and one-lower contact structures from the integral structure to the front middle section of a transversal extension 492. Thus, the aspect of the detection contact of the sixth embodiment is different from that of the first embodiment. Also, the upper contact interface 43 and the lower contact interface 44 of the sixth embodiment only include the ground and power terminals, wherein the ground and power terminals include two grounding contacts and two power contacts. The upper and lower power contacts integrally extend frontwards from the bottom portion of the connection slot and are disposed in back of the grounding contacts 431*a* and 441*a*. Each of the grounding and power contacts is provided with at least one pin so that at least two bonding pads are obtained. So, the bidirectional electrical connector 4 of the sixth embodiment may be the chargeable structure having the short-circuit detection structure function.

Referring further to FIGS. 21 to 28, the tongue 42 is a fixed metal tongue, and the left and right two sides thereof have limit projections 422, wherein the limit projection 422 and the insulation plate body 423 of the rear end are embedded molded at a time. The metal member (may correspond to the transversal extension 492) of the tongue 42 and the upper contact interface 43 and the lower contact interface 44 pertain to the same metal plate. Thus, upon design, one of the sides of the metal interfaces, which are left-right arranged and linked in parallel or front-rear arranged and linked in parallel, may be additionally provided with a metal member, wherein the upper and lower contact interfaces and the metal member may be deployed without overlapping after one metal plate is punched and cut, and the upper and lower contact interfaces and the metal member are provided with the embedded insulation plate body. Second, the tongue 42 has the H-shaped structure, wherein the H-shaped tongue structure is a fixed tongue and the partition plate of the middle section of the fixed tongue is the metal tongue constituted by the metal member. The metal tongue has the thickness ranging from 0.10 mm to 0.20 mm.

Referring further to FIGS. 21 to 28, the top and bottom sides of the housing 45 may be symmetrically provided with a resilient snap structure 46. The resilient snap structure 46 has a front bevel guide 461 and a rear snap surface 462. The rear snap surface 462 steeply projects beyond a housing surface of the housing 45 much more than the front bevel guide 461. Upon docking with the complementary electrical connector, the front bevel guide 461 of the resilient snap structure 46 is smooth and facilitates inserting, while the rear snap surface 462 is steep and can increase a pull-out force to ensure the clamping locking function. So, the resilient snap structure 46 is a structure having different front and rear bevels.

Referring to FIGS. 29 to 35, both of the housing 55 and the insulation seat 51 of the bidirectional electrical connector 5 of the seventh embodiment are similar to those of the sixth embodiment, and detailed descriptions thereof will be omitted. The upper contact interface 53 and the lower contact interface 54 of the seventh embodiment are left-right arranged and linked in parallel, and are linked with the metal tongue 52 and the detection terminal 59 in parallel on one metal plate, which is punched and cut and deployed without overlapping. Second, multiple terminal material bridges 523 linked together are provided between the upper contact interface 53, the lower contact interface 54 and the detection terminal 59. Taking the upward contacting contact 531*a* as an example, two sides of the corresponding extension thereof respectively have terminal material bridges 523, wherein the terminal material bridge 523 of one side is linked to the detection terminal 59, the terminal material bridge 523 of the other side is linked to the common extension of the downward contacting contact 541*b* and the upward contacting contact 531*b*. Similarly, the downward contacting contact 541*a* also has the same property, so the detection terminal and the ground and power terminals form the integral structure through the terminal material bridge, which is not cut off. Also, the contacts 531*a*, 531*b*, 541*a* and 541*b* has a cascaded structure 524, which may be a common pin, and the detection terminal 59 backwardly extends two pins linked to the metal material bridge 526 from the outer inverse-U shape. Furthermore, the transversal extension of the detection terminal 59 extending frontwards to the location in front of the contact 531*a* and the contact 541*a* may function as the metal tongue 52, and upper and lower two detection contacts are formed inwardly. The grounding contacts 531*a* and 541*a* are respectively two grounding contacts extending frontwards from the bottom portion of the connection slot to the front end on the inner side of the two sides of the outer inverse-U shape, and are cascaded by the cascaded structure 524 on the rear end of the base portion of the insulation seat 51. The upper and lower power contacts 531*b* and 541*b* integrally extend frontwards from the bottom portion of the connection slot and is disposed in back of the grounding contacts 531*a* and 541*a*. Each of the grounding contact, the power contact and the detection contact is provided with at least one pin, and there are at least three bonding pads to form a chargeable structure having an open type detection structure function.

Referring to FIGS. 36 to 43, the housing 65 of the bidirectional electrical connector 6 of the eighth embodiment is similar to the sixth embodiment, and detailed descriptions thereof will be omitted. Second, one portion of the insulation seat 61 of the bidirectional electrical connector 6 constitutes the limit projection 622 of the left and right two sides of the metal tongue 62. The thickness of the limit projection 622 of this embodiment is smaller than that of the sixth embodiment. That is, in the connection slot of the housing 65 surrounding the top and bottom sides of the metal tongue 62, limit projection 622 does not rest against the inner sidewall of the housing 65. So, the metal tongue 62 may be moved up and down in the connection slot, and the metal tongue 62 of the eighth embodiment is a floating H-shaped metal tongue.

Referring further to FIGS. 36 to 43, the terminal material bridge 623 between the upper contact interface 63, the lower contact interface 64 and the detection terminal 69 of the eighth embodiment will be cut off after embedding. That is, in there is no terminal material bridge 623 provided on the contact interface formed by one metal sheet of the bidirectional electrical connector 6. Also, a resistor element 624 is disposed on the extensions corresponding to the grounding contact 631*a* and the detection contact 691 in a crossing manner, so that the application of the bidirectional electrical connector of the invention is optimized. Thus, one front contact interface and one rear contact interface of the top and bottom surfaces of the eighth embodiment are the MICRO USB 2.0 plug, and a detection contact 691 is added to one side of the grounding contact 631*a*, wherein the detection contact 691 and the grounding contact 631*a* are a split-type structure. Each of the vertically integral grounding, power and detection contacts is provided with at least one pin and there are at least three bonding pads, and a resistor element 624 is provided between the detection contact 691 and the grounding contact 631*a* to form a chargeable structure having an open type detection structure function.

Referring to FIGS. 43 to 51, the housing 75 and the insulation seat 71 of the bidirectional electrical connector 7 of the ninth embodiment are the same as those of the sixth embodiment, and detailed descriptions thereof will be omitted. Second, one front contact interface and one rear contact interface 73 and contact interface 74 of the top and bottom surfaces of the bidirectional electrical connector 7 are a MICRO USB 2.0 plug, the upper and lower ones of the middle are D+ signal contacts 731*c* and 741*c* integrally disposed on the middle section of the transversal extension 791 of the front end of an outer inverse-U shape, and forwardly extend inwardly and are bent reversely to face each other in a vertical direction and in front of the power contacts 731*b* and 741*b*. The upper and lower grounding contacts 731*a* and 741*a* are disposed on two sides of the connection slot to form an integral structure and disposed in front of the power contacts 731*b* and 741*b*. The upper and lower power contacts 731*b* and 741*b* disposed in back of the grounding contacts 731*a* and 741*a*, and disposed on the inner sides of the two sides of the outer inverse-U shape 79 and integrally connected and extended frontwards from the bottom portion of the connection slot. The upper and lower D− signal contacts 731*d* and 741*d* are integrally disposed on and extend frontwards from the bottom portion of the connection slot, and disposed on sides of the D+ signal contacts 731*c* and 741*c*. Also, the grounding contacts 731*a* and 741*a* are cascaded from the U-shaped link structure 793, and the upper and lower power contacts 731*b* and 741*b* are cascaded from the U-shaped link structure 792. Each of the upper and lower grounding, power, D+ and D− contacts is provided with at least four contacts and at least four bonding pads to form a structure at least having signal and charge functions.

Figure 69:
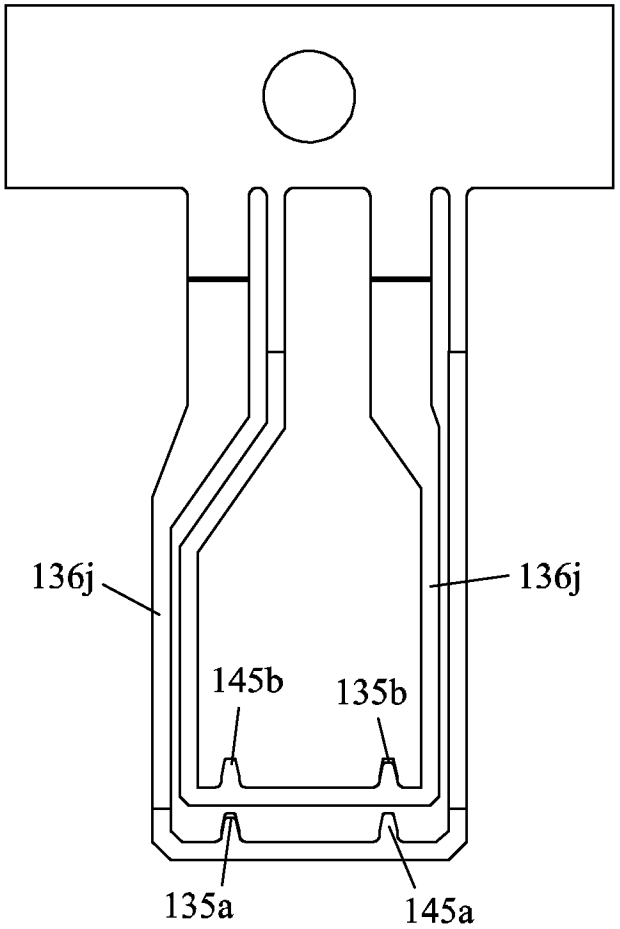
FIGS. 68 and 69 are schematic structure views showing the upper contact terminal and the lower contact terminal of the bidirectional electrical connector according to the twelfth preferred embodiment of the invention at different viewing angles.
Figure 68:
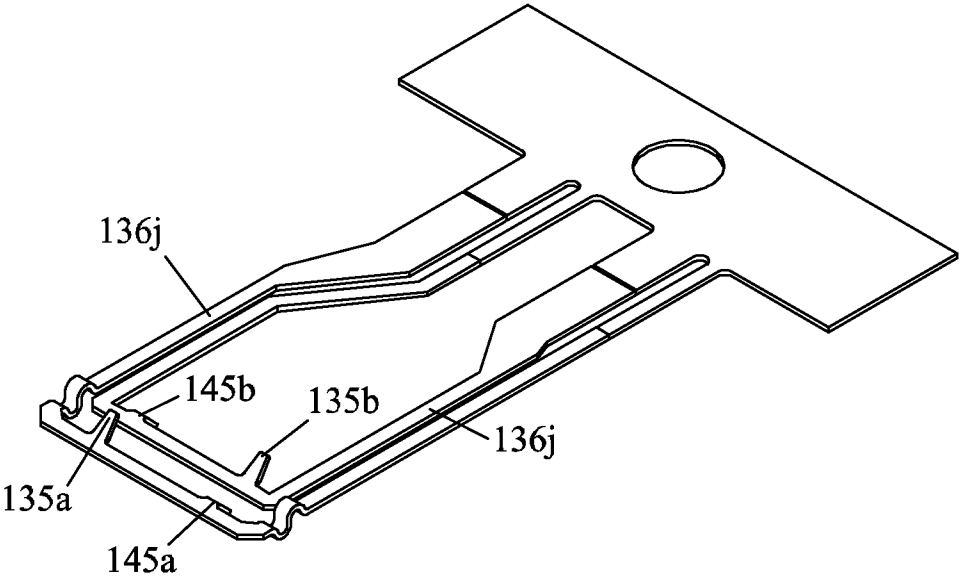
Figure 70:
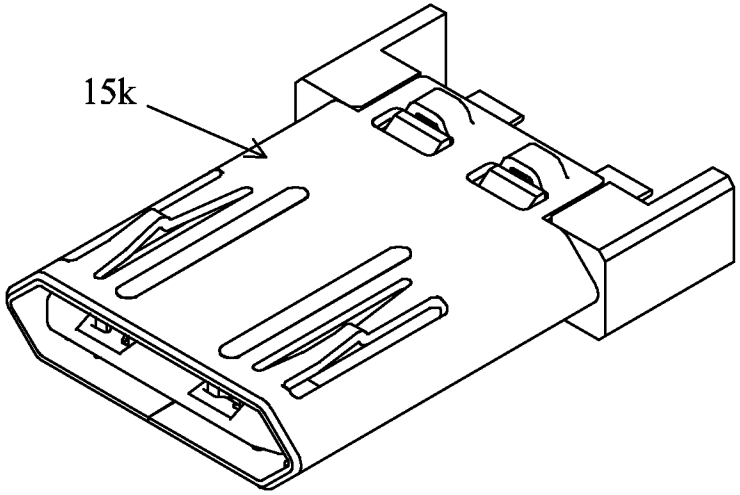
FIGS. 70 to 72 are a structural view, a structural side view and a structural schematic front view showing the bidirectional electrical connector according to the thirteenth preferred embodiment of the invention.
Figure 71:
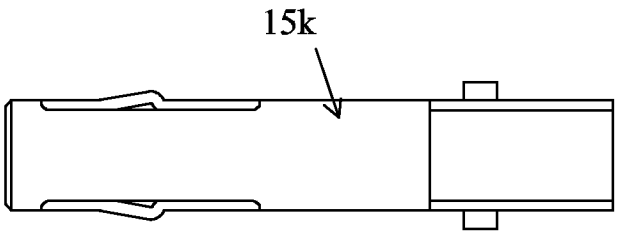
Figure 72:
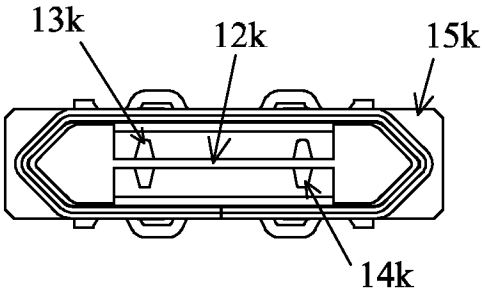
Figure 74:
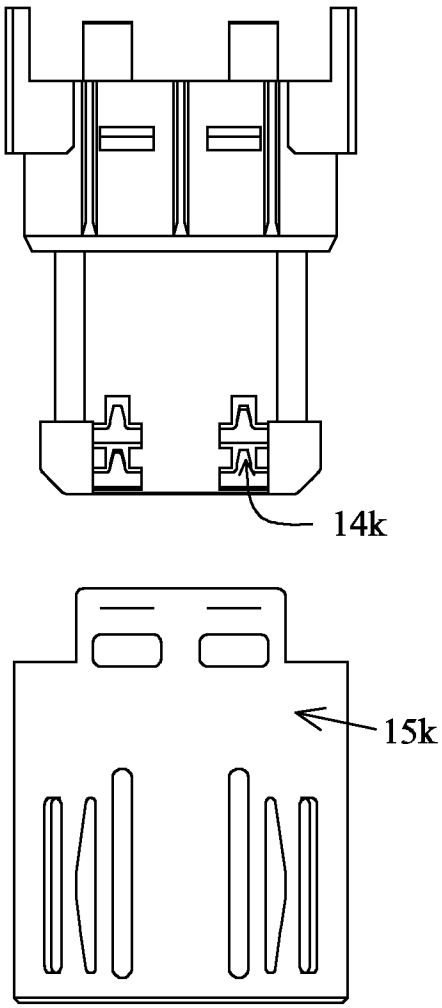
FIGS. 73 and 74 are structural decomposed schematic views showing the bidirectional electrical connector according to the thirteenth preferred embodiment of the invention at different viewing angles.
Figure 73:
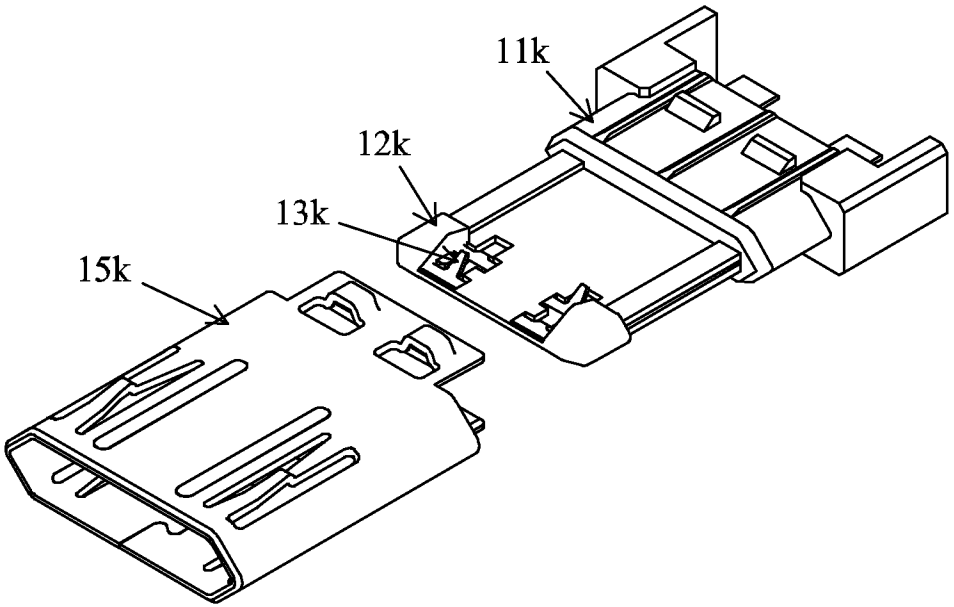
Figure 75:
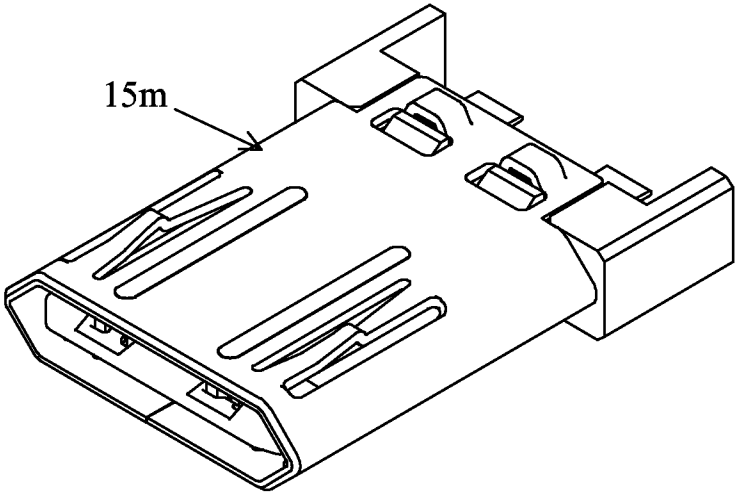
FIGS. 75 to 77 are a structural view, a structural side view and a structural schematic front view showing the bidirectional electrical connector according to the 14th preferred embodiment of the invention.
Figure 76:
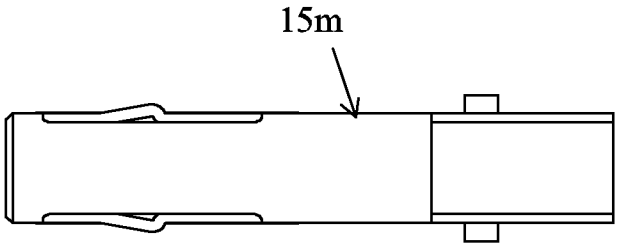
Figure 77:
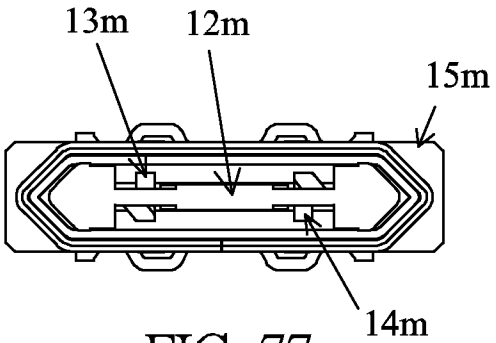
Figure 79:
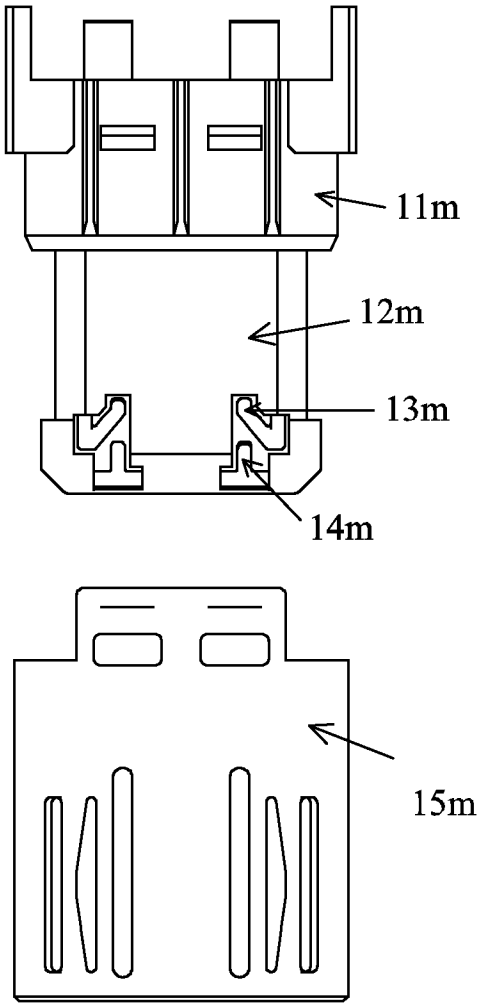
FIGS. 78 and 79 are structural decomposed schematic views showing the bidirectional electrical connector according to the 14th preferred embodiment of the invention at different viewing angles.
Figure 78:
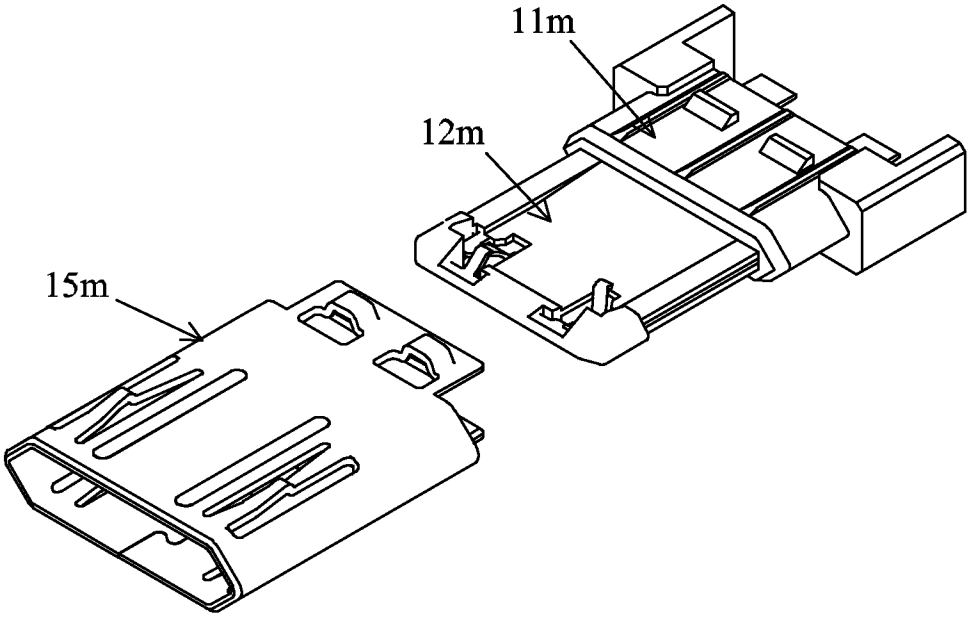
Figure 81:
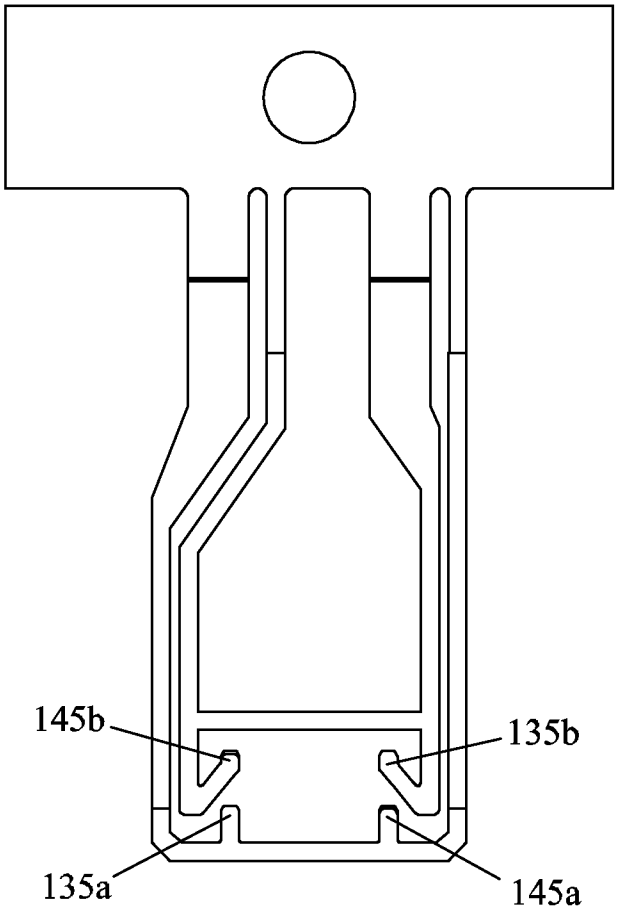
FIGS. 80 and 81 are schematic structure views showing multiple upper contact terminals and multiple lower contact terminals of the bidirectional electrical connector according to the 14th preferred embodiment of the invention at different viewing angles.
Figure 80:
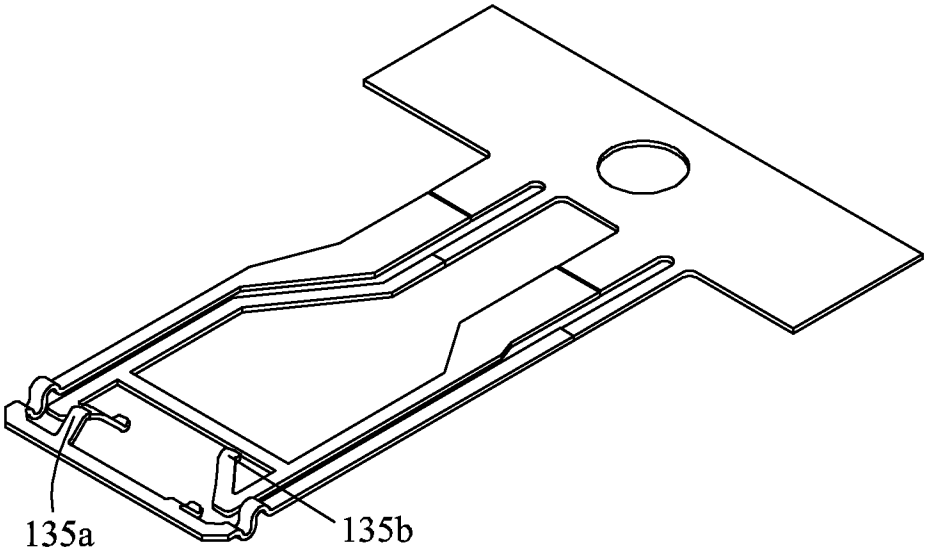
Figure 82:
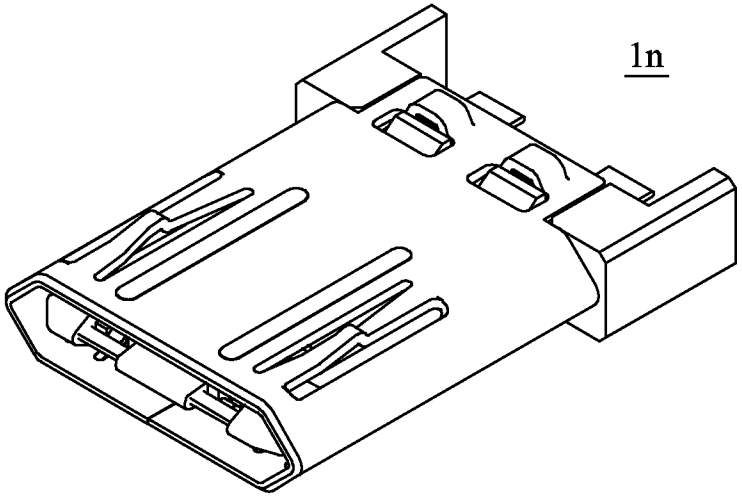
FIGS. 82 to 86 are a structural pictorial side view, a structural side view, a structural front view, a structural pictorial view and a structural decomposed schematic view showing the bidirectional electrical connector according to the 15th preferred embodiment of the invention.
Figure 83:
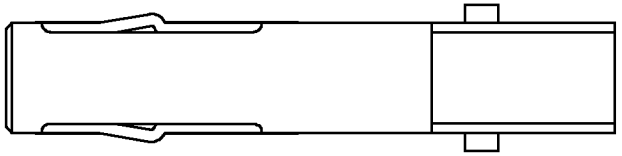
Figure 84:
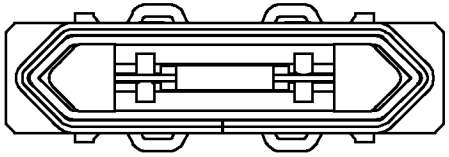
Figure 86:
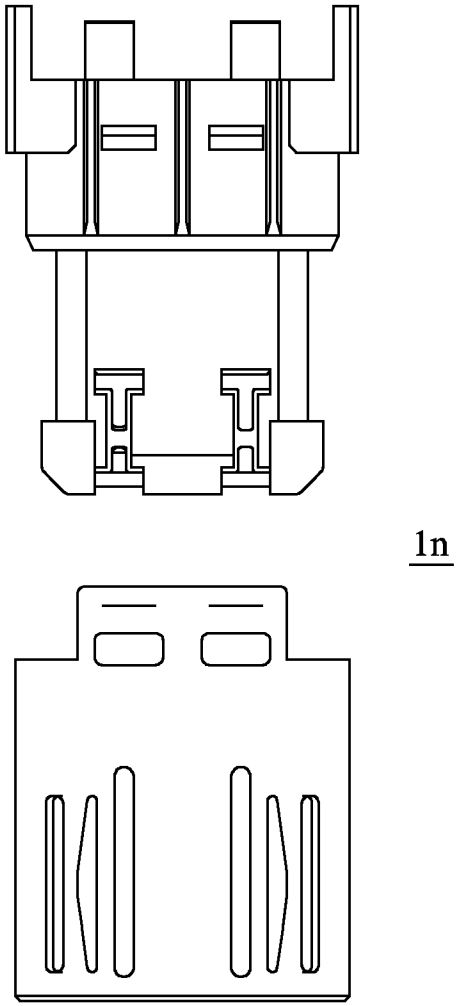
Figure 85:
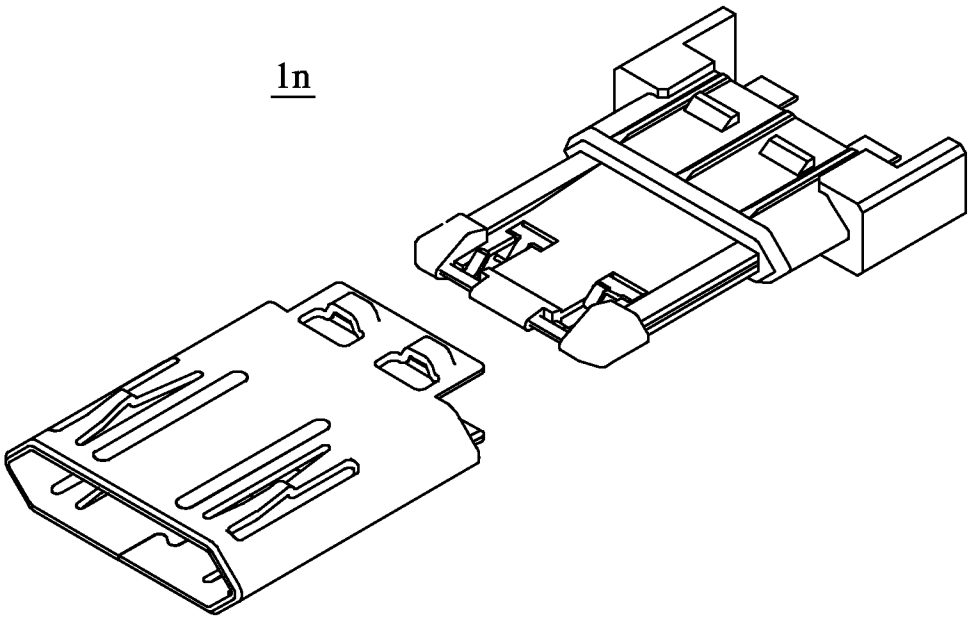
Figure 88:
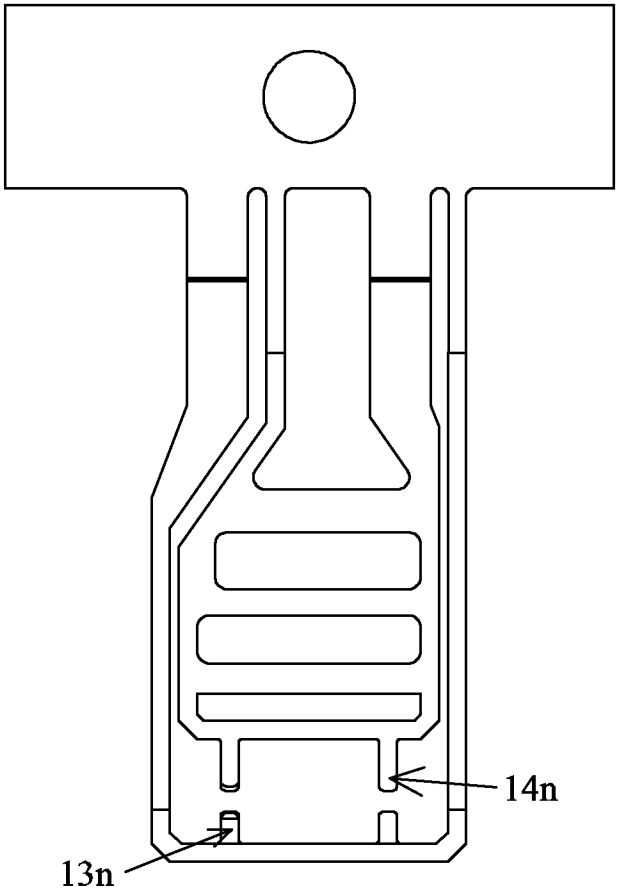
FIGS. 87 and 88 are schematic structure views showing multiple upper contact terminals and multiple lower contact terminals of the bidirectional electrical connector according to the 15th preferred embodiment of the invention at different viewing angles.
Figure 87:
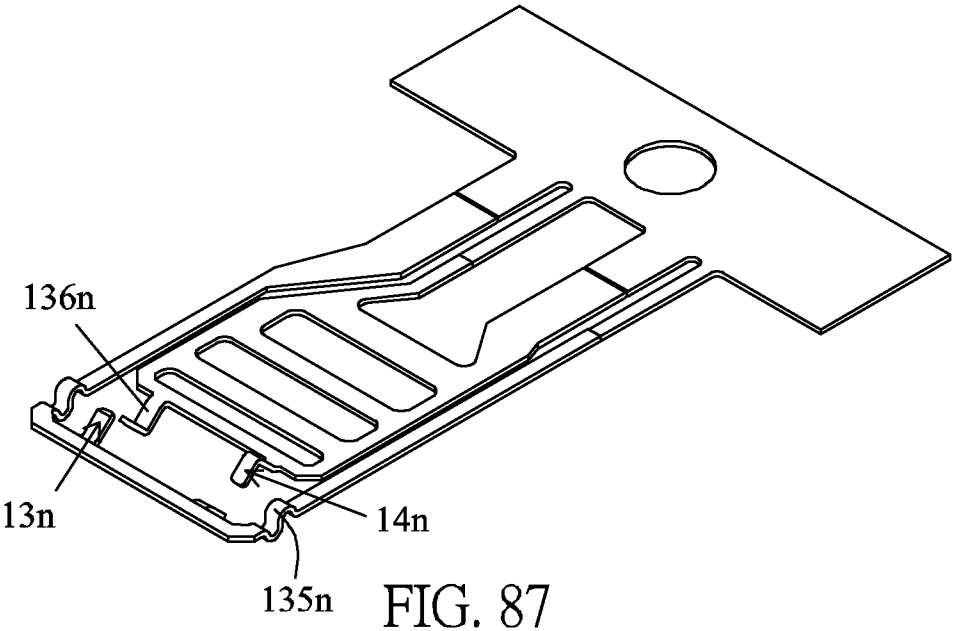
Figure 91:
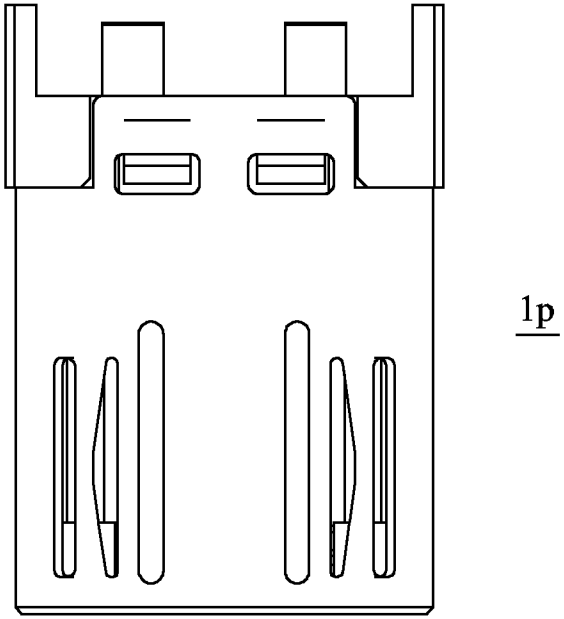
FIGS. 89 to 96 are schematic structure views showing the bidirectional electrical connector according to the 16th preferred embodiment of the invention at different viewing angles.
Figure 92:
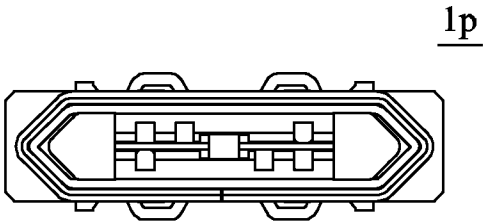
Figure 89:
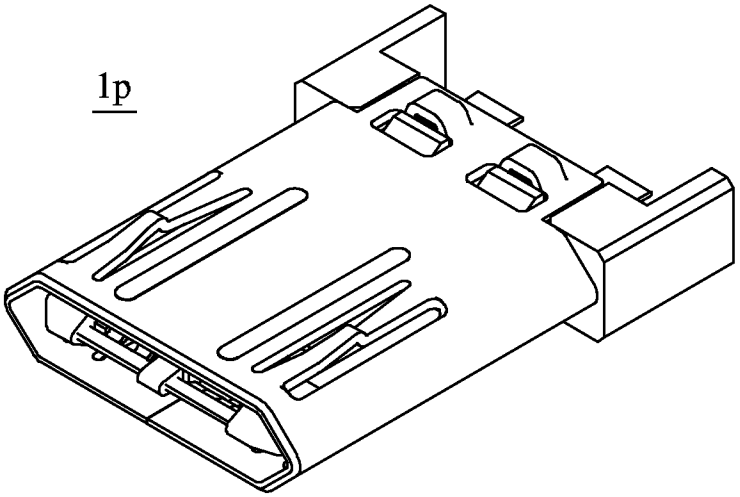
Figure 90:
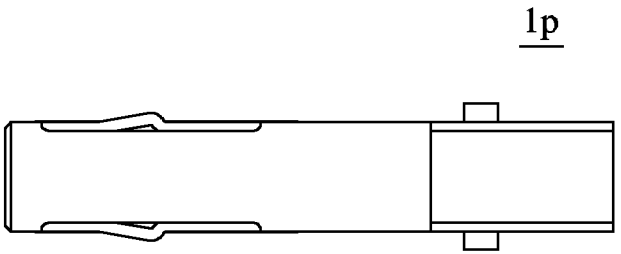
Figure 94:
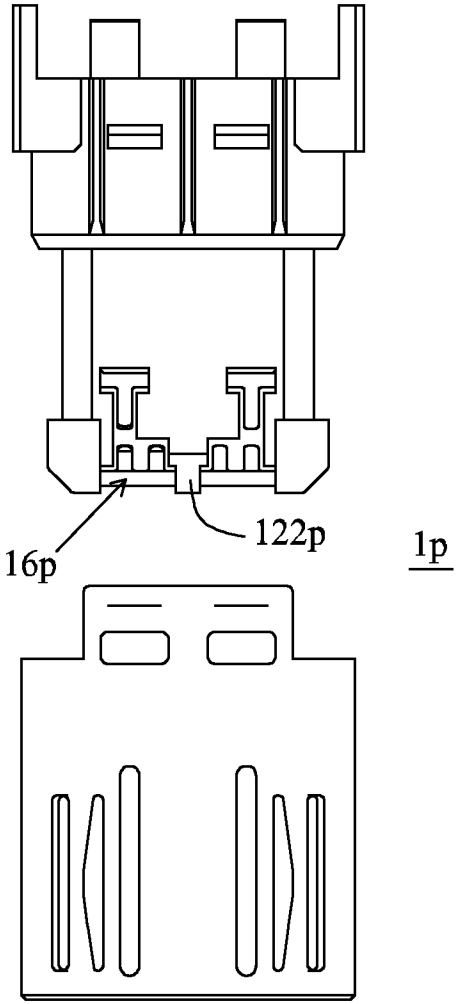
Figure 93:
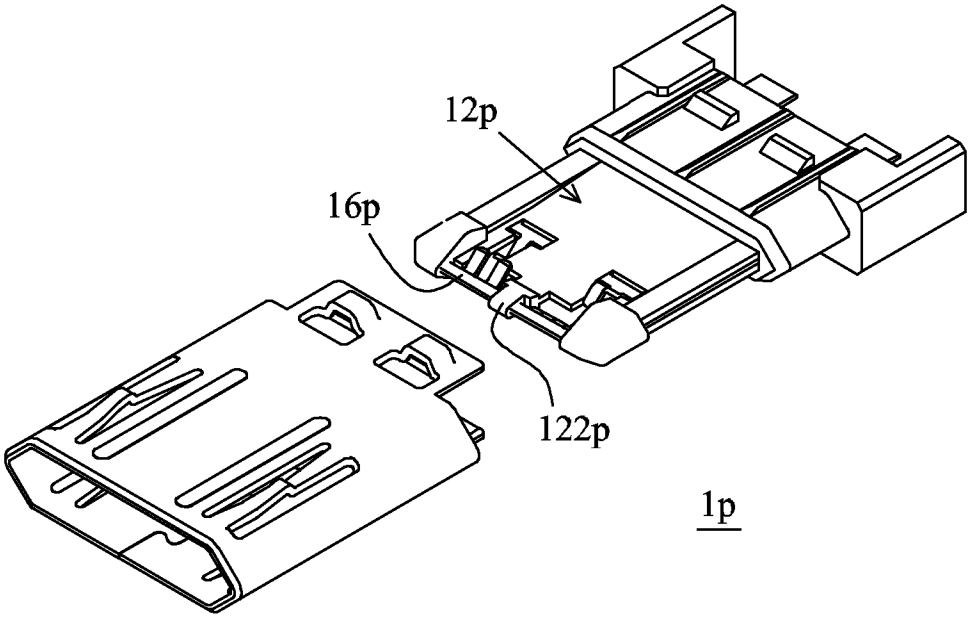
Figure 96:
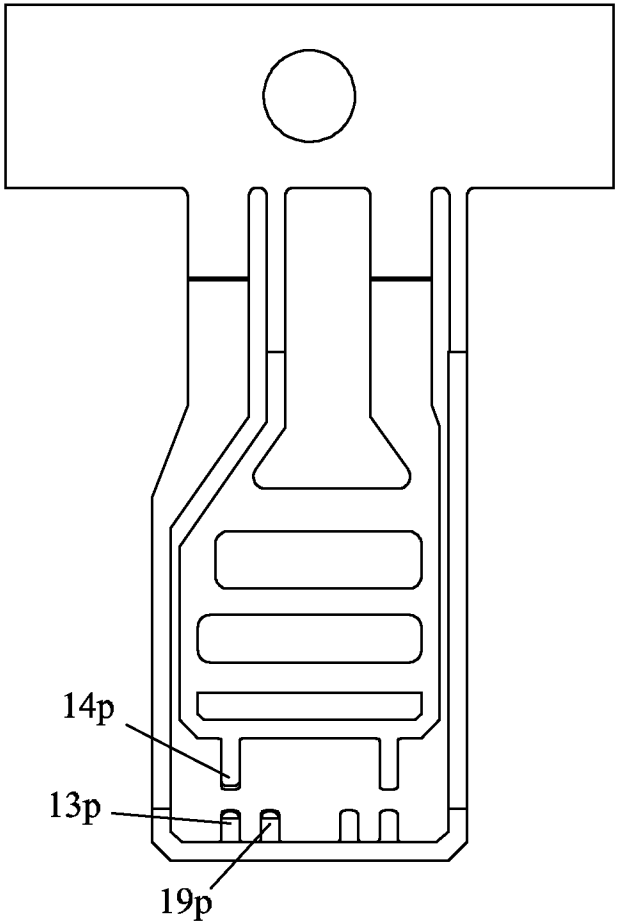
Figure 95:
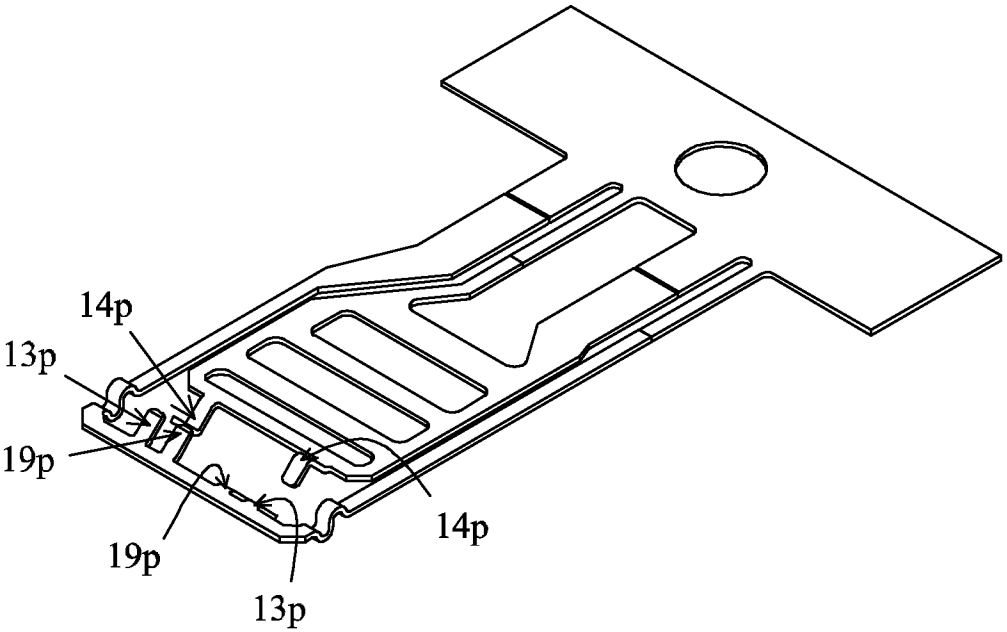
Figure 99:
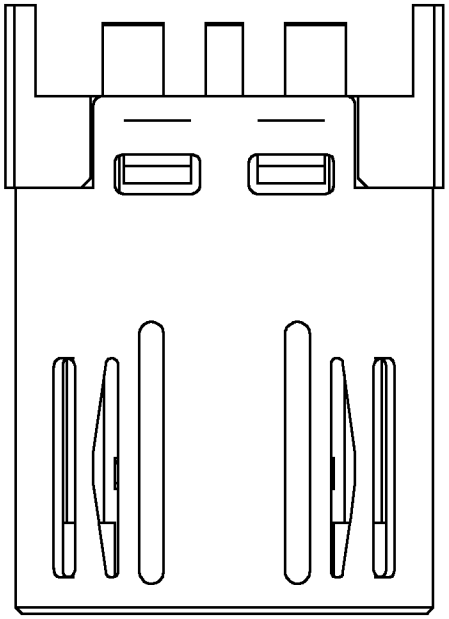
FIGS. 97 to 104 are schematic structure views showing the bidirectional electrical connector according to the 17th preferred embodiment at different viewing angles.
Figure 100:
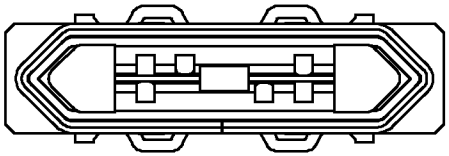
Figure 97:
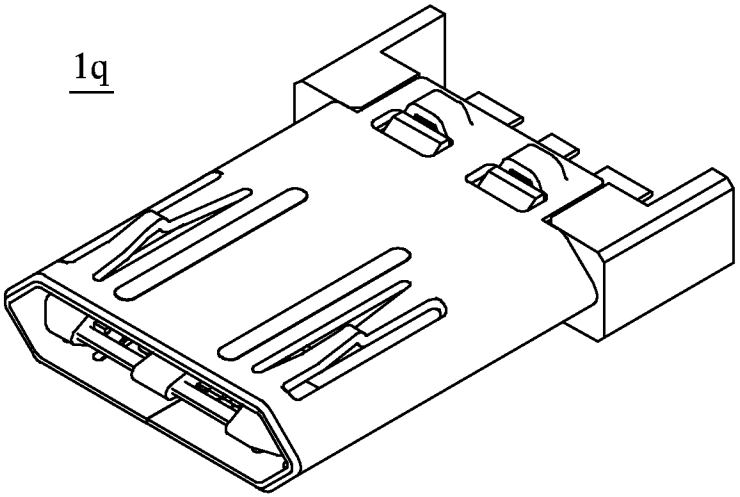
Figure 98:
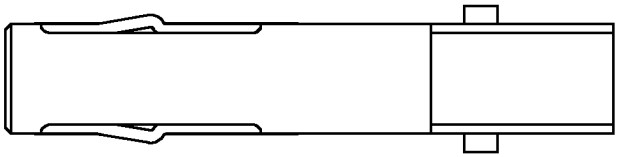
Figure 102:
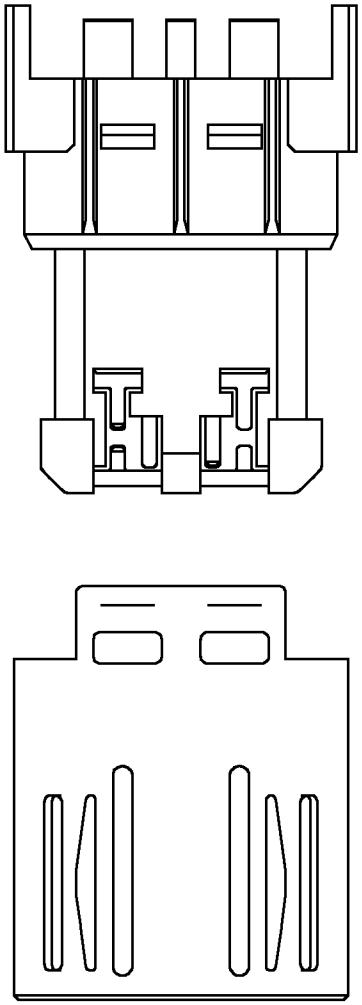
Figure 101:
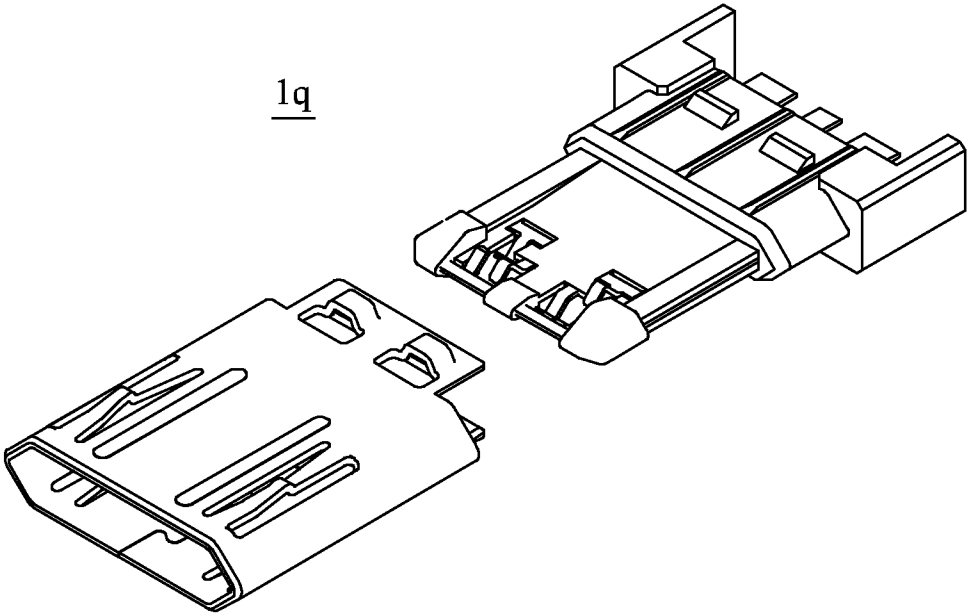
Figure 104:
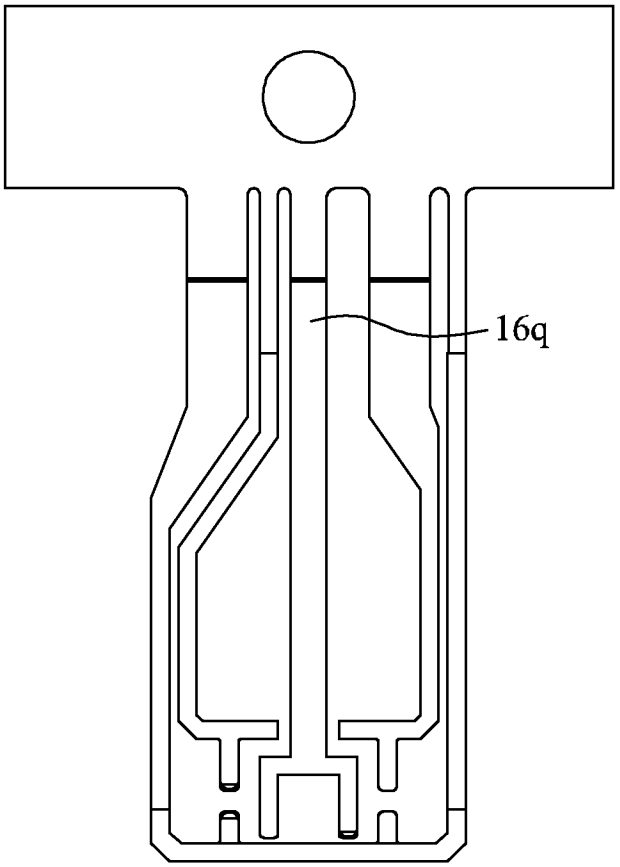
Figure 103:
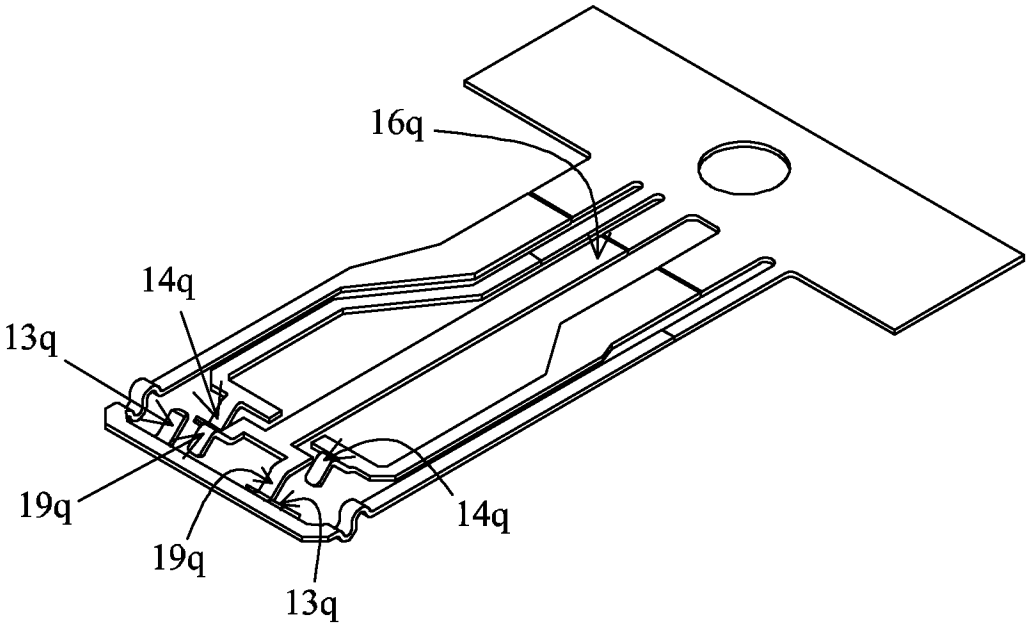

Referring to FIGS. 52 to 58, the housing 85 and the insulation seat 81 of the bidirectional electrical connector 8 of the tenth embodiment are the same as those of the sixth embodiment, and detailed descriptions thereof will be omitted. Second, one front contact interface and one rear contact interfaces 83 and 84 of top and bottom surfaces of the bidirectional electrical connector 8 are the MICRO USB 2.0 plug, the upper and lower ones of the middle are D+ signal contacts 831*c* and 841*c* integrally disposed on the middle section of the transversal extension 891 of the front end of the outer inverse-U shape, and forwardly extend inwardly and are bent reversely up and down, are aligned with the locations in front of the power contacts 831*b* and 841*b*, and are provided with at least one pin. Also, an anti-short-circuit bump 894 may be provided on the transversal extension 891. The upper and lower grounding contacts 831*a* and 841*a* are disposed on two sides of the connection slot to form an integral large U-shaped structure 871, are disposed in front of the power contacts 831*b* and 841*b*, and are provided with at least one pin. The upper and lower power contacts 831*b* and 841*b* disposed in back of the grounding contacts 831*a* and 841*a*, are disposed on the inner sides of the two sides of the outer inverse-U shape and extends frontward from the bottom portion of the connection slot being the integral middle U-shaped link 872, and are provided with at least one pin. The upper and lower D− signal contacts 831*d* and 841*d* are an integral small U-shape, disposed frontwards from the bottom portion of the connection slot, disposed on one side of the D+ signal contact and provided with at least one pin, and have terminal material bridges 873 linked together. Each of the upper and lower grounding, power, D+ and D− contacts is provided with at least four contacts and at least four bonding pads 833*a*, 833*b*, 833*c* and 833*d* to form a structure at least having signal and charge functions. FIG. 69 shows another implementation of the contact. A resistor element 826 is disposed on the extensions corresponding to the grounding contact and the detection contact. That is, the signal contact of the tenth embodiment function as the detection contact. In addition, the chamfers 821 are disposed on top and bottom sides of the transversal extension, to facilitate the docking.

Figure 61:
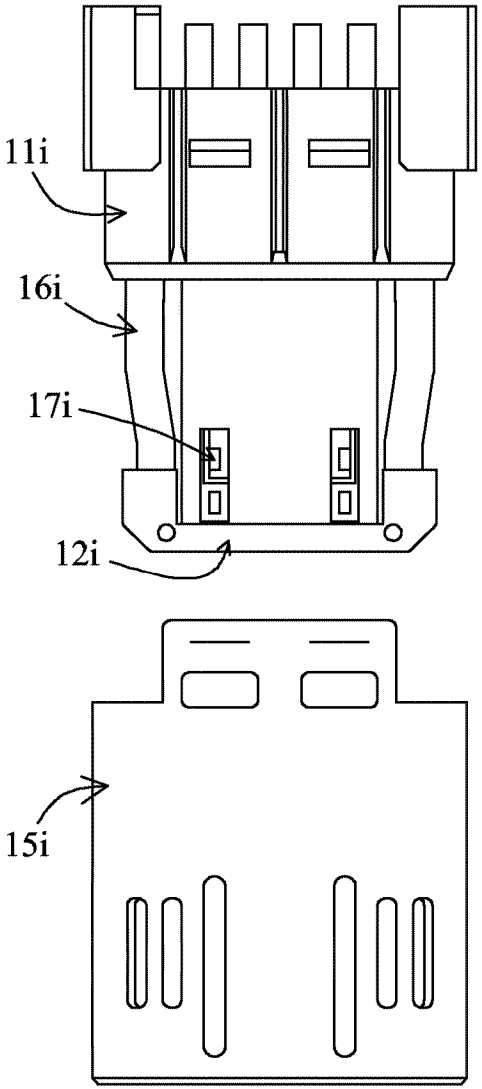
FIGS. 60 and 61 are a decomposed pictorial side view and a top view showing the bidirectional electrical connector according to the eleventh embodiment of the invention.
Figure 60:
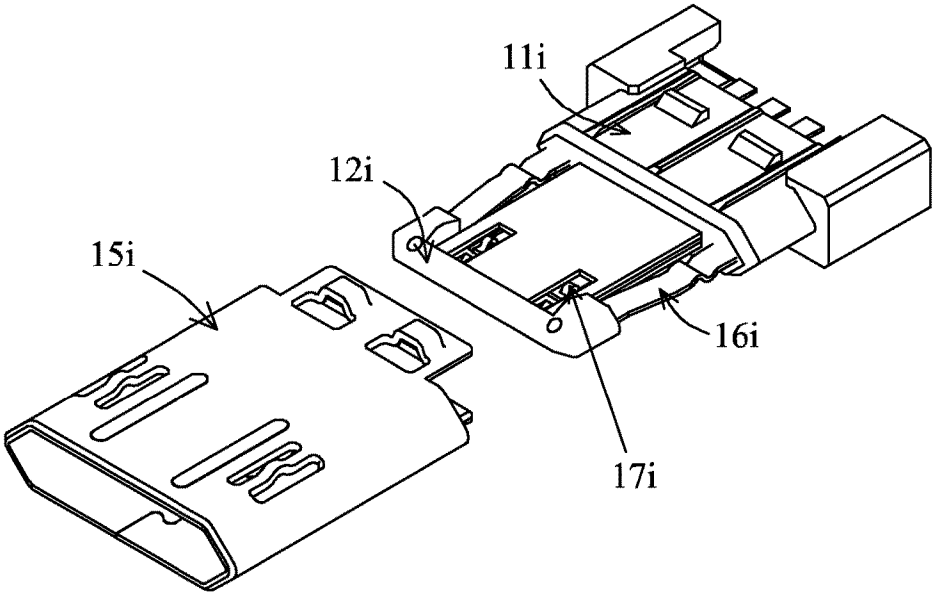
Figure 64:
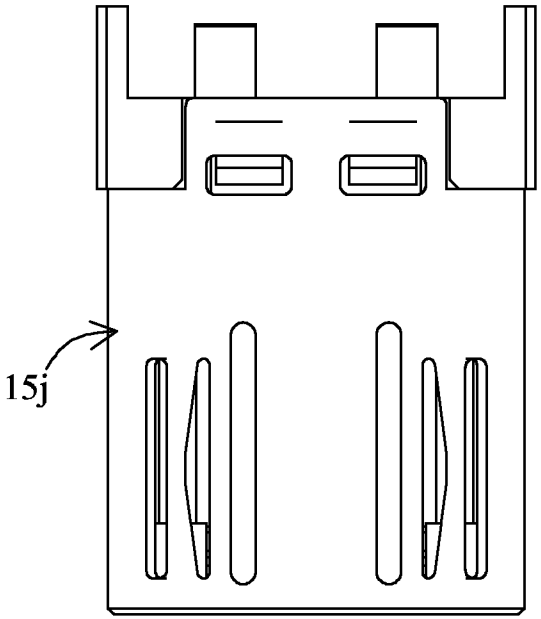
FIGS. 62 to 65 are a structural view, a structural side view, a structural top view and a structural schematic front view showing the bidirectional electrical connector according to the twelfth preferred embodiment of the invention.
Figure 65:
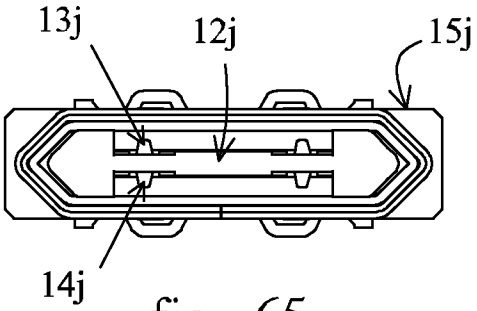
Figure 62:
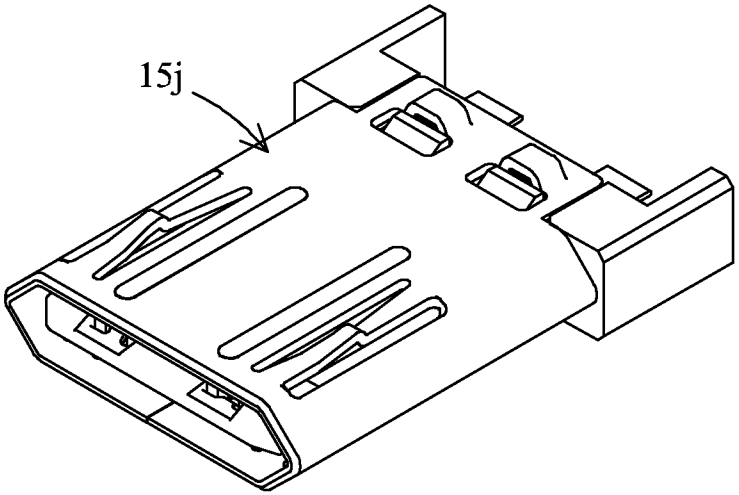
Figure 63:
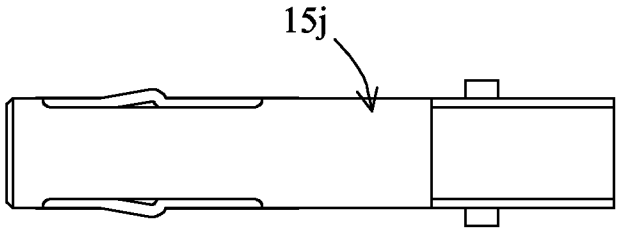
Figure 67:
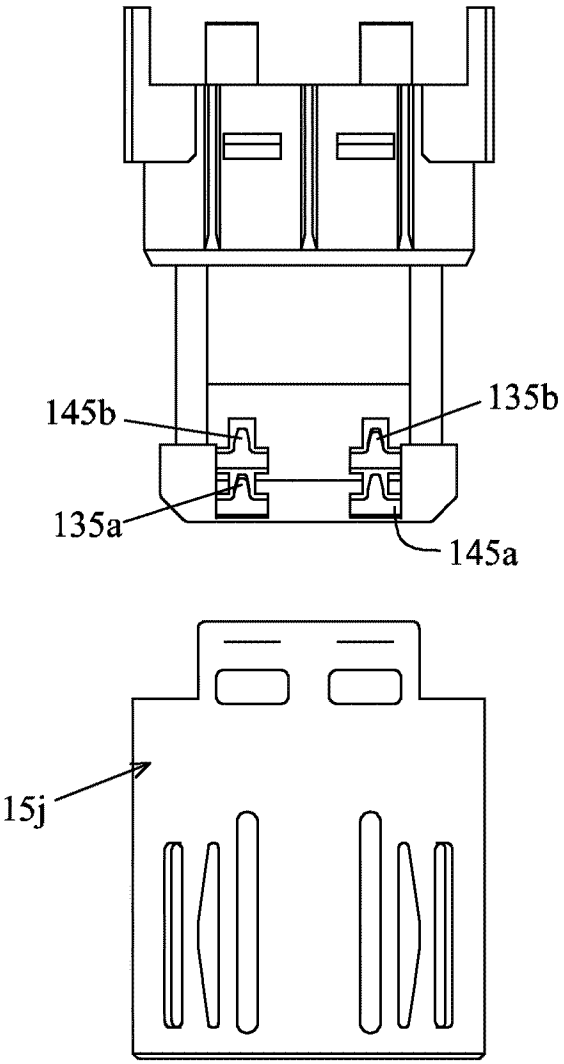
FIGS. 66 and 67 are structural decomposed schematic views showing the bidirectional electrical connector according to the twelfth preferred embodiment of the invention at different viewing angles.
Figure 66:
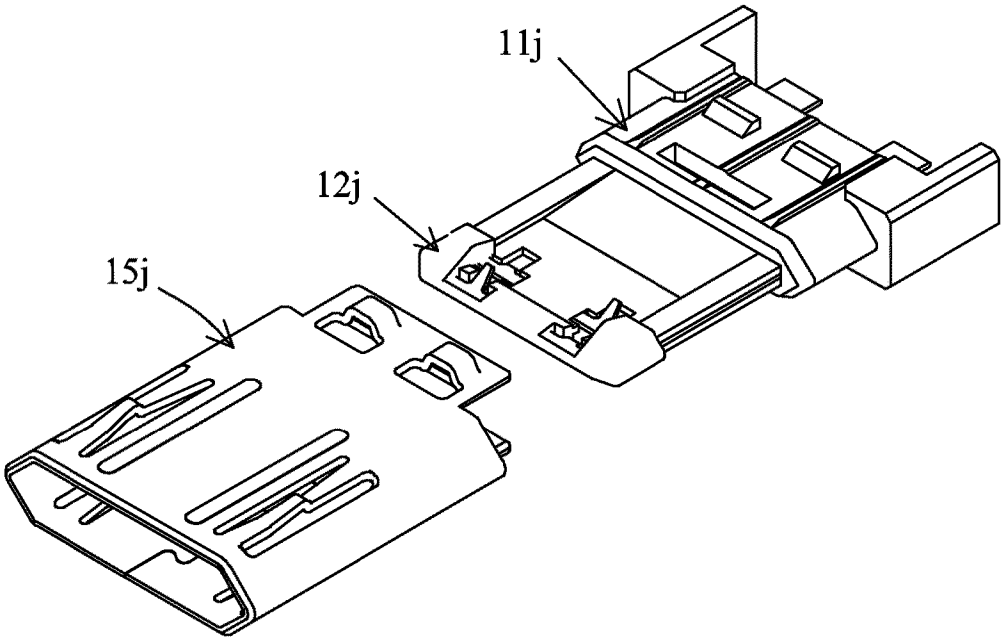

FIGS. 60 and 61 area decomposed pictorial side view and atop view showing the bidirectional electrical connector according to the eleventh embodiment of the invention. The bidirectional electrical connector is an electrical plug with a MICRO USB transmission interface, and includes a tongue 12*i*, an insulation seat 11*i*, a connection plate body 16*i*, multiple upper and lower contact terminals and a housing 15*i*. The upper and lower two rows of contact terminals are made of the same one metal plate, and only one embedding and injection molding process is needed to form the upper and lower two rows of contact terminals fixed to the insulation seat 11*i*. The insulation seat 11*i* and the tongue 12*i* are formed by one plastic injection molding process in an exemplified but non-restrictive example. In another preferred embodiment, the insulation seat 11*i* and the tongue 12*i* are formed by way of assembling. The upper contact terminal and the lower contact terminal may only has the charge function, so the upper and lower two rows of contact terminals only have the contact terminal with the power function and the grounding function. The tongue 12*i* is H-shaped and is connected to the insulation seat 11*i* through the connection plate body 16*i*, and the connection plate body 16*i* has two elastic sheets exposed to the outside. In response to the structure of the elastic sheet, the tongue 12*i* may be floating relatively to the insulation seat 11*i*, and this is an H-shaped floating insulation tongue. Two elastic sheets are respectively located on the outer sides of the multiple upper contact terminals and the multiple lower contact terminals. In addition, the frame of the connection plate body 16*i*, which is not exposed to the outside, is located inside the tongue 12*i* to strengthen the structure of the tongue 12*i*. That is, it has the structure reinforcing function. The invention may further adopt the following preferred aspect, in which the elastic sheet of the connection plate body 16*i* has the semicircular protrusion or S-shaped elastically movable structure for increasing the resilience, wherein the elastically movable structure thereof has the effect of increasing the elastic force thereof, and may also adjust the front-rear position of the connection plate body 16*i* in response to the requirement, so that the tongue 12*i* may be located at the appropriate position. The upper contact terminal, the lower contact terminal and the connection plate body 16*i* are integrally formed together. The tongue 12*i* and the insulation seat 11*i* are integrally formed together, and the upper and lower contact terminals only have the upper contact 17*i* and the lower contact exposed outside the tongue 12*i*.

Referring to FIGS. 62 to 69, the bidirectional electrical connector of the twelfth embodiment includes a tongue 12*j*, an insulation seat 11*j*, multiple upper and lower contact terminals 13*j* and 14*j* and an outer housing 15*j*. The multiple upper contact terminals 13*j* and the multiple lower contact terminals 14*j* are integrally formed together. It is to be explained that the bidirectional electrical connector of the twelfth embodiment is not provided with the connection plate body. That is, the elastic sheet needs not to be provided. Second, the upper and lower two rows of contact terminals 13*j* and 14*j* only have the power function and the grounding function, and the contact terminals are respectively inverse-U shaped cascaded structures. the contacts of the contact terminals 13*j* and 14*j* having the power function and the grounding function respectively extend in opposite directions, and the contacts 135*a* and 145*a* having the grounding function is located in front of the contacts 135*b* and 145*b* having the power function. Specifically speaking, the upper contact 135*a* of the upper contact terminal 13*j* having the grounding function is located in front of the upper contact 135*b* having the power function, and both of them are respectively disposed at diagonal corners of the front end of the tongue 12*j*. In addition, the inverse-U shaped two sides of the contact terminals are elastically movable extensions 136*j*.

Referring to FIGS. 70 to 74, the bidirectional electrical connector of the thirteenth embodiment includes a tongue 12*k*, an insulation seat Ilk, multiple upper and lower contact terminals 13*k* and 14*k* and an outer housing 15*k*, wherein the multiple upper contact terminals 13*k* and the multiple lower contact terminals 14*k* are integrally formed together. In the thirteenth embodiment, the docking limit portion of the tongue 12*k* has the larger thickness, and can contact the outer housing 15*k*. That is, the tongue 12*k* is a fixed and non-floating structure.

Referring to FIGS. 75 to 81, the bidirectional electrical connector of the 14th embodiment includes a tongue 12*m*, an insulation seat 11*m*, multiple upper and lower contact terminals 13*m* and 14*m* and an outer housing 15*m*, wherein the multiple upper contact terminals 13*m* and the multiple lower contact terminals 14*m* are integrally formed together, and the contact terminals has the power and grounding functions. The contact terminals 135*a* and 145*a* having the grounding function are inverse-U shaped cascaded structures, and the contact terminals 135*b* and 145*b* having the power function are the similar H-shaped cascaded structures, wherein the front end of the contact terminal having the power function has the forwardly elastically movable structure.

Referring to FIGS. 82 to 88, the bidirectional electrical connector 1*n* of the 15th embodiment is the electrical plug of the MICRO USB transmission interface, wherein the front end of the longer contact terminal 13*n* is provided with the bent back forward structure 135*n*, and the front end of the shorter contact terminal 14*n* is provided with reverse structure 136*n* in an opposite direction.

Referring to FIGS. 89 to 96, the bidirectional electrical connector 1*p* of the 16th embodiment is the electrical plug of the MICRO USB transmission interface. In the structure of the bidirectional electrical connector 1*p*, the tongue 12*p* includes an insulation plate body 122*p* covers the metal plate body 16*p* from the rear end to the front, and the upper and lower integral two contacts 19*p* are added to the upper and lower contact terminals 13*p* of the one row of upper and lower contact terminals having the grounding function, and the added two contacts 19*p* has the detection function, so that one row of upper and lower contact terminals 3*p* and two contacts 14*p* having the power function totally include 6 contacts (the upper row of 3 contacts, the lower row of 3 contacts), wherein the two contacts 19*p* having the detection function do not have pins.

Referring to FIGS. 97 to 104, the bidirectional electrical connector 1*q* of the 17th preferred embodiment is the electrical plug of the MICRO USB transmission interface, wherein the two contacts having the detection function has pins 16*q*, the upper and lower contact terminals 19*q* having the detection function are integral, the upper and lower contact terminals 13*q* having the grounding function are also integral, and the upper and lower contact terminals 14*q* having the power function are not integral, and is a split-type structure.

Figure 105:
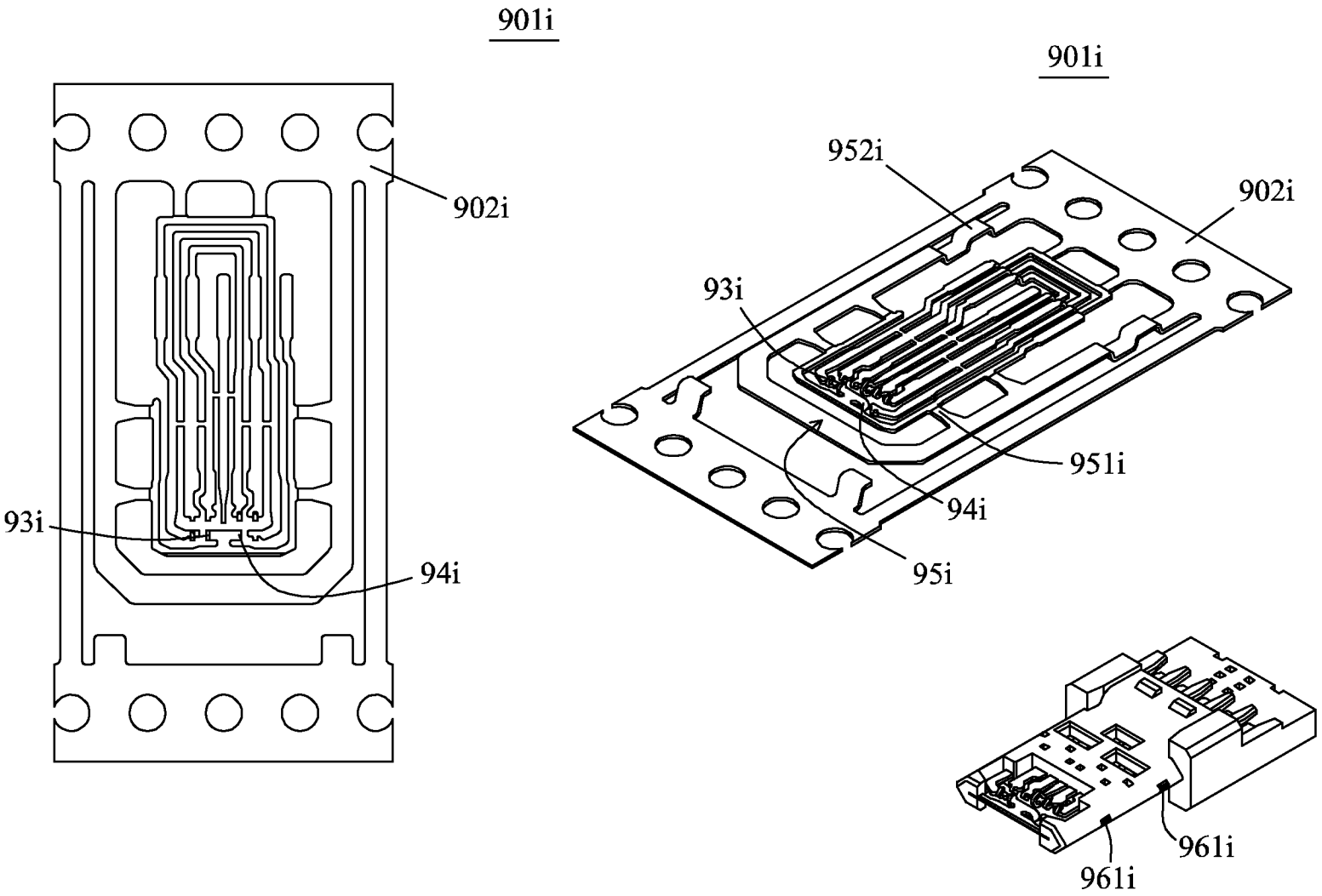
FIG. 105 is a schematic top view showing metal structures of one row of duplex contact terminals of the bidirectional electrical connector of the invention.
Figure 108:
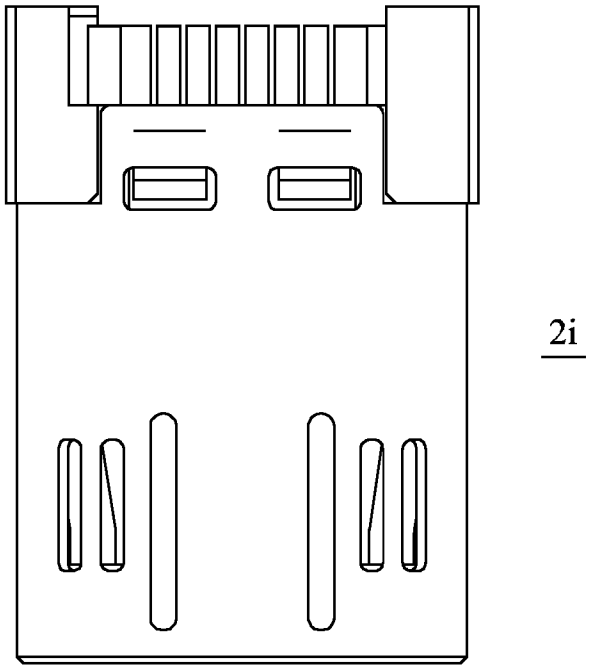
FIGS. 106 to 112 are a structural view, a structural side view, a structural top view, a structural front view, a separated structural view, a structure decomposed view and a structural cross-sectional schematic side view showing the bidirectional electrical connector according to the 19th preferred embodiment of the invention.
Figure 109:
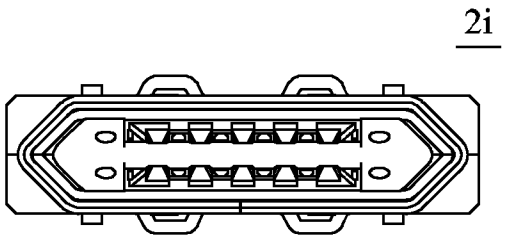
Figure 106:
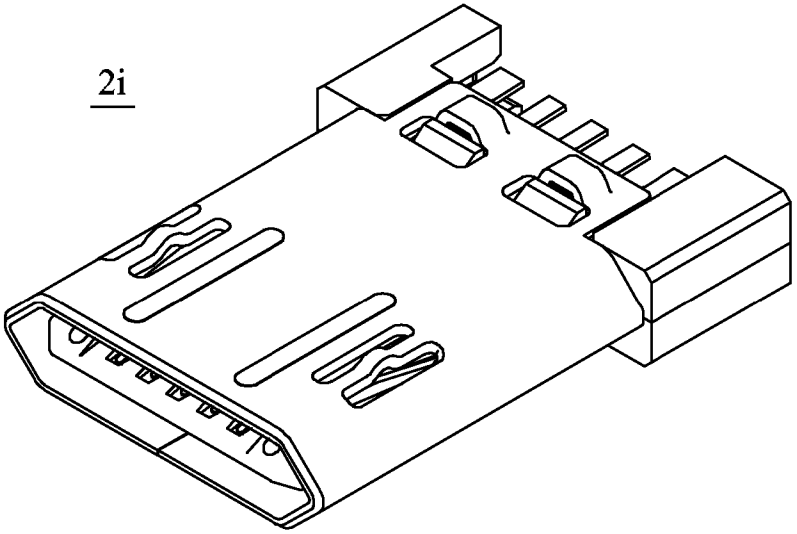
Figure 107:
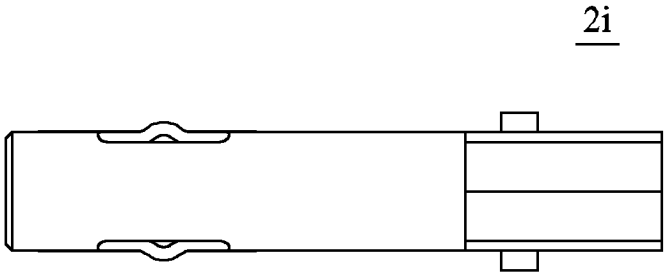
Figure 110:
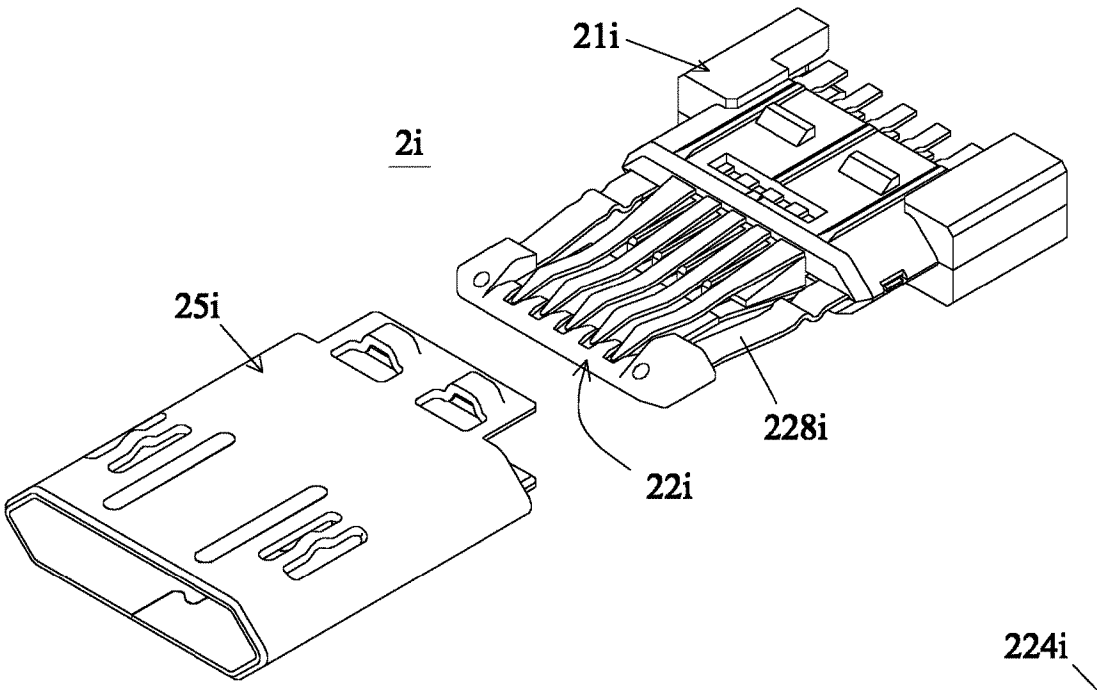
Figure 111:
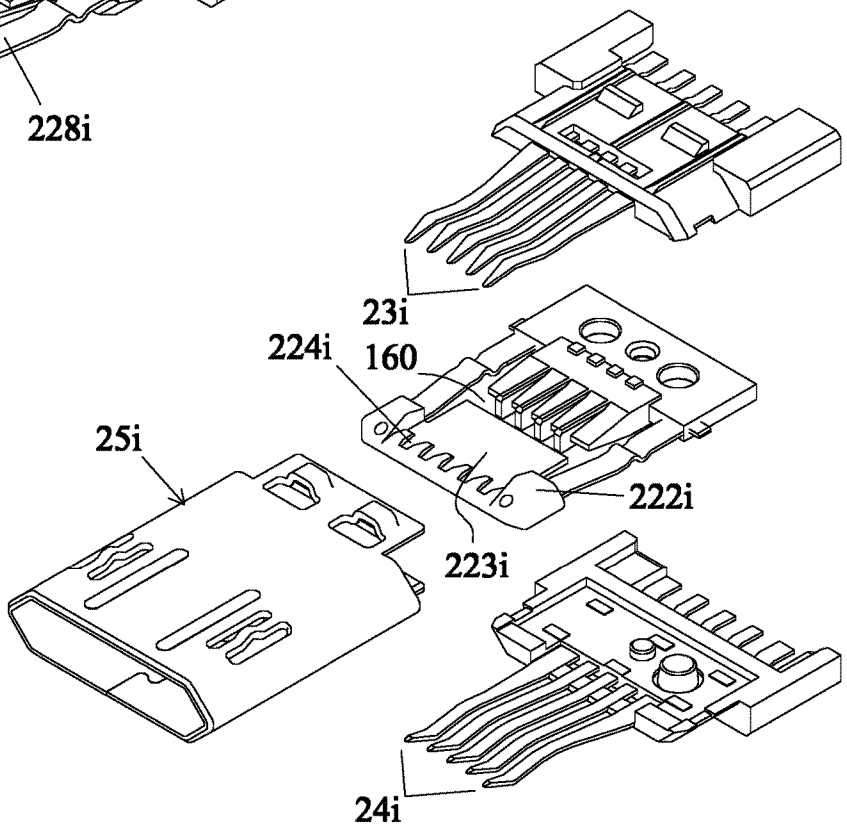
Figure 112:
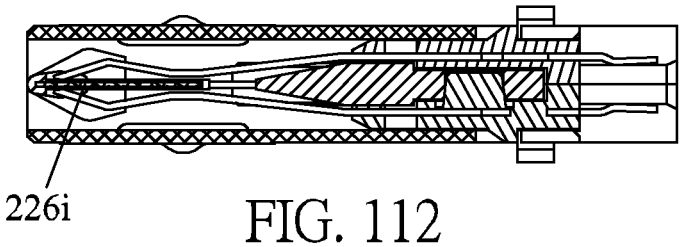
Figure 113:
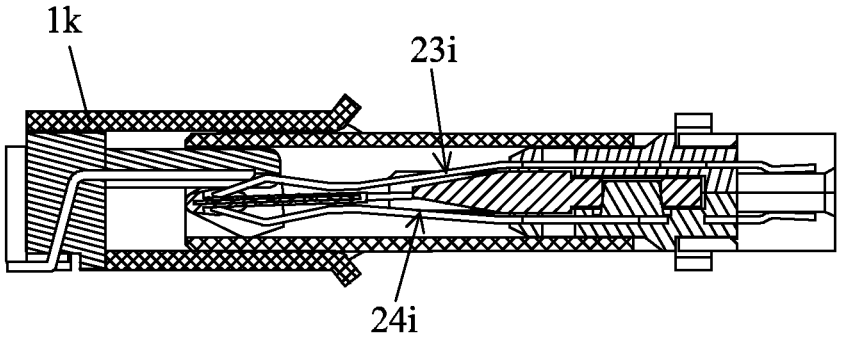
FIGS. 113 to 114 are structural cross-sectional schematic side views showing the bidirectional electrical connector according to the 19th preferred embodiment of the invention docking with the complementary electrical connector.
Figure 114:
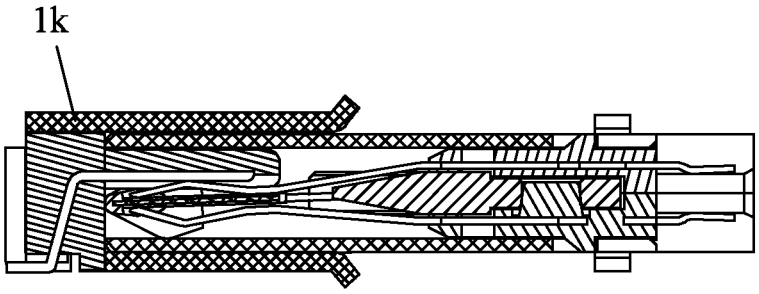

Referring to FIG. 105, the metallic inward contraction arm structure of one row of duplex contact terminals includes a metal plate 901*i*, the metal plate 901*i* is connected to at least one material tape 902*i*, the material tape 902*i* is connected to upper and lower rows of contact terminals 93*i* and 94*i* and at least one metallic inward contraction arm 95*i*, the upper and lower rows of contact terminals 93*i* and 94*i* are respectively provided with upper and lower two rows of contacts in front and rear rows or left and right rows, one metal plate is pressed and deployed to form pressed molding, the at least one metallic inward contraction arm 95*i* is provided with the link material bridge 951*i* linked to the at least one contact, the at least one metallic inward contraction arm is provided with the convex structure 952*i* to shorten the length of at least one of the contact terminals 93*i* and 94*i*. In this example, the metallic inward contraction arm is an inverse-U shaped closed form. Also, regarding the material tape, after the plastic material injection molding is completed, the material bridge is removed. So, the electroplating-free structure 961*i* of the broken metal terminal material bridge can be seen on two side surfaces of the insulation seat.

Referring to FIGS. 106 to 114, the bidirectional electrical connector 2*i* includes a tongue 22*i*, an insulation seat 21*i*, a reinforcement plate 221*i*, multiple upper contact terminals 23*i* arranged in one row, multiple lower contact terminals 24*i* arranged in one row and outer housing 25*i*. Each upper contact terminal includes an upper contact, an upper extension segment, an upper fixing portion and an upper pin. The front end of the upper contact has an upper bevel guide. Each lower contact terminal includes a lower contact, a lower extension segment, a lower fixing portion and a lower pin, and the front end of the lower contact has a lower bevel guide. The multiple upper contact terminals and the multiple lower contact terminals are respectively fixed to the insulation seat 21*i*. In this example, the bidirectional electrical connector is the electrical plug of the MICRO USB transmission interface.

Referring further to FIGS. 106 to 114, the tongue 22*i* is H-shaped and may float relatively to the insulation seat 21*i*, the tongue 22*i* includes multiple docking limit portions 222*i* and a partition plate 223*i*, and the partition plate 223*i* is located between the multiple docking limit portions 222*i* and is respectively connected to the multiple docking limit portions 222*i*. The thickness of the partition plate 223*i* is smaller than that of the docking limit portion 222*i*, and the multiple docking limit portions 222*i* and the partition plate 223*i* are integrally formed together. The two surfaces of the partition plate 223*i* respectively have multiple bevel guide limit slots 224*i*, wherein the multiple bevel guide limit slots 224*i* of the upper surfaces correspond to multiple upper contact terminals, the multiple upper contact terminals 23*i* may stretch into the corresponding multiple bevel guide limit slots 224*i* and rest against the partition plate 223*i*, and the multiple bevel guides of the front ends of the multiple upper contact terminals may be protected by the multiple bevel guide limit slots 224*i*. Similarly, the multiple bevel guide limit slots 224*i* of the lower surface of the partition plate 223*i* correspond to the multiple lower contact terminals 24*i*. The multiple lower contact terminals 24*i* may stretch into the corresponding multiple bevel guide limit slots 224*i* and rest against the partition plate 223*i*, and the multiple bevel guides of the front ends of the multiple lower contact terminals 24*i* may be protected by the multiple bevel guide limit slots 224*i*.

Referring further to FIGS. 106 to 114, when the bidirectional electrical connector is docking with the complementary connector, the multiple bevel guide limit slots can protect the front ends and two sides of the multiple upper contact terminals and the multiple lower contact terminals to prevent the impact and damage caused by the complementary connector. On the other hand, the insulation seat has multiple separation columns capable of separating and limit the multiple upper contact terminals 23*i* and the multiple lower contact terminals 24*i*, and further can protect the multiple upper contact terminals and the multiple lower contact terminals. In addition, a hollow region 160 is disposed between the tongue 22*i* and the insulation seat 21*i*, and the tongue is provided with the reinforcement plate 226*i*. The tongue is connected to the insulation seat 21*i* through the metal elastic sheets 228*i* of two sides of the reinforcement plate 226*i*, so that the tongue may float relatively to the insulation seat 21*i*. That is, when the bidirectional electrical connector is docking with the complementary connector, the tongue may float under the push of the complementary connector. In the invention, embedding and injection molding processes are performed on the reinforcement plate to form the tongue and the insulation seat on the reinforcement plate.

Referring further to FIGS. 106 to 114, multiple upper contacts of multiple upper contact terminals 23*i* project beyond the upper surface of the partition plate, and the distance between the multiple upper contacts and the upper surface (above the bevel guide limit slot) of the partition plate 223*i* of the tongue is greater than the depressed gap of the terminal of the complementary connector. Thus, when the bidirectional electrical connector is docking with the complementary connector, the multiple upper contacts 23*i* is pushed by the terminals of the complementary connector and compressed. At this time, the resilient normal force toward the direction of the terminal of the complementary connector may be generated in response to the metal resilience of the upper contact terminal 23*i* to ensure the upper contacts to stably contact the terminals. The multiple lower contact terminals 24*i* also have the similar properties, so detailed descriptions thereof will be omitted. On the other hand, because the multiple upper contact terminals 23*i* and the multiple lower contact terminals 24*i* respectively stretch into the corresponding multiple bevel guide limit slots and rest against the partition plate 223*i*, so the overall resilient normal force of the tongue can be increased. It is to be specified that the thickness of the docking limit portions 222*i* of the tongue 22*i* is greater than the thickness of the partition plate 223*i*. So, when the bidirectional electrical connector is docking with the complementary connector 1*k*, the partition plate of the tongue is pushed by the complementary connector and float downward. At this time, the thicker docking limit portions 222*i* contact the outer housing 25*i* to stop the partition plate 223*i* from floating downward. Meanwhile, a gap may be held between the lower contacts and the outer housing 25*i* to prevent the short-circuited condition from occurring.

Figure 115:
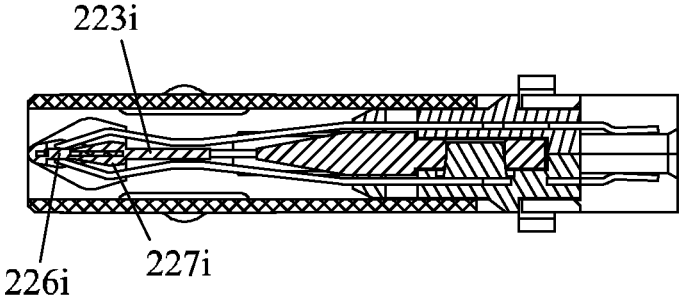
FIG. 115 is a structural cross-sectional schematic side view showing the bidirectional electrical connector according to the 20th preferred embodiment of the invention.

Referring to FIG. 115, the bidirectional electrical connector of the 20th preferred embodiment is substantially the same as that of the 19th preferred embodiment, so detailed descriptions thereof will be omitted. There are two differences therebetween. First, the front end 227*i* of the partition plate of the tongue has the larger thickness to increase the structural strength of the partition plate. Second, the positions of reinforcement plate corresponding to the contact terminals and resting against the partition plate are provided with multiple opening holes. When the partition plate molding process encounter the non-saturated membrane condition, the partial thickness of the partition plate is thinned, or even the reinforcement plate may be exposed out of the partition plate, so that the contact terminal may contact the reinforcement plate. Thus, the function of the multiple opening holes in the molding process is to assist the plastic material in flowing into the multiple opening holes, so that the partition plate has the saturated membrane to prevent the contact terminal from contacting the reinforcement plate.

Figure 116:
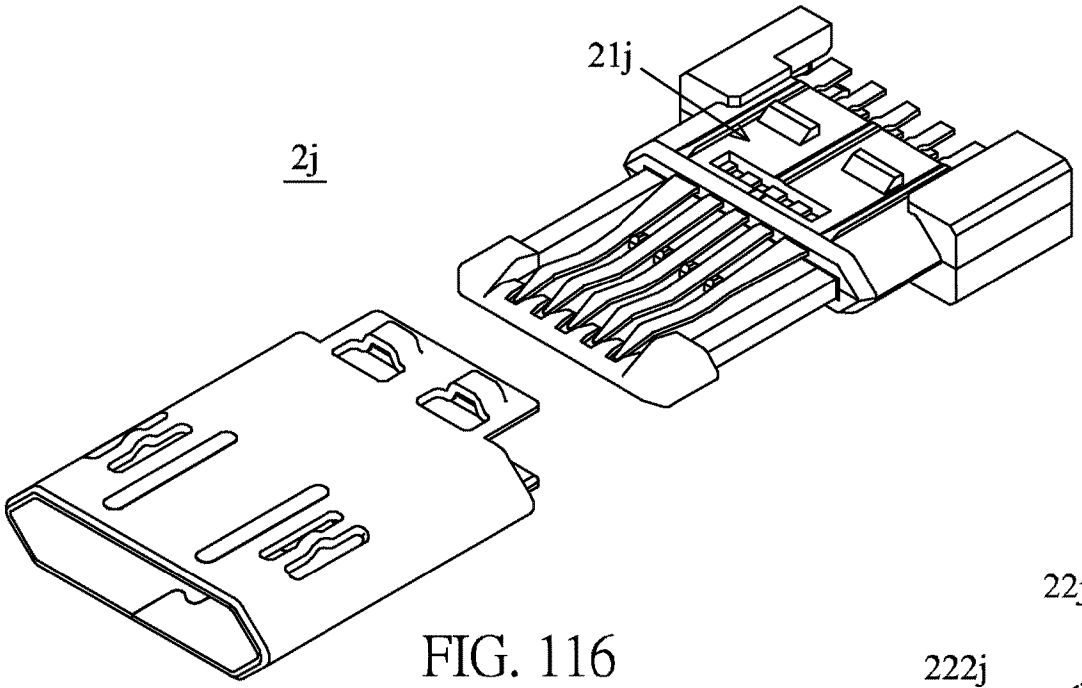
FIGS. 116 to 118 are schematic structural views showing the bidirectional electrical connector according to the 21st preferred embodiment of the invention at different viewing angles.
Figure 117:
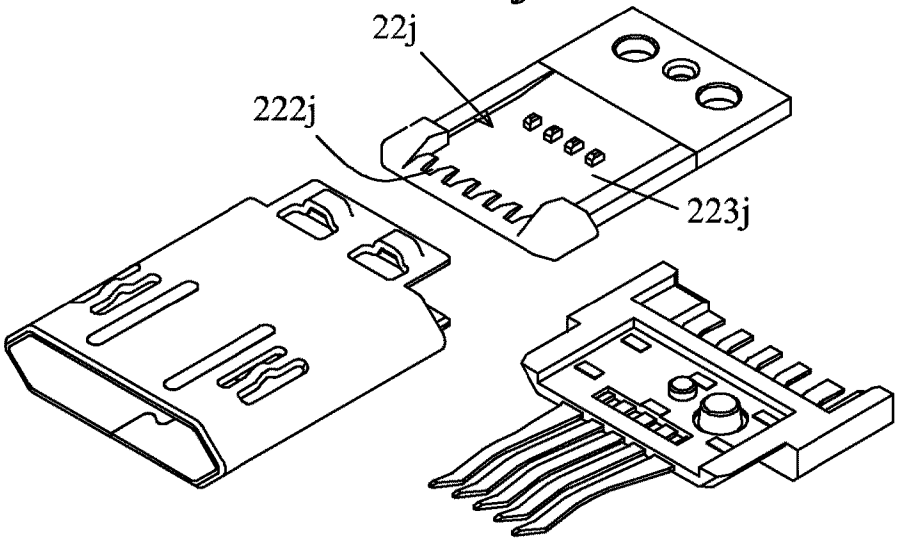
Figure 118:
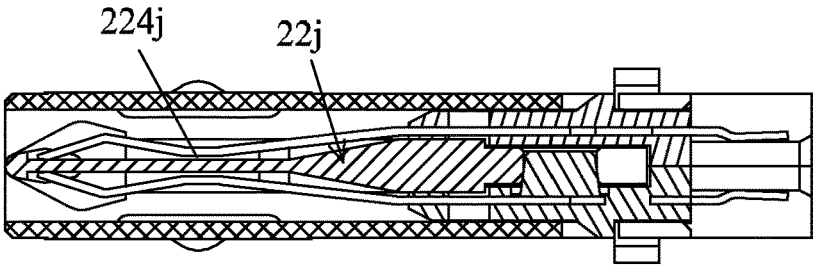

Referring to FIGS. 116 to 118, the bidirectional electrical connector 2*j* of the 21st preferred embodiment includes a tongue, an insulation seat, multiple upper contact terminals arranged in one row, multiple lower contact terminals arranged in one row and an outer housing, wherein each upper contact terminal includes an upper contact, an upper extension segment, an upper fixing portion and an upper pin. Each lower contact terminal includes a lower contact, a lower extension segment, a lower fixing portion and a lower pin. The reinforcement plate 226*j* may be disposed in the tongue 22*j* in the bidirectional electrical connector 2*j*. Also, tongue 22*j* is H-shaped and includes multiple docking limit portions 222*j* and a partition plate 223*j*, and the partition plate 223*j* and a portion of the insulation seats 21*j* are integrally formed together to form a full plastic tongue. When the bidirectional electrical connector is docking with the complementary connector, the partition plate 223*j* of the tongue 22*j* is pushed by the complementary connector and slightly float downwards, the generated floating displacement is smaller. Second, the front bevel guide of the contact of the contact terminal rests against the bottom portion of the limit slot, and the middle section of the elastically movable extension and each of the top and bottom sides of the floating or fixed tongue 22*j* is provided with the elastically movable gap 155.

Figure 119:
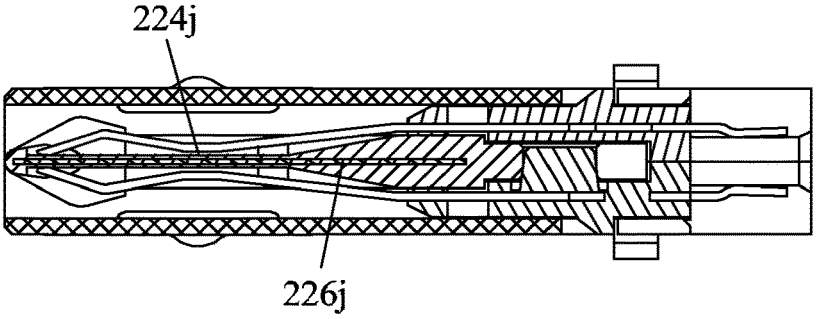
FIGS. 119 and 120 are schematically cross-sectional views showing the tongue and the contact interface of the bidirectional electrical connector according to the 21st preferred embodiment of the invention in different aspects.
Figure 120:
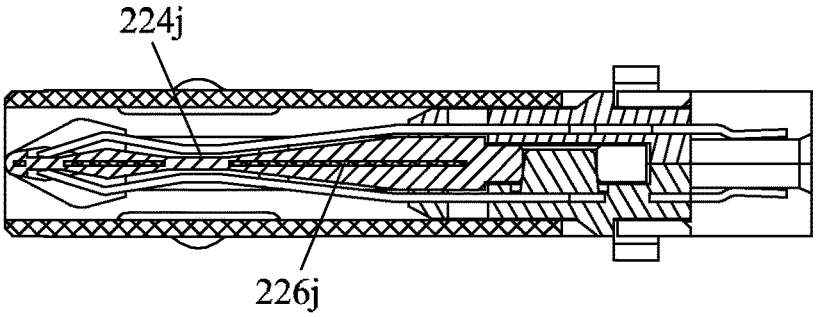

Referring to FIGS. 119 and 120, the reinforcement plate 226*j* is disposed inside the partition plate 223*j*, to increase the structural strength and resilience of the tongue. wherein the reinforcement plate 226*j* may be molded into a full plastic tongue by the embedding and injection molding processes. It is to be specified that, the reinforcement plate 226*j* in FIG. 120 is provided with the opening hole, and the structure thereof is advantageous to the molding of the tongue.

Figure 121:
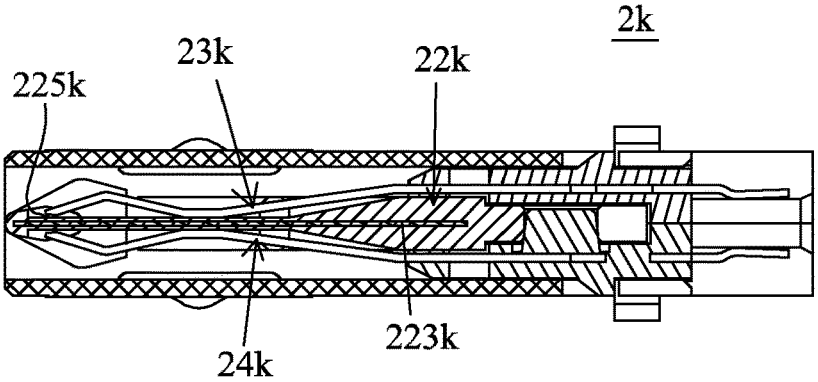
FIG. 121 is a schematic structural cross-sectional view showing the bidirectional electrical connector according to the 22nd preferred embodiment of the invention at the viewing angle.

Referring to FIG. 121, the portions of the upper contact terminal 23*k* and the lower contact terminal 24*k* of the bidirectional electrical connector 2*k* of the 22nd preferred embodiment resting against the partition plate 223*k* of the tongue 22*k* are the upper extension segment and the lower extension segment, and the upper bevel guide and the lower bevel guide do not contact the partition plate. In other words, the portions of the upper contact terminal and the lower contact terminal of the invention resting against the partition plate are not restricted to the upper bevel guide and the lower bevel guide. It is also possible to utilize other portions of the contact terminal to rest against the partition plate. Second, in this embodiment, the middle sections of the vertically elastically movable extensions rest against the top and bottom sides of the tongue 22*k*, and the elastically movable gaps 155 are provided between the bevel guide of the front end of the contact and the top and bottom sides of the tongue 22*k*.

Figure 123:
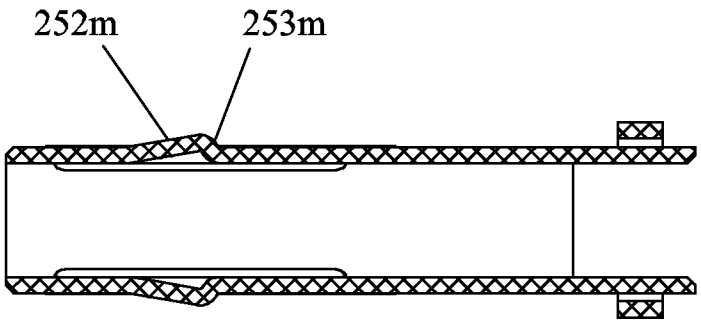
FIGS. 122 and 123 are pictorially and schematically cross-sectional views showing the outer housing of the 23rd preferred embodiment.
Figure 122:
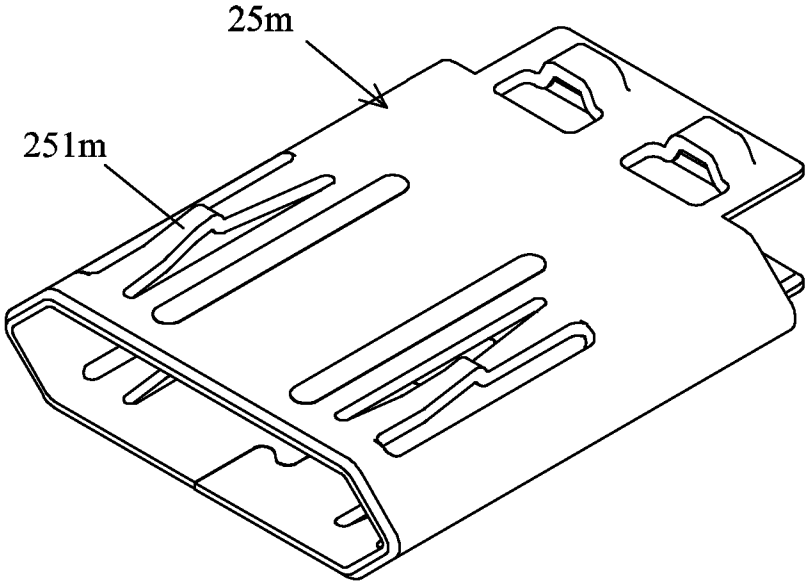

Referring to FIGS. 122 and 123, the outer housing 25*m* of the bidirectional electrical connector of the 23rd preferred embodiment has elastically movable multiple snaps 251*m*, which are fishing-rod type arm snaps. Specifically speaking, each of the multiple snaps 251*m* is a closed form middle-section structure provided with at least one longitudinally extended structure and having front and rear two ends provided with the fulcrums. Alternatively, each of the multiple snaps is provided with at least one longitudinally extended structure, and has front and rear two ends each having the structure with tapered arm width toward the middle section. Alternatively, the multiple snaps are closed extended structures, and the inserting bevel guide is smaller than pull-out bevel. That is, the angle of one surface 252*m* of the front end of the snap close to the outer housing is more smooth, and the angle of one surface 253*m* of the rear end of the snap close to the outer housing is larger, as shown in FIG. 123. Thus, when the bidirectional electrical connector is docking with the complementary connector, the surface of the snap with the larger angle is advantageous to the connection between the bidirectional electrical connector and the complementary connector, and the docking between both of them cannot be easily separated.

Figure 124:
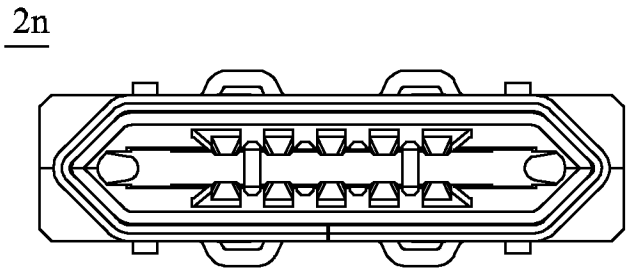
FIGS. 124 to 126 are a front view, a partially decomposed pictorial view and a partially decomposed pictorial view showing the bidirectional electrical connector of the 24th embodiment.
Figure 125:
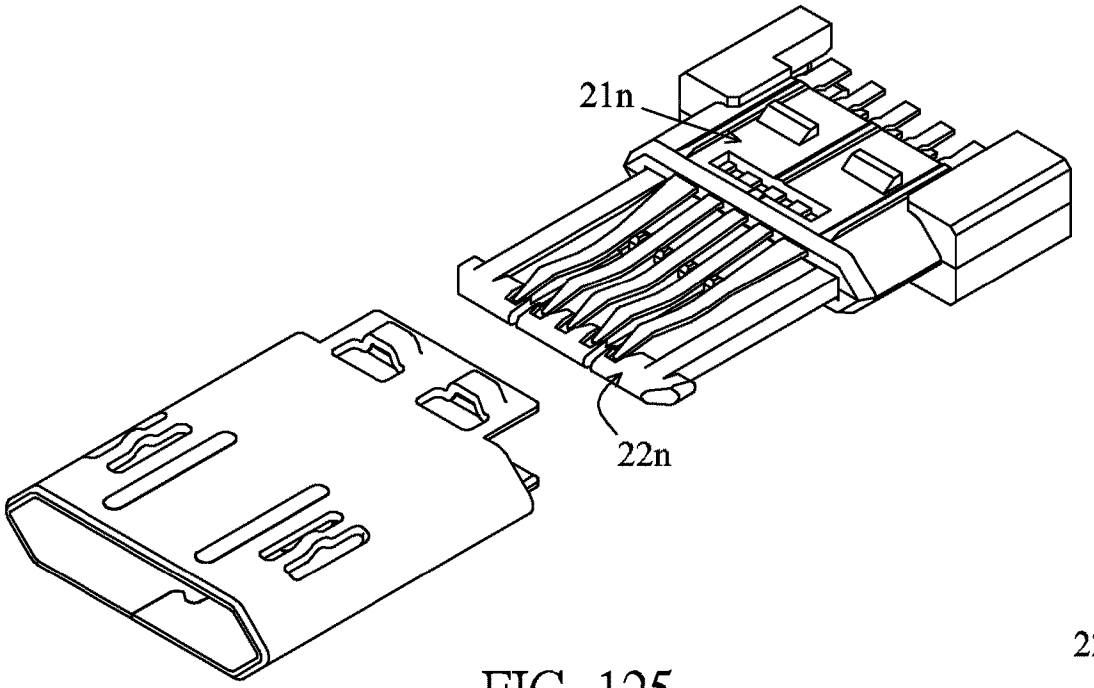
Figure 126:
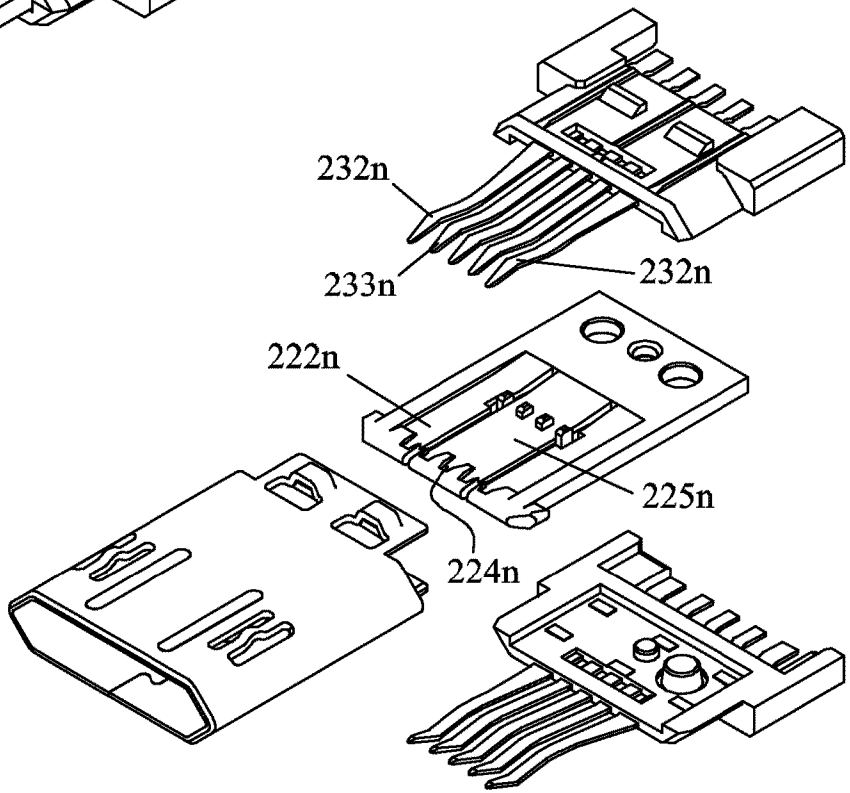

Referring to FIGS. 124 to 126, in multiple upper contact terminals arranged in one row of the bidirectional electrical connector of the 24th embodiment 2n, the lengths of the two contacts terminal 232*n* on the outer side are longer than the lengths of the three contact terminals 233*n* on the inner side, and the lower contact terminals also have the similar property. Second, in response to the structure, in which multiple upper contact terminals and multiple lower contact terminals have different lengths, the partition plate 225*n* of the tongue 22*n* has the corresponding structure. The tongue 22*n* is H-shaped and can float relatively to the insulation seat 21*n*, the tongue 22*n* includes multiple docking limit portions and a partition plate, and two surfaces of the partition plate 222*n* respectively have multiple bevel guide limit slots. In response to the structure, in which multiple upper contact terminals and multiple lower contact terminals have different lengths, the lengths of the multiple bevel guide limit slots 224*n* are also adjusted therewith. For example: in the tongue specified by the USB Association, the distance from the front end of the tongue corresponding to longer contact terminal to the bevel guide of the contact ranges from 0.8 mm+0.15 mm to 0.8 mm-0.15 mm; and in the tongue specified by the USB Association, the distance from the front end of the tongue corresponding to the shorter contact terminal to the bevel guide of the contact ranges from 1.2 mm+0.15 mm to 1.2 mm-0.15 mm. That is, the difference between the length of the contact of the longer contact terminal 232*n* and the length of the contact of the shorter contact terminal 233*n* is smaller than or equal to 0.2 mm. Also, the partition plate 225*n* is divided into three sheets, which include two outer side partition plate parts corresponding to the longer contact terminal and one inner side partition plate part corresponding to the shorter contact terminal. With the structure, in which the partition plate is divided into three sheets, the two outer side partition plate parts can operate independently in response to the longer contact terminal. Similarly, the inner side partition plate part may also operate independently in response to the shorter contact terminal. In other words, the partition plate 225*n* of this preferred embodiment can act independently in response to the longer contact terminal or the shorter contact terminal.

Figure 129:
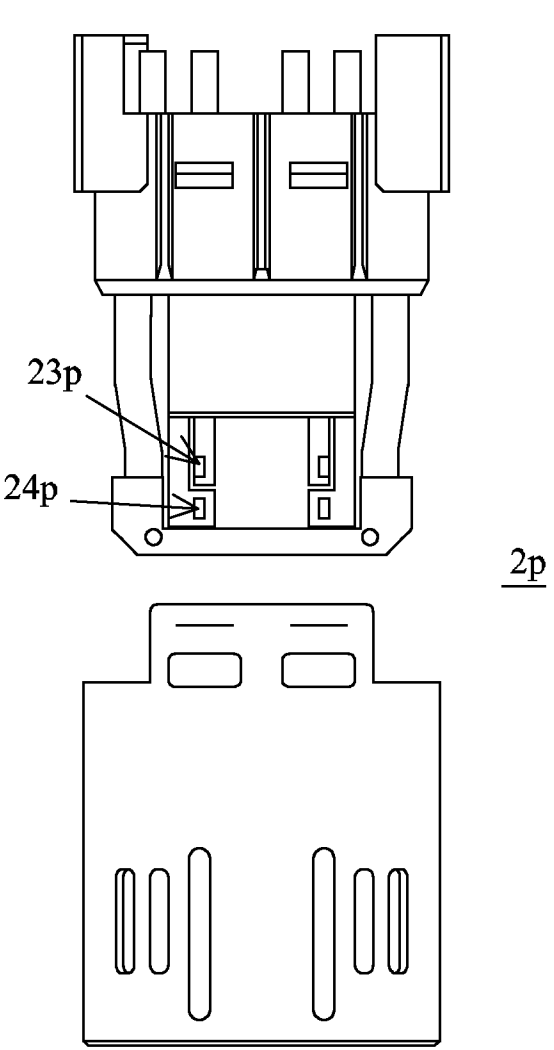
FIGS. 127 to 129 are a front view, a partially decomposed pictorial view and a partially decomposed schematic top view showing the bidirectional electrical connector of the 25th preferred embodiment.
Figure 127:
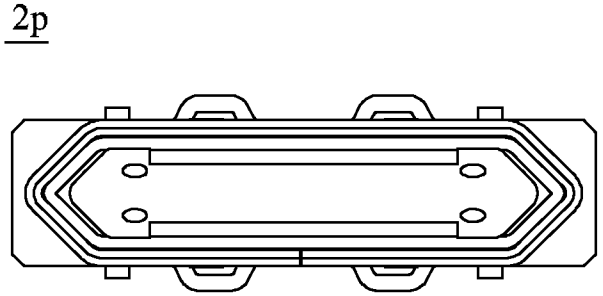
Figure 128:
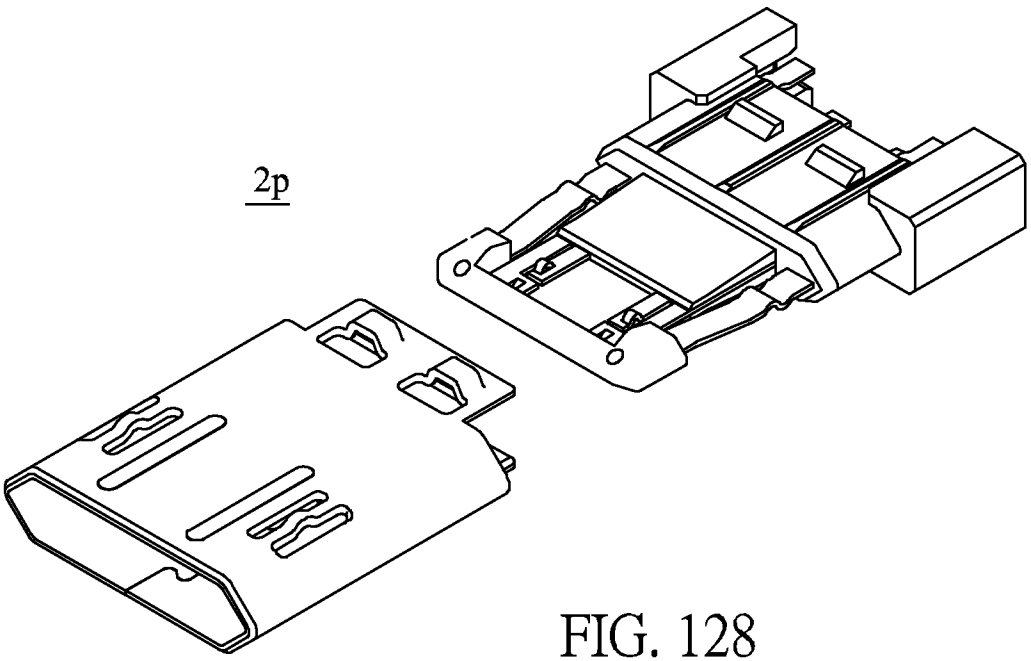

Referring to FIGS. 127 to 129, the bidirectional electrical connector 2*p* of the 25th preferred embodiment is a charging type structure. That is, the contact terminals need not to perform the data signal transmission, and only need to perform the electric power transmission, so the bidirectional electrical connector is referred to as a charging type structure connector. There are only two contact terminals, and the horizontal width of each contact terminal is greater than the horizontal width of the contact terminal of the preferred embodiment to increase the charging speed. The contact terminals are made of the same copper sheet, and only one embedding and injection molding process is needed to mold multiple contact terminals fixed to the tongue.

Figure 131:
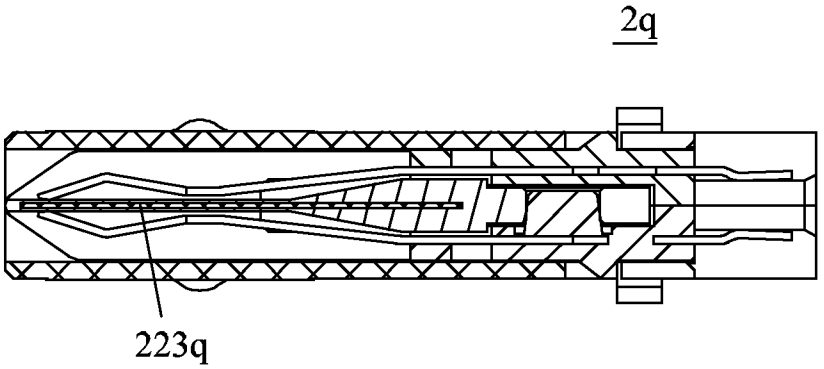
FIGS. 130 to 132 are a front view and a side cross sectional view showing the bidirectional electrical connector of the 26th preferred embodiment, and schematically cross-sectional view for docking with the complementary electrical connector.
Figure 132:
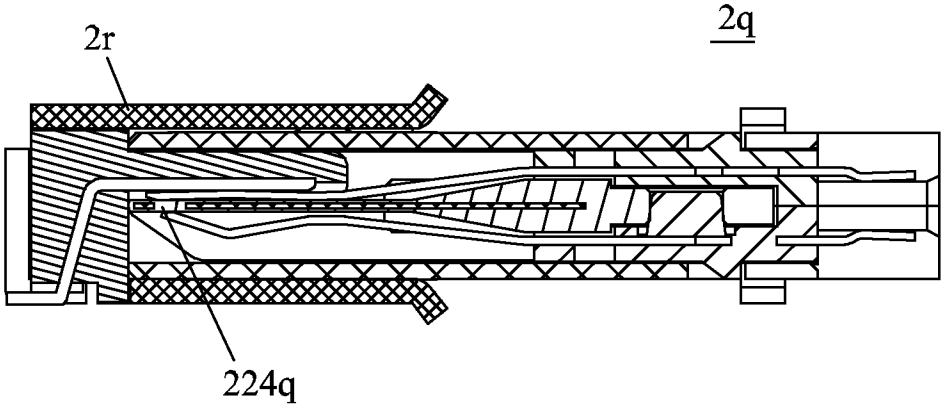
Figure 130:
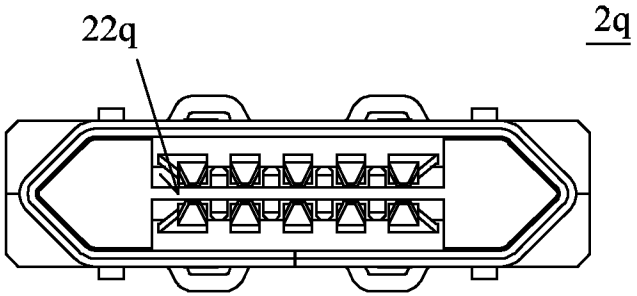
Figure 135:
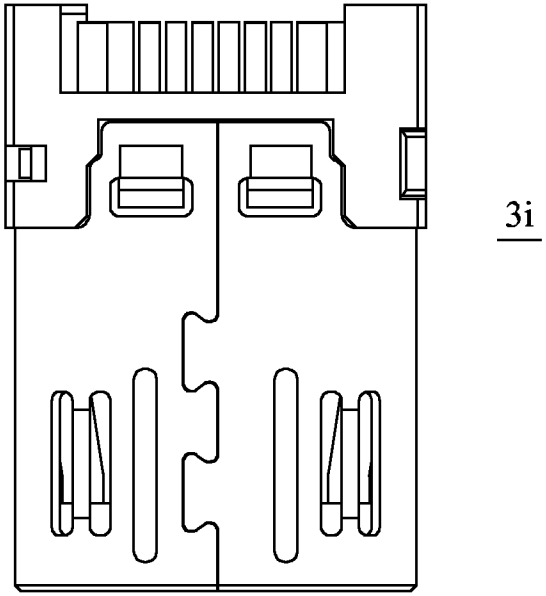
FIGS. 133 to 138 are a pictorial view, a side view, a top view, a front view, partially decomposed and schematically cross-sectional views showing the duplex electrical connector of the 27th embodiment.
Figure 136:
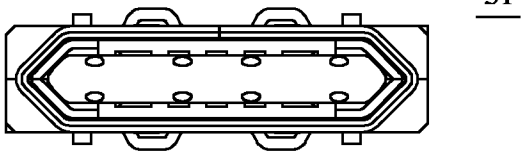
Figure 133:
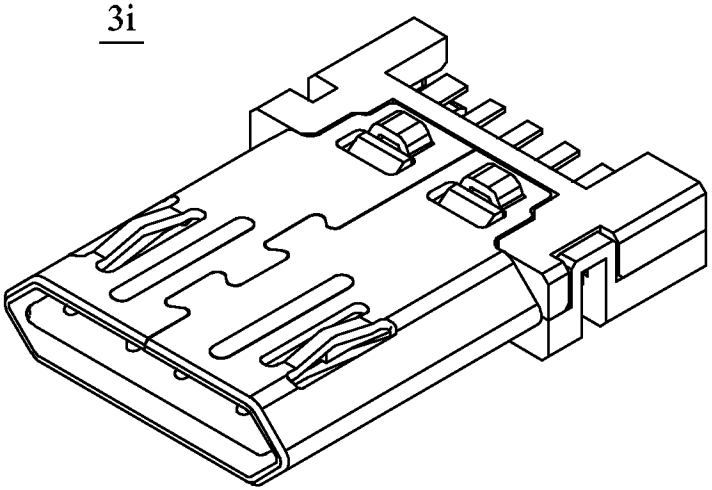
Figure 134:
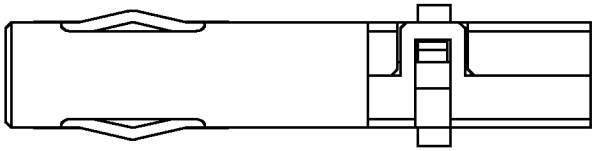
Figure 137:
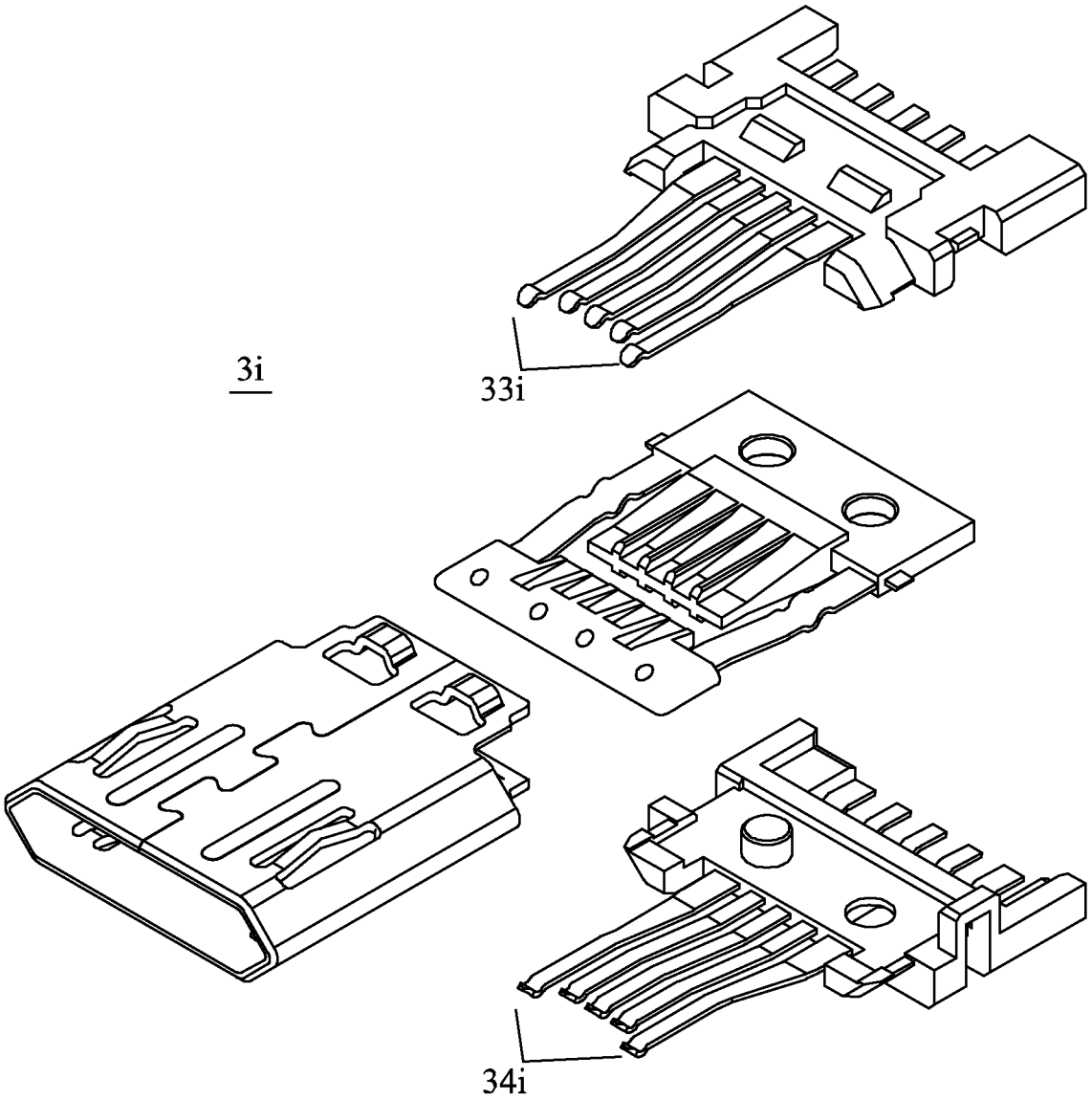
Figure 138:
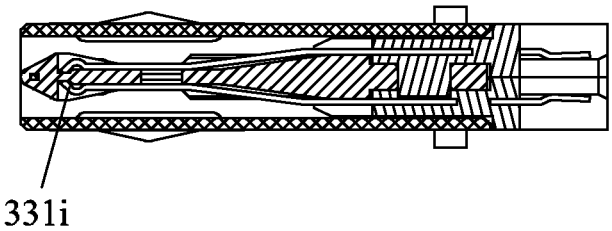
Figure 139:
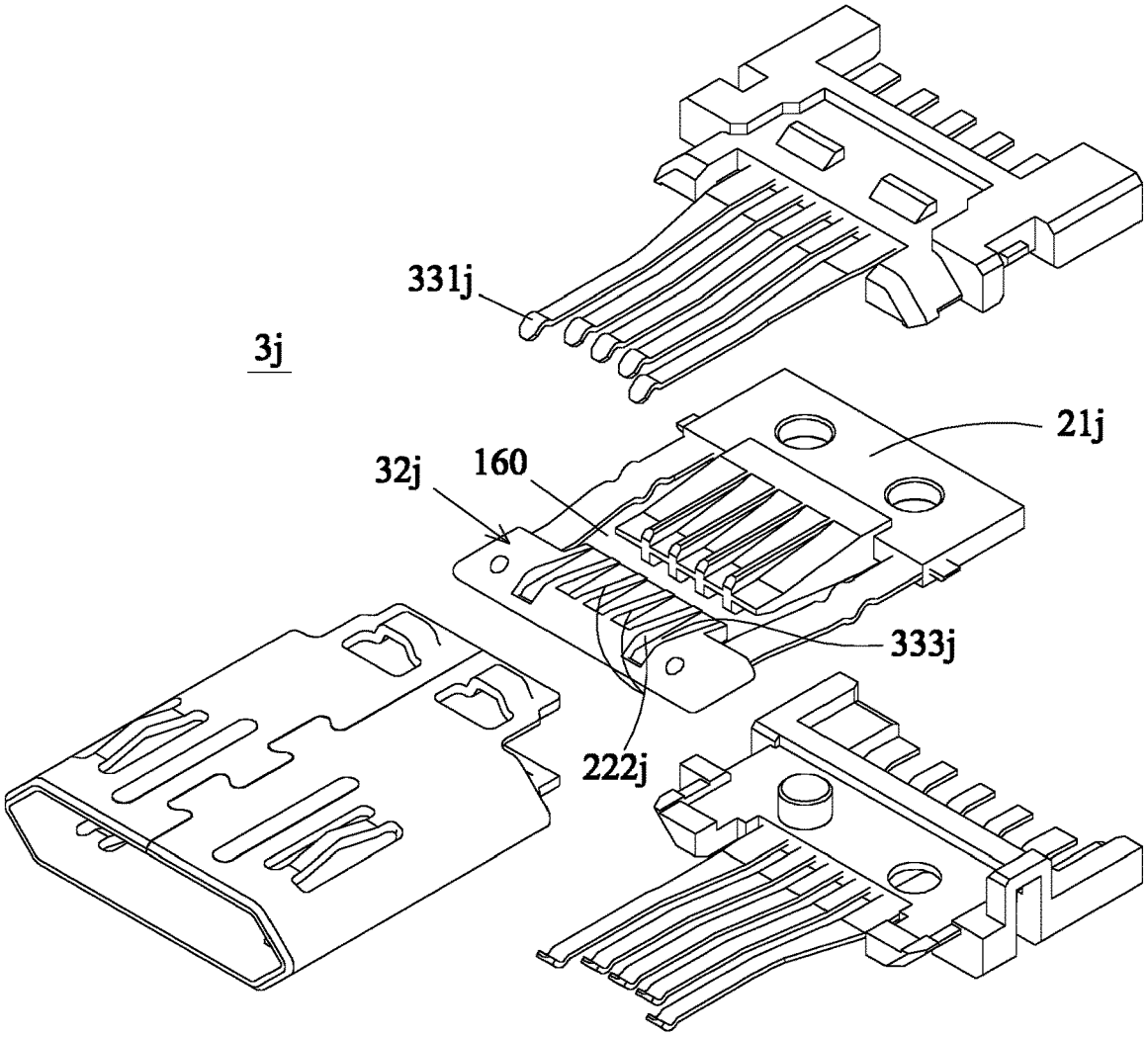
FIGS. 139 to 144 are a partially decomposed view, a side cross sectional view, a pictorial top view and a pictorial top view showing the duplex electrical connector of the 28th embodiment.
Figure 140:
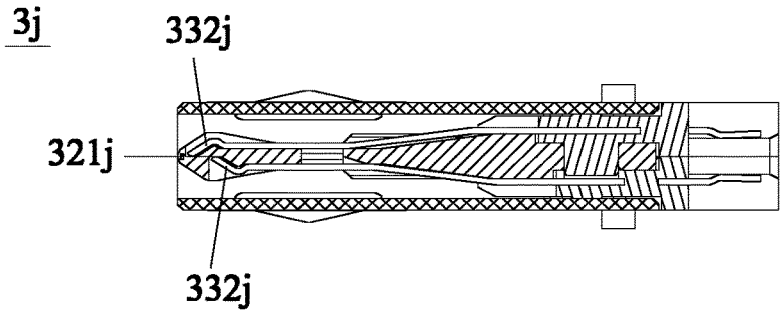

Referring to FIGS. 130 to 132, the tongue 22*q* of the bidirectional electrical connector 2*q* of the 26th preferred embodiment has the thinner thickness, and does not have multiple bevel guide limit slots. When the bidirectional electrical connector is docked with the complementary connector 2*r*, because the tongue 22*q* has the thinner thickness, it is not pushed to float by the complementary connector 2*r*. That is, the tongue 22*q* of this example is a fixed and non-floating structure. When the bidirectional electrical connector 2*q* is docked with the complementary connector 2*r*, multiple upper contacts of multiple upper contact terminals are pushed and compressed by the complementary connector, as shown in FIG. 132. Multiple lower contacts of multiple lower contact terminals also have the similar properties, and detailed descriptions thereof will be omitted. wherein the positions on the reinforcement plate 223*q* and corresponding to the contact terminals resting against the partition plate are provided with multiple opening holes 224*q* functioning to assist the plastic material in flowing into the multiple opening holes in the molding process, so that the partition plate has the saturated membrane to prevent the contact terminals from contacting the reinforcement plate 223*q*.

Referring to FIGS. 133 to 138, in the duplex electrical connector 3*i* of the 27th embodiment, the bevel guides 333*i* of the upper contact terminal 33*i* and the lower contact terminal 34*i* thereof are correspondingly in flat surface contact with each other without staggering, wherein the others are similar to the above-mentioned example and will not be described in detail.

Figure 141:
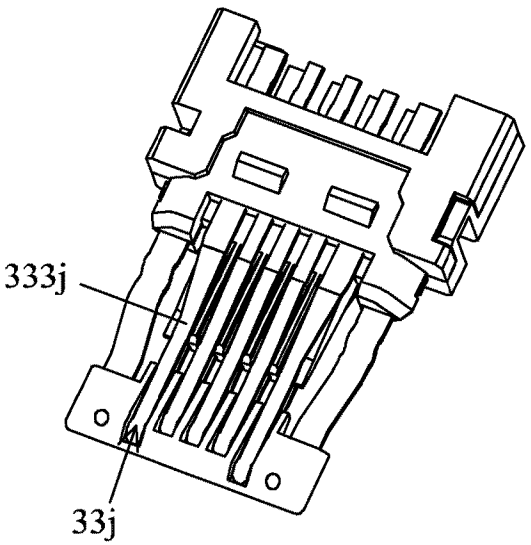
Figure 143:
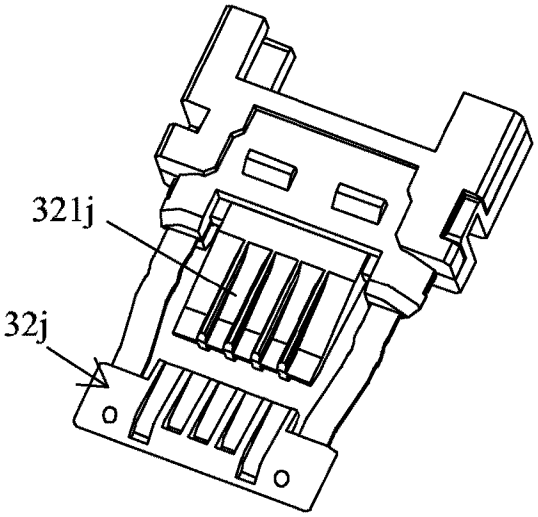
Figure 142:
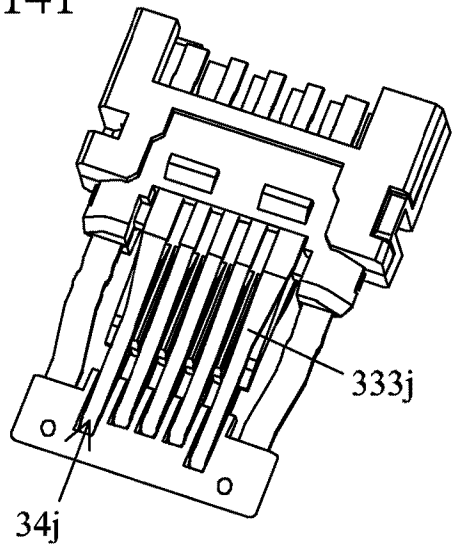
Figure 144:
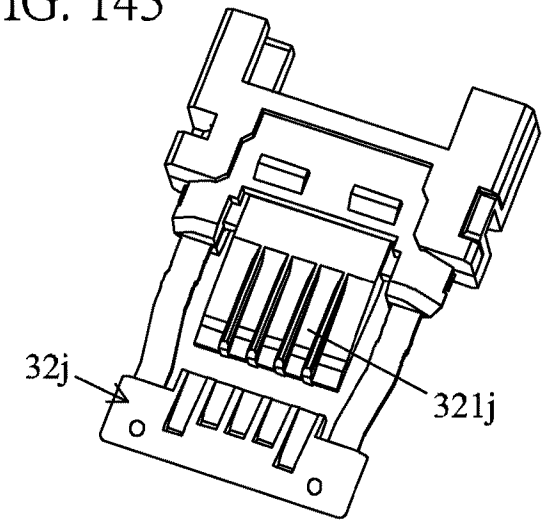
Figure 147:
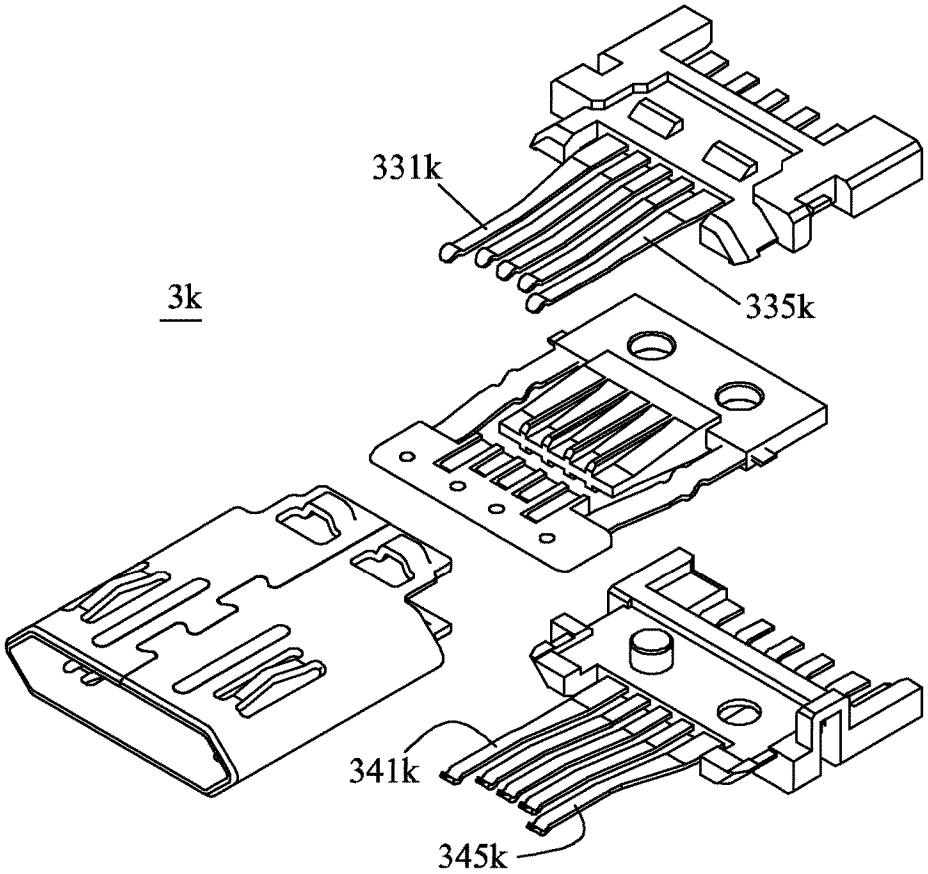
FIGS. 145 to 148 are a top view, a front view, a partial decomposed view and a schematically cross-sectional side view showing the duplex electrical connector of the 29th embodiment.
Figure 148:
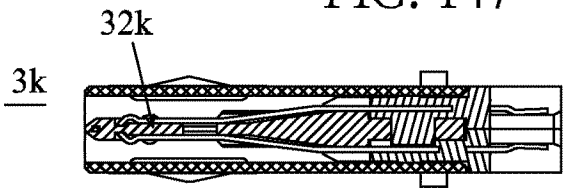
Figure 145:
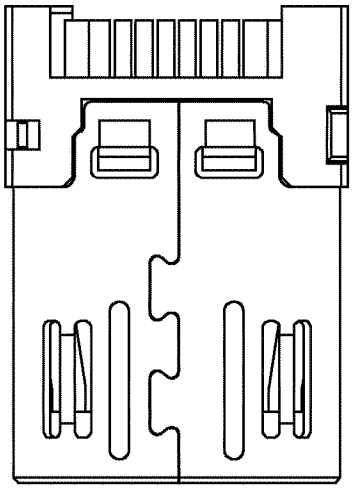
Figure 146:
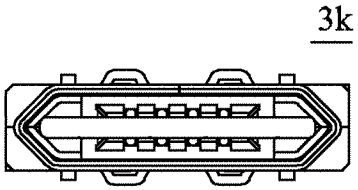

Referring to FIGS. 139 to 144, the duplex electrical connector 3*j* of the 28th embodiment is characterized in that: the upper and lower contacts 33*j* and 34*j* left-right opposite and front-rear staggered contacts depressedly disposed in the left-right opposite and front-rear staggered elastic movement slots 333*j* for elastically movable connection points, wherein the above-mentioned arrangement can prevent the upper and lower contacts 33*j* and 34*j* from mutual collision to cause short-circuit. Multiple connection points 331*j* are left-right opposite and front-rear staggered, wherein the multiple bevel guides of the contact terminals are in flat surface contact with the center line 321*j* of the tongue. Elastically movable extensions of one row of 5 connection points having front ends resting against the concave portion behind the floating tongue 32*j* are disposed behind the tongue 32*j* at top and bottom positions, and the elastically movable extension is provided with the contact with the elastically movable dual-arm middle-section connection point. The insulation base seat is a three-piece base seat stack, and the three-piece base seat is embedded or assembled at least one row of terminals. FIG. 141 shows the longer contact 33*j*, while FIG. 142 shows the shorter contact 34*j*.

There are multiple limit projections 222 disposed between each row of the contacts. A hollow region 160 is disposed between the tongue 32*j* and the insulation seat 21*j*.

Referring to FIGS. 145 to 148 showing the duplex electrical connector 3*k* of the 29th embodiment, at least one of the contacts, extensions, fixing portions and pin portions of the power and ground terminals 331*k*, 335*k*, 341*k* and 345*k* of the upper and lower rows of contact terminals has the wider width. Preferably, all of them are widened, and the grounding and power terminals are disposed on two outer sides.

Figure 149:
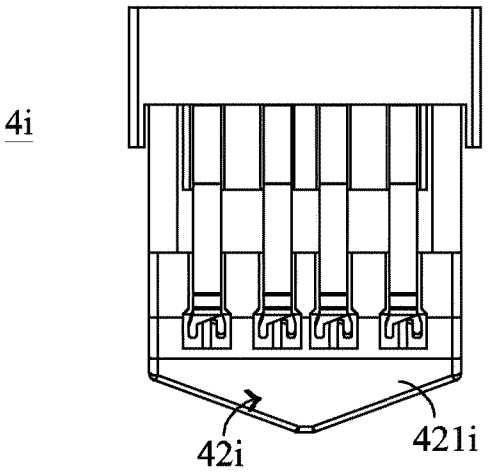
FIGS. 149 to 151 are a top view, a partial pictorial view and a pictorial view showing the duplex electrical connector of the 30th embodiment.
Figure 150:
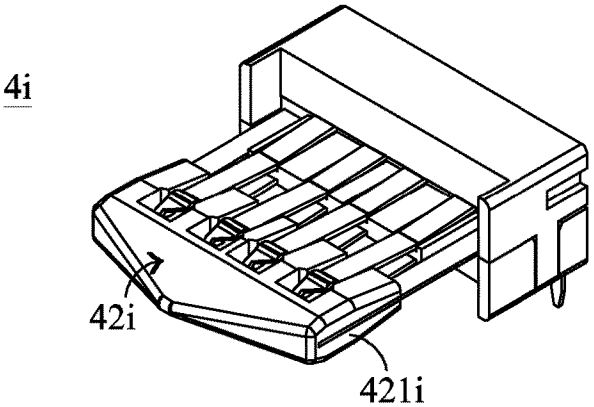
Figure 151:
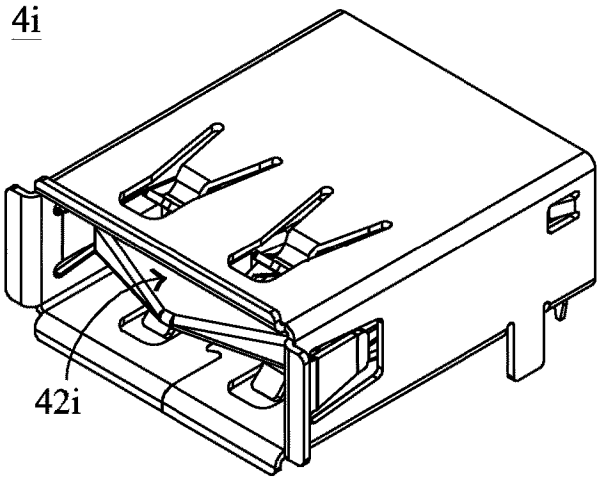
Figure 153:
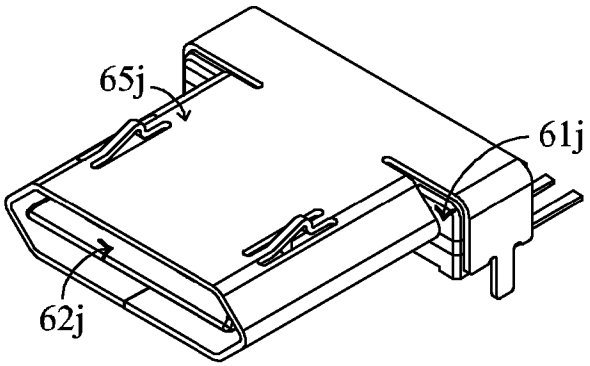
FIGS. 152 to 157 are a partial decomposed pictorial view, a pictorial view, a top view, a side view, a partial decomposed pictorial view and a pictorial view showing the bidirectional duplex electrical connector of the 31st embodiment.
Figure 154:
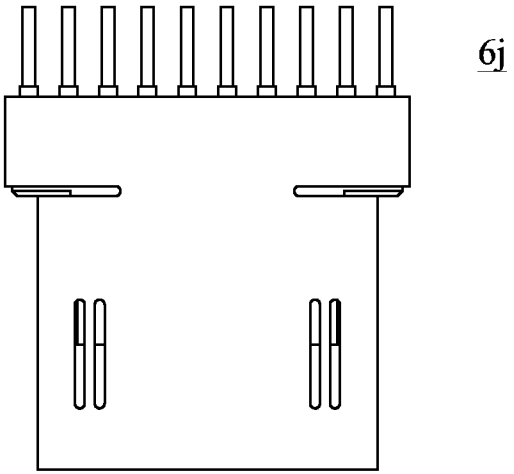
Figure 152:
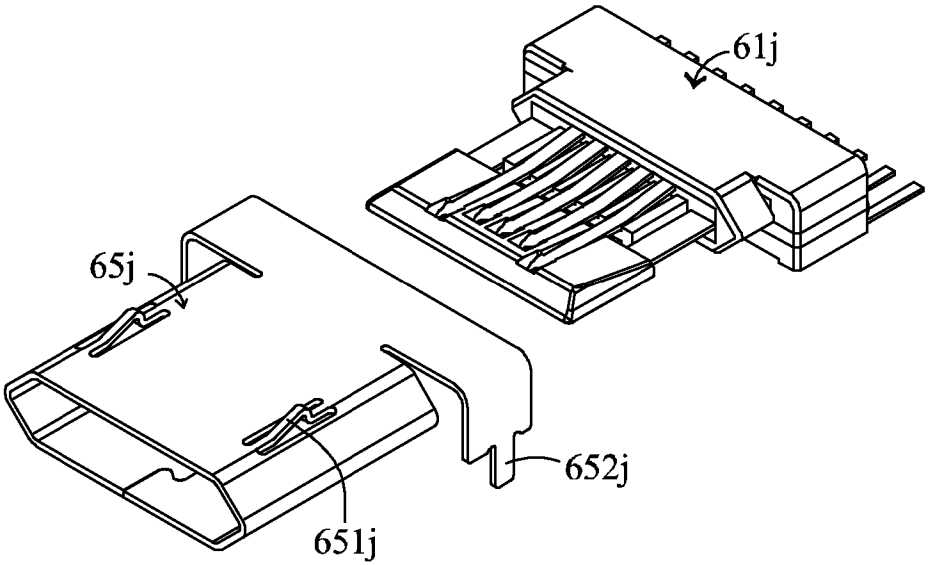
Figure 155:
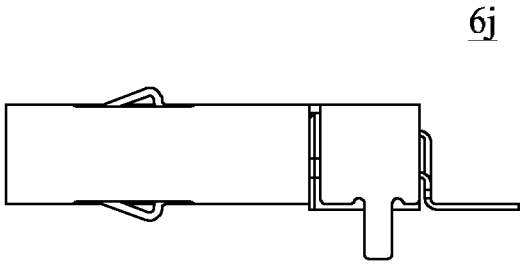
Figure 157:
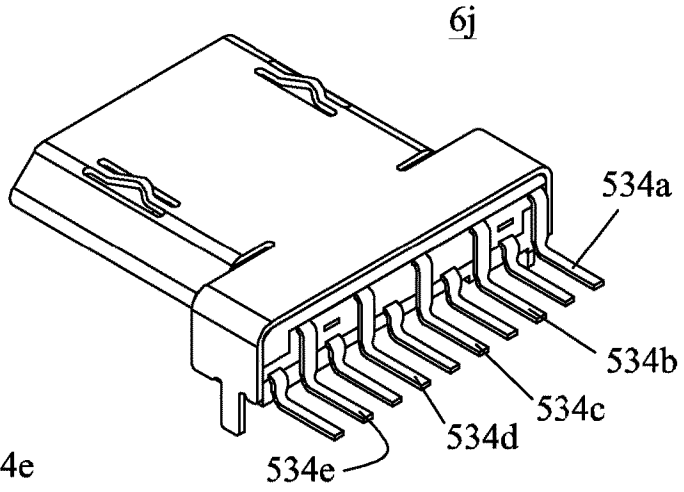

Referring to FIGS. 149 to 151, the shape of the plate body 421*i* of the floating tongue 42*i* of the duplex electrical connector 4*i* of the 30th embodiment is the multi-bevel pyramid structure, which is more beneficial to the docking with the complementary electrical connector.

Referring to FIGS. 152 to 157, the bidirectional duplex electrical connector 6*j* of the 31st embodiment includes an insulation seat 61*j*, a floating tongue 62*j*, one row of upper terminal interfaces, one row of lower terminal interfaces and an outer housing 65*j*. The outer housing 65*j* of the bidirectional duplex electrical connector 6*j* includes a resilient snap structure 651*j* and a metal housing bonding pin 652*j*. The resilient snap structure 651*j* is advantageous to the increase of the combination force when both of them are docked with each other, and the metal housing bonding pin 652*j* may be connected to a circuit board. Second, the upper pins of the upper terminal interfaces and the lower pins of the lower terminal interfaces are in the staggered single-row arrangement, and extends out of the insulation seat 61*j* in a direction parallel to the floating tongue 62*j*.

Figure 158:
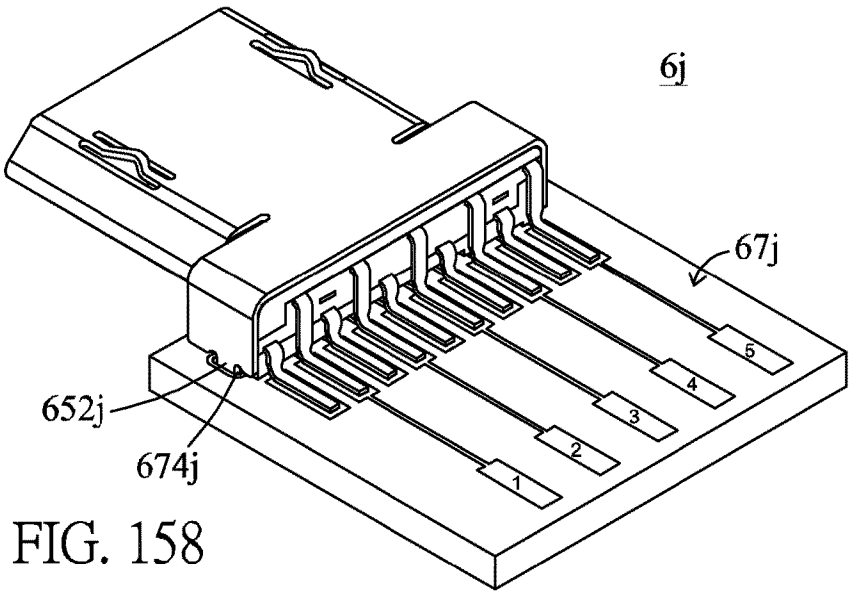
FIGS. 158 to 160 are a pictorial view, a partial structure pictorial view and a partial structural schematic top view showing the bidirectional duplex electrical connector of the 32nd embodiment.
Figure 156:
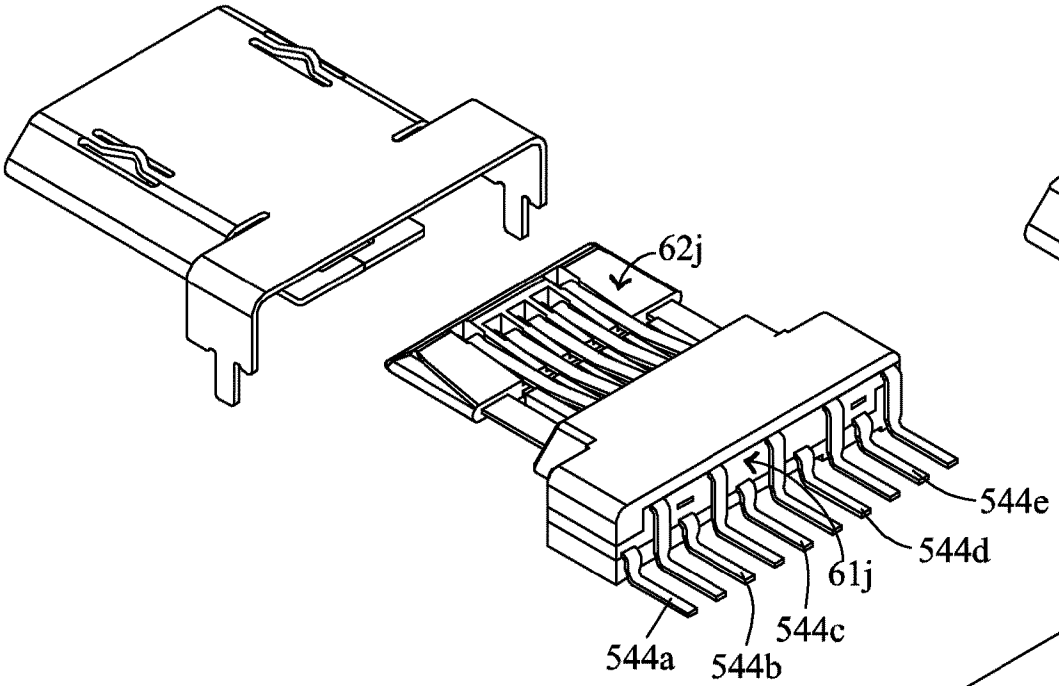
Figure 159:
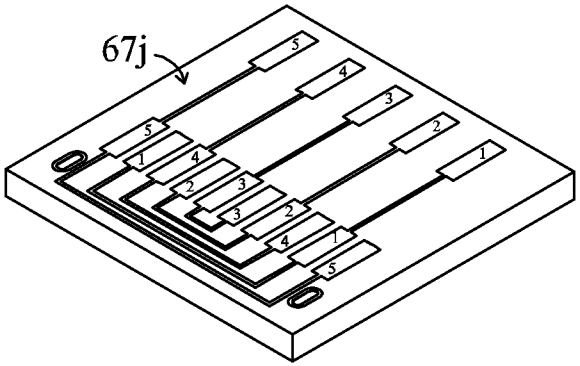
Figure 160:
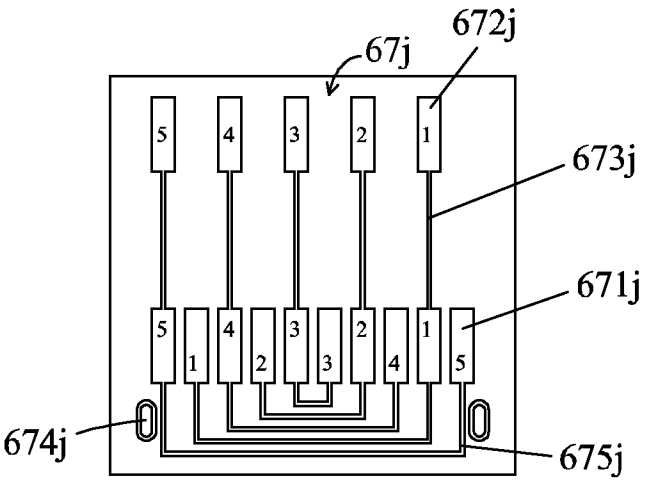

Referring to FIGS. 158 to 160, the bidirectional duplex electrical connector 6*j* is connected to the circuit board 67*j* by way of bonding. The circuit board 67*j* is provided with the circuit-board opening hole 674*j* corresponding to the metal housing bonding pin 652*j*, and further includes multiple pin bonding pads 671*j* corresponding to the upper pins 534*a* to 534*e* of the upper terminal interfaces and the lower pins 544*a* to 544*e* of the lower terminal interfaces. Each pin bonding pad 671*j* is assigned with the arranged serial number corresponding to the terminal interface. That is, there are two pin bonding pads 671*j* assigned with the same arranged serial number and respectively connected to the upper terminal interface and the corresponding lower terminal interface. In this embodiment, the upper terminal interface and the corresponding lower terminal interface are respectively connected to the corresponding pin bonding pads 671*j* by the surface mount technology (SMT). In addition, the circuit board 67*j* further includes other electroconductive pads 672*j*. The electroconductive pads 672*j* are electrically connected to several pin bonding pads 671*j* with different arranged serial numbers through wires 673*j*. Also, the pin bonding pads 671*j* with the same arranged serial number are electrically connected to each other through the turning cascaded structure 675*j*, and the turning cascaded structure 675*j* disposed on the portion of the circuit board 67*j* covered by the insulation seat 61*j*. According to the descriptions mentioned hereinabove, the invention is electrically connected to the pin bonding pads 671*j* with the same arranged serial number through the turning cascaded structure 675*j*. Thus, only a half number of pin bonding pads 671*j* are needed to connect to the electroconductive pads 672*j* through the wires 673*j*. Upon the actual signal transmission, the signals either through the upper terminal interface or through the lower terminal interface may be transmitted to the electroconductive pads 672*j* through the wires 673*j*, and further transmitted to the circuit board 67*j* or other external circuits. On the contrary, the external signal may also be transmitted to the upper terminal interface or the lower terminal interface. Also, the signal pin of the terminal interface and the cascaded structure are adjacently arranged approximately, parallelly and equidistantly.

Figure 161:
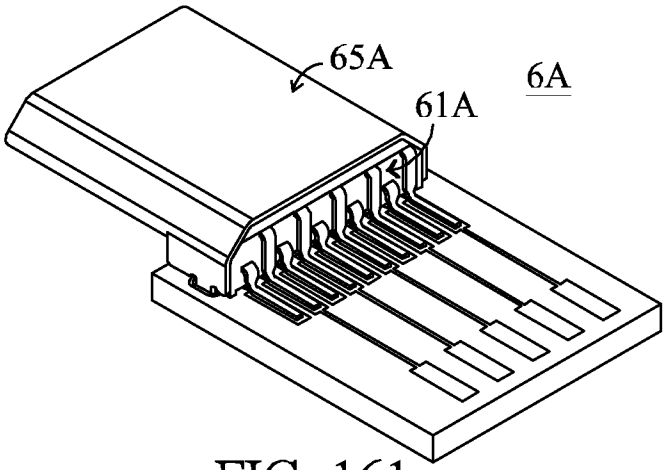
FIG. 161 is a schematic view showing different aspects of the bidirectional duplex electrical connector of the 32nd embodiment.
Figure 162:
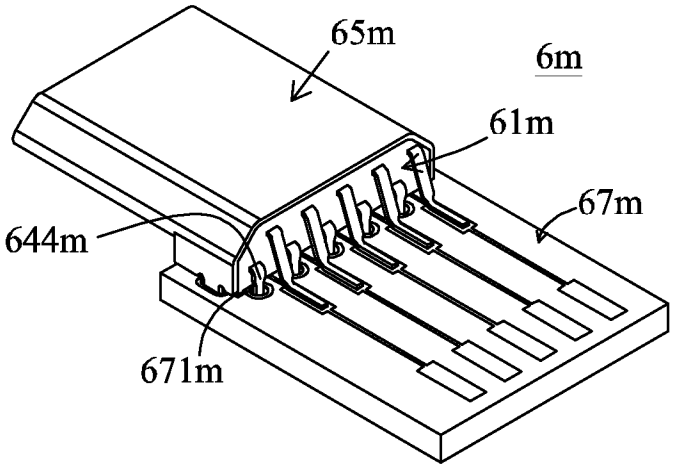
FIG. 162 is a schematic view showing different aspects of the bidirectional duplex electrical connector of the 32nd embodiment.

FIG. 161 shows that the bidirectional duplex electrical connector 6A includes an insulation seat 61A and an outer housing 65A, wherein its appearance structure is slightly different from the bidirectional duplex electrical connector 6, but its inner structures and operations are substantially the same, and detailed descriptions thereof will be omitted. FIG. 162 shows another bidirectional duplex electrical connector 6*m*, wherein the appearance structures of the insulation seat 61*m* and the outer housing 65*m* are substantially the same those of the bidirectional duplex electrical connector 6A, but the pin 644*m* of its lower terminal interface is an inserting pin, so the circuit board 67*m* includes the opening hole 671*m* for accommodating the pin 644*m*, and the opening hole 671*m* may be filled with solder to establish the electrical connection between the lower terminal interface and the circuit board 67*. The upper terminal interface is connected to the pin bonding pad 671*m* of the circuit board 67*m* by SMT.

Figure 163:
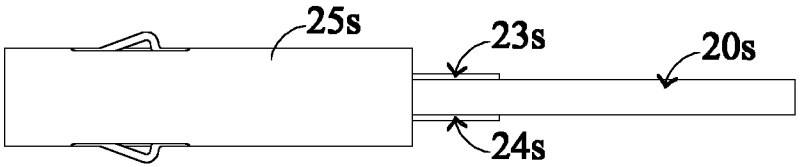
FIG. 163 is a schematic view showing the circuit board of the bidirectional duplex electrical connector of the 32nd embodiment.

Referring to FIG. 163, the configuration relationship between the circuit board and the pins will be further explained. The circuit board 20*s* extends outside from the rear of the housing 25*s*, and multiple upper pins 23*s* and multiple lower pins 24*s* are respectively disposed on the top and bottom sides of the circuit board 20*s*, so the upper and lower pins of the upper and lower contact terminals of the invention may be disposed on the same one side of the circuit board or are respectively disposed on the top and bottom sides. Thus, the circuit board of the invention includes multiple upper pin bonding pads, multiple lower pin bonding pads, multiple wire pads, multiple turning cascaded structures and multiple serial holes. The upper pin bonding pads correspond to the upper contact terminals, and are disposed on the upper surface of the circuit board and may be connected to the corresponding upper contact terminals. Second, the upper pin bonding pads are assigned with terminal serial numbers A1 to A5. The lower pin bonding pads correspond to the lower contact terminals, and are disposed on the lower surface of the circuit board, which is different from the surface on which the multiple upper pin bonding pads are disposed. The multiple lower pin bonding pads function to respectively connect to the corresponding lower contact terminals, wherein the multiple lower pin bonding pads are also assigned with the terminal serial numbers B1 to B5. The multiple wire pads are disposed on one side of the circuit board the same as the surface on which the multiple upper pin bonding pads are disposed, and may be respectively connected to the corresponding multiple wires. The invention is not restricted to the condition that the upper pin bonding pads and the lower pin bonding pads are disposed on the same surface of the circuit board, and the upper pin bonding pads and the lower pin bonding pads may also be respectively disposed on different surfaces, so that the connector may be applied to the bidirectional electrical plugs with different requirements.

The foregoing descriptions are merely preferred embodiments of the present invention and are not intended to limit the scope of the claims of the present invention. Therefore, other equivalent changes or modifications made without departing from the spirit disclosed by the present invention shall be included in the present invention and deemed as falling within the scope of the claim.

What is claimed is:

1. A bidirectional electrical connector capable of docking and positioning with a complementary connector in a reversible dual-positional manner, the bidirectional electrical connector comprising:

a housing made of a metal material;

an insulation seat;

a tongue disposed on a front end of the insulation seat, wherein the housing surrounds the tongue and is formed with a connection slot on top and bottom sides of the tongue, and the tongue is floatingly disposed in a middle section of the connection slot; and two rows of contact terminals, wherein each of the two rows of contact terminals is provided with a contact, the two rows of contacts of the two rows of contact terminals are respectively disposed on the top and bottom sides of the tongue, each of the two rows of contacts form a contact interface, and at least one pair of the contacts of the same circuit in the two contact interfaces are arranged reversely; wherein top and bottom surfaces of a front section of the tongue are projectingly provided with at least two limit projections, so that the at least two limit projections project beyond each of the two rows of contacts in an up-down direction, and the at least two limit projections of the top and bottom surfaces of the front section of the tongue can make each of the two rows of contacts be isolated from the housing to prevent each of the two rows of contacts from being short-circuited.

2. The bidirectional electrical connector according to claim 1, wherein each of the two rows of contacts are connected to at least one row of extensions, the at least one row of extensions are extended and connected to at least one row of fixing portions, the at least one row of fixing portions are fixed to the insulation seat, the at least one row of fixing portions are connected to at least one row of pins, and the at least one row of pins extend out of the insulation seat.

3. The bidirectional electrical connector according to claim 1, wherein the at least two limit projections are two limit projections disposed on left and right sides of the tongue, so that the tongue has an H-shaped tongue structure.

4. The bidirectional electrical connector according to claim 3, wherein the H-shaped tongue structure comprises the two limit projections having at least two outer sides with thicker dimensions and a middle section partition plate having a middle section with a thinner dimension.

5. The bidirectional electrical connector according to claim 4, wherein the two rows of contact terminals rest against the middle section partition plate, and each of the two rows of contacts project beyond middle section partition plate.

6. The bidirectional electrical connector according to claim 1, wherein the at least two limit projections are disposed on two outer sides of the two rows of contacts.

7. The bidirectional electrical connector according to claim 6, wherein there are more than two limit projections disposed between each of the rows of the contacts.

8. The bidirectional electrical connector according to claim 2, wherein in D+ and D− contact terminals of the two rows of contact terminals, width dimensions of the contacts and the extensions are narrower than width dimensions of the contacts and the extensions of ground and power contact terminals.

9. The bidirectional electrical connector according to claim 8, wherein in the D+ and D− contact terminals of the two rows of contact terminals, width dimensions of the fixing portions and the pins are narrower than width dimensions of the fixing portions and the pins of the ground and power contact terminals.

10. The bidirectional electrical connector according to claim 1, wherein the two rows of contacts are longer contacts on at least two sides.

11. The bidirectional electrical connector according to claim 1, wherein each of the two rows of contacts is provided with a bevel guide and a connection point.

12. The bidirectional electrical connector according to claim 1, wherein a hollow region is disposed between the tongue and the insulation seat, the tongue is connected to the insulation seat through at least two metal elastic sheets, and the tongue can float up and down relatively to the insulation seat through elastic movements of the at least two metal elastic sheets.

13. The bidirectional electrical connector according to claim 1, wherein the bidirectional electrical connector is applicable to: an adapter device comprising a HUB expander, a power bank/charger/mobile power, or a flash drive/U-disk/thumb drive/mobile hard drive; or another electronic device.

14. The bidirectional electrical connector according to claim 1, wherein the contacts of the two contact interfaces of the same circuit are arranged reversely; or the contacts of the two contact interfaces of the same contact interface and the same circuit are arranged reversely.

15. The bidirectional electrical connector according to claim 1, wherein the contacts of the two contact interfaces of the same circuit are electrically connected together; or the contacts of the two contact interfaces of the same contact interface and the same circuit are electrically connected together; or in the two contact interfaces, the contacts of the same ground circuit are electrically connected, together, and the contacts of the same power circuit are electrically connected together.

16. The bidirectional electrical connector according to claim 1, wherein the two contact interfaces are respectively provided with contacts of ground circuits, contacts of power circuits and contacts of D+ and D− signal circuits.

17. The bidirectional electrical connector according to claim 1, wherein the two rows of contact terminals are embedded into the insulation seat to be one-time plastic injection molded the tongue; or the two rows of contact terminals are one-time embedded and plastic injection molded.

18. The bidirectional electrical connector according to claim 1, wherein the contacts of the same ground circuit and the same power circuit in the upper and lower rows of contact terminals are connected to a transversal extension in a top-bottom and one-left-one-right manner, and the transversal extensions of the same circuit are embedded into, injection molded with and fixed to the tongue.

19. The bidirectional electrical connector according to claim 1, wherein the top and bottom surfaces of the front section of the tongue have concave-convex structures.

* * * * *